US005985527A

United States Patent [19]

Haijima et al.

[11] Patent Number: 5,985,527

[45] Date of Patent: Nov. 16, 1999

[54] SILVER HALIDE PHOTOGRAPHIC LIGHT-SENSITIVE MATERIAL AND METHOD FOR FORMING IMAGES

[75] Inventors: Akimitsu Haijima; Shunji Takada, both of Minami-Ashigara, Japan

[73] Assignee: Fuji Photo Film Co., Ltd., Kanagawa, Japan

[21] Appl. No.: 08/679,266

[22] Filed: Jul. 12, 1996

[30] Foreign Application Priority Data

Jul. 14, 1995 [JP] Japan ..... 7-200336

[51] Int. Cl.[6] ..... G03C 7/392; G03C 1/035

[52] U.S. Cl. ..... 430/383; 430/567; 430/486; 430/491; 430/456; 430/457; 430/957

[58] Field of Search ..... 430/567, 569, 430/486, 491, 456, 457, 383, 957

[56] References Cited

U.S. PATENT DOCUMENTS

| | | | |
|---|---|---|---|
| 3,756,822 | 9/1973 | Sahyun | 430/17 |
| 4,582,775 | 4/1986 | Toriuchi et al. | 430/219 |
| 4,952,489 | 8/1990 | Amicucci | 430/567 |
| 5,063,143 | 11/1991 | Hirose et al. | 430/419 |
| 5,244,783 | 9/1993 | Chang | 430/567 |
| 5,250,408 | 10/1993 | Chang et al. | 430/567 |
| 5,314,798 | 5/1994 | Brust et al. | 430/567 |
| 5,320,937 | 6/1994 | Ihama | 430/567 |
| 5,395,744 | 3/1995 | Sowinski et al. | 430/567 |
| 5,399,471 | 3/1995 | Murai | 430/567 |
| 5,401,621 | 3/1995 | Kojima | 430/393 |
| 5,491,050 | 2/1996 | Brust et al. | 430/567 |
| 5,508,160 | 4/1996 | Maskasky | 430/567 |
| 5,667,949 | 9/1997 | Szajewski | 430/567 |
| 5,667,954 | 9/1997 | Irving et al. | 430/567 |
| 5,672,467 | 9/1997 | Buitano et al. | 430/567 |
| 5,709,981 | 1/1998 | Szajewski | 430/567 |
| 5,709,988 | 1/1998 | Black et al. | 430/567 |

*Primary Examiner*—Mark F. Huff

*Attorney, Agent, or Firm*—Birch, Stewart, Kolasch & Birch, LLP

[57] ABSTRACT

A silver halide photographic light-sensitive material has at least one silver halide emulsion layer on a support, wherein the silver halide emulsion layer contains a silver halide emulsion consisting of tabular silver halide grains not containing a cavity extending through two major planes opposing each other and having an average aspect ratio of 1.5 or more, except that 20% or more of the tabular silver halide grains started to be developed containing a cavity extending through the major planes when the silver halide emulsion was developed with a color developer containing a silver halide solvent and a p-phenylenediamine-based color developing agent for 60 sec. A method for forming images includes the step of performing color development for the material for 25 to 90 sec by using a color developing solution containing thiosulfate, methanethiosulfonate, thiocyanate or at least one of the silver halide solvents represented by the formula (A), (B), (C), (D) and (E) each defined in the specification.

7 Claims, 1 Drawing Sheet

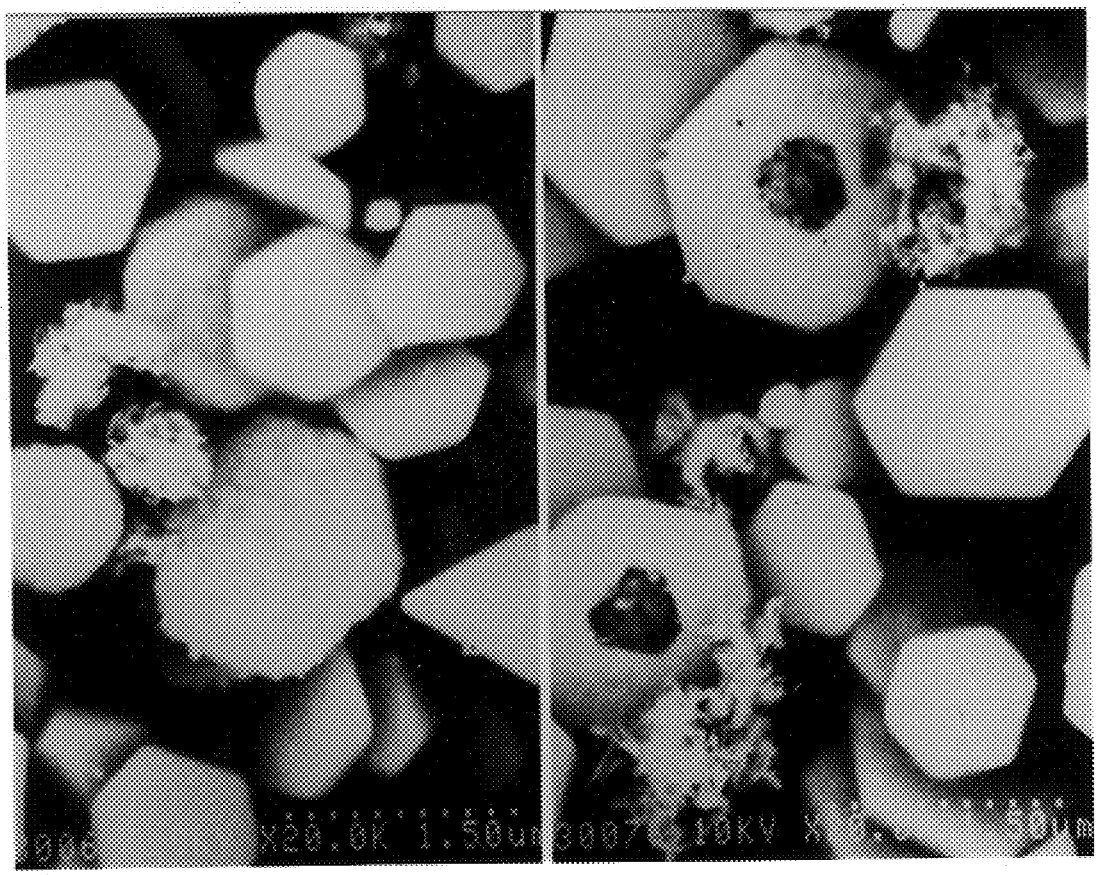
FIGURE

SILVER HALIDE PHOTOGRAPHIC LIGHT-SENSITIVE MATERIAL AND METHOD FOR FORMING IMAGES

BACKGROUND OF THE INVENTION

1. Field of the Invention

The present invention relates to a silver halide photographic light-sensitive material suited to very rapid processing and, more particularly, to a silver halide photographic light-sensitive material which achieves a high sensitivity, a high image quality (graininess and sharpness), and a high color reproduction when color-developed for a short time period by using a color developer having an improved solubility of a silver halide.

2. Description of the Related Art

Recently, photo studios (called miniature laboratories) in which a small automatic processor is installed behind the counter are built in many places, and so it becomes possible to perform photographic processing near users. Accordingly, demands for rapid processing are more and more increasing. However, the speed of the conventional processing is increased in a desilvering step after a color development step. That is, there has been almost no reduction in the time of the color development step since the color development time was shortened to 3 min 15 sec by C-41 processing introduced by Eastman Kodak Co. in 1972.

Presently, the ratio of the color development time in the whole development time is more and more increasing. Therefore, to achieve a higher processing speed it is essential to develop a technique by which the color development time is largely shortened.

Generally, in the color development step a color developing agent approaches (contacts) the surface of each silver halide grain and forms a latent image in an exposed silver halide grain. In a portion (development start point) where this latent image exists, an oxidation-reduction reaction occurs between the color developing agent and the silver halide. The silver halide is reduced to produce silver, releasing halogen ions into the developer. On the other hand, the color developing agent is oxidized to become semiquinone and then quinonediimine, and this quinonediimine reacts with a color coupler (coupler) to form a dye image.

To shorten the color development step, it is well known to raise development activity by increasing the temperature or pH of a developer or increasing the density of a color developing agent. Unfortunately, neither method can achieve a high enough processing speed. Furthermore, a developer is greatly deteriorated resulting in increase in the density (stain) in an unexposed portion or degradation of the image quality such as the graininess or the color reproduction.

To raise the developing speed of a silver halide, a method of increasing the silver chloride content is also usable. As described previously, a silver halide grain beginning to be developed releases halogen ions into a developer when silver is produced in a latent image portion. A silver halide which releases halogen ions more easily (i.e., which has a higher solubility) has a higher developing speed. Accordingly, the developing speed is increased in the order of silver iodide, silver bromide, and silver chloride. This method of raising the developing speed by increasing the silver chloride content is disclosed in JP-A-3-149546 ("JP-A" means Published Unexamined Japanese Patent Application). Unfortunately, the method has the drawback that the sensitivity decreases and the image quality such as the graininess also decreases when the silver chloride content is increased. Therefore, the method has not been applied yet to photographic color negative light-sensitive materials required to have a high sensitivity and a high image quality.

SUMMARY OF THE INVENTION

It is therefore an object of the present invention to provide a silver halide photographic light-sensitive material which can be color-developed very rapidly, i.e., which achieves a high developing speed, a high sensitivity, and a high image quality (graininess, sharpness, and color reproduction).

The above object of the present invention is achieved by the following means.

(1) A silver halide photographic light-sensitive material having at least one silver halide emulsion layer on a support, wherein the silver halide emulsion layer contains a silver halide emulsion consisting of tabular silver halide grains not containing a cavity extending through two major planes opposing each other and having an average aspect ratio of 1.5 or more, and those of the tabular silver halide grains in the number corresponding to 20% or more of silver halide grains started to be developed, contain a cavity extending through the major planes when the silver halide emulsion was developed with a color developing solution containing a silver halide solvent and a p-phenylenediamine-based color developing agent for 60 sec.

(2) The material described in item (1), wherein the tabular silver halide grain has a development start point in an outer peripheral portion.

(3) The material described in item (1), wherein a silver halide in an outer peripheral portion of a major plane of the tabular silver halide grain is sparingly soluble in the color developing agent as compared to a silver halide in a central portion.

(4) The material described in item (3), wherein the silver halide in the outer peripheral portion is silver iodobromide containing a larger amount of silver iodide than in the central portion.

(5) The material described in item (1), wherein in the silver halide emulsion not less than 40% of the tabular silver halide grains started to be developed contain a cavity extending through the major planes.

(6) The material described in item (1), wherein the silver halide solvent is Compound (B-3) below and the p-phenylenediamine-based color developing agent is 2-methyl-4-(N-ethyl-N-(β-hydroxyethyl)amino)aniline.

(B-3)

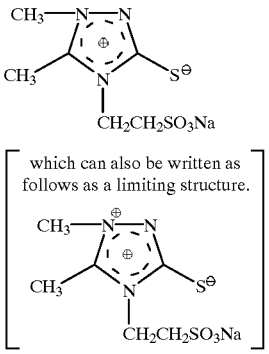

(7) The material described in item (1), wherein the color developing solution contains 2.0 g of Diethylenetriaminepentaacetic acid, 3.3 g of 1-hydroxyethylidene-1,1-diphosphonic acid, 4.0 g of Sodium sulfite, 37.5 g of Potassium carbonate, 2.0 g of Potassium bromide, 1.3 mg of Potassium iodide, 13.0 g of Disodium N,N-bis(sulfonateethyl) hydroxylamine, 11.0 g of 2-methyl-4-(N-ethyl-N-(β-hydroxyethyl) amino)aniline sulfate, 1.0 mmol of Silver halide solvent (B-3) of the present invention, and Water to make 1.0 l, pH of the color developing solution being controlled by potassium hydroxide or sulfuric acid 10.05.

(8) The material described in item (1), characterized by containing a compound which reacts with an oxidized form of a color developing agent and releases the compound which decreases a solubility of a silver halide.

(9) The material described in item (1), wherein the compound which releases a compound which decreases the solubility of a silver halide is represented by Formula (I) below.

$$A\text{-}\{(L1)_a\text{—}(B)_m\}_p\text{—}(L2)_n\text{—}DI \qquad \text{Formula (I)}$$

wherein A represents a group which reacts with an oxidized form of an aromatic primary amine developer and cleaves $\{(L1)_a\text{—}(B)_m\}_p\text{—}(L2)_n\text{—}DI$, L1 represents a group which cleaves a right-hand bond (with $(B)_m$) after a bond at the left of L1 indicated by Formula (I) cleaves, B represents a group which reacts with the developing agent oxidized form and cleaves a bond at the left of L2 indicated by Formula (I), L2 represents a group which cleaves a right-hand bond (with DI) after the bond at the left of L2 indicated by Formula (I) cleaves, DI represents a development inhibitor, each of a, m, and n represents 0 or 1, p represents any integer from 0 to 2, and, if p is greater than 1, each $(L1)_a\text{—}(B)_m$' can be the same or different.

(10) The material described in item (9), wherein the DI represents benzotriazolyls.

(11) A silver halide photographic light-sensitive material having at least one silver halide emulsion layer on a support, wherein the silver halide emulsion layer contains silver halide grains not containing a cavity extending through two major planes opposing each other and having an average aspect ratio of 1.5 or more, 5% to 25% of the silver halide grains contain a cavity extending through the two major planes opposing each other when given an exposure equivalent to an average value (logE1+logE2)/2 of an exposure amount logE1 by which a density equivalent to (fog+0.1) is given on a characteristic curve and an exposure amount logE2 by which a density equivalent to (maximum color density−0.1) is given on the characteristic curve, developed with a color developing solution containing a silver halide solvent and a p-phenylenediamine-based color developing agent at 45.0° C. for 60 sec. and washed with water.

(12) The material described in item (11), wherein the tabular silver halide grain has a development start point in an outer peripheral portion.

(13) The material described in item (11), wherein a silver halide in an outer peripheral portion of a major plane of the tabular silver halide grain is sparingly soluble in the color developing agent as compared to the silver halide in a central portion.

(14) The material described in item (13), wherein the silver halide in the outer peripheral portion is silver iodobromide containing a larger amount of silver iodide than in the central portion.

(15) The material described in item (11), wherein in the silver halide emulsion not less than 40% of the tabular silver halide grains started to be developed contain a cavity extending through the major planes.

(16) The material described in item (11), wherein the silver halide solvent is Compound (B-3) below and the p-phenylenediamine-based color developing agent is 2-methyl-4-(N-ethyl-N-(β-hydroxyethyl)amino) aniline.

(B-3)

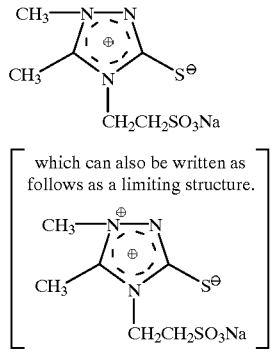

(17) The material described in item (1), wherein the color developing solution contains 2.0 g of Diethylenetriaminepentaacetic acid, 3.3 g of 1-hydroxyethylidene-1,1-diphosphonic acid, 4.0 g of Sodium sulfite, 37.5 g of Potassium carbonate, 2.0 g of Potassium bromide, 1.3 mg of Potassium iodide, 13.0 g of Disodium N,N-bis(sulfonateethyl) hydroxylamine, 11.0 g of 2-methyl-4-(N-ethyl-N-(β-hydroxyethyl) amino)aniline sulfate, 1.0 mmol of Silver halide solvent (B-3) of the present invention, and Water to make 1.0 l, pH of the color developing solution being controlled by potassium hydroxide or sulfuric acid 10.05.

(18) The material described in item (11), characterized by containing a compound which reacts with an oxidized form of a color developing agent and releases the compound which decreases a solubility of a silver halide.

(19) The material described in item (11), wherein the compound which releases a compound which decreases the solubility of a silver halide is represented by Formula (I) below.

$$A\text{-}\{(L1)_a\text{—}(B)_m\}_p\text{—}(L2)_n\text{—}DI \qquad \text{Formula (I)}$$

wherein A represents a group which reacts with an oxidized form of an aromatic primary amine developer and cleaves $\{(L1)_a\text{—}(B)_m\}_p\text{—}(L2)_n\text{—}DI$, L1 represents a group which cleaves a right-hand bond (with $(B)_m$) after a bond at the left of L1 indicated by Formula (I) cleaves, B represents a group which reacts with the developing agent oxidized form and cleaves a bond at the left of L2 indicated by Formula (I), L2 represents a group which cleaves a right-hand bond (with DI) after the bond at the left of L2 indicated by Formula (I) cleaves, DI represents a development inhibitor, each of a, m, and n represents 0 or 1, p represents any integer from 0 to 2, and, if p is greater than 1, each p $(L1)_a$—$(B)_m$'s can be the same or different.

(20) The material described in item (19), wherein the DI represents benzotriazolyls.

(21) A method for forming images comprising the step of performing color development for a material described in item (1) for 25 to 90 sec by using a color developing solution containing at least one of the silver halide solvents selected from thiosulfate, methanethiosulfonate, thiocyanate and the compound represented by the Formulas (A) to (E) below.

Formula (A)

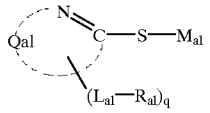

wherein $Q_{a1}$ represents a nonmetal atom group necessary to form a 5- or 6-membered heterocyclic ring which can be condensed with a carbon aromatic ring or a hetero aromatic ring, $L_{a1}$ represents a single bond, a divalent aliphatic group, a divalent aromatic hydrocarbon group, a divalent heterocyclic group, or a linking group as a combination thereof, $R_{a1}$ represents carboxylic acid or a salt thereof, sulfonic acid or a salt thereof, phosphonic acid or a salt thereof, an amino group, or ammonium salt, q represents any integer from 1 to 3, and $M_{a1}$ represents a hydrogen atom or a cation.

Formula (B)

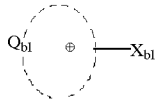

wherein $Q_{b1}$ represents a 5- or 6-membered meso-ionic ring constituted by a carbon atom, a nitrogen atom, an oxygen atom, a sulfur atom, or a selenium atom, $X_{b1}^-$ represents —$O^-$, —$S^-$, or —$N^-R_{b1}$, and $R_{b1}$ represents an aliphatic group, an aromatic hydrocarbon group, or a heterocyclic group.

$$L_{C1}—(A_{C1}—L_{C2})_r—A_{C2}—L_{C3}$$ Formula (C)

wherein $L_{C1}$ and $L_{C3}$ can be the same or different and each represents an aliphatic group, an aromatic hydrocarbon group, or a heterocyclic group, $L_{C2}$ represents a divalent aliphatic group, a divalent aromatic hydrocarbon group, a divalent heterocyclic linking group, or a linking group as a combination thereof, each of $A_{C1}$ and $A_{C2}$ represents —S—, —O—, —$NR_{C20}$—, —CO—, —$SO_2$—, or a group as a combination thereof, r represents any integer from 1 to 10, at least one of $L_{C1}$ and $L_{C3}$ being substituted by —$SO_3M_{C1}$, —$PO_3M_{C2}M_{C3}$, —$NR_{C1}(R_{C2})$, —$N^+R_{C3}(R_{C4})(R_{C5})\cdot X_{C1}^-$, —$SO_2NR_{C6}(R_{C7})$, —$NR_{C8}SO_2R_{C9}$, —$CONR_{C10}(R_{C11})$, —$NR_{C12}COR_{C13}$, —$SO_2R_{C14}$, —$PO(—NR_{C15}(R_{C16}))_2$, —$NR_{C17}CONR_{C18}(R_{C19})$, —$COOM_{C4}$, or a heterocyclic group, $M_{C1}$, $M_{C2}$, $M_{C3}$, and $M_{C4}$ can be the same or different and each represents a hydrogen atom or a counter cation, $R_{C1}$ to $R_{C20}$ can be the same or different and each represents a hydrogen atom, a substituted or a unsubstituted 1- to 12-carbon aliphatic group, or a substituted or unsubstituted 6- to 12-carbon aromatic group, and $X_{C1}^-$ represents a counter anion, at least one of $A_{C1}$ and $A_{C2}$ representing —S—.

Formula (D)

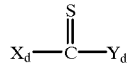

wherein each of $X_d$ and $Y_d$ represents an aliphatic group, an aromatic hydrocarbon group, a heterocyclic group, —$N(R_{d1})R_{d2}$—$N(R_{d3})N(R_{d4})R_{d5}$, —$OR_{d6}$, or —$SR_{d7}$, $X_d$ and $Y_d$ may be bonded each other to form a ring but being not enolized, and at least one of $X_d$ and $Y_d$ being substituted by carboxylic acid or a salt thereof, sulfonic acid or a salt thereof, phosphonic acid or a salt thereof, an amino group, an ammonium group, or a hydroxyl group, each of $R_{d1}$, $R_{d2}$, $R_{d3}$, $R_{d4}$, and $R_{d5}$ represents a hydrogen atom, an aliphatic group, an aromatic hydrocarbon group, or a heterocyclic group, and each of $R_{d6}$ and $R_{d7}$ represents a hydrogen atom, a cation, an aliphatic group, an aromatic hydrocarbon group, or a heterocyclic group.

Formula (E)

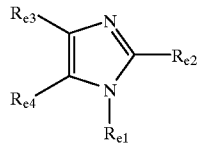

wherein each of $R_{e1}$, $R_{e2}$, $R_{e3}$, and $R_{e4}$ represents a hydrogen atom, an alkyl group, or an alkenyl group.

(22) The method described in item (21), wherein the silver halide solvent is the compound represented by the Formula (A) or (B) below.

Formula (A)

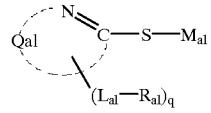

wherein $Q_{a1}$ represents a nonmetal atom group necessary to form a 5- or 6-membered heterocyclic ring which can be condensed with a carbon aromatic ring or a hetero aromatic ring, $L_{a1}$ represents a single bond, a divalent aliphatic group, a divalent aromatic hydrocarbon group, a divalent heterocyclic group, or a linking group as a combination thereof, $R_{a1}$ represents carboxylic acid or a salt thereof, sulfonic acid or a salt thereof, phosphonic acid or a salt thereof, an amino group, or ammonium salt, q represents any integer from 1 to 3, and $M_{a1}$ represents a hydrogen atom or a cation.

Formula (B)

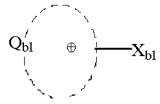

wherein $Q_{b1}$ represents a 5- or 6-membered meso-ionic ring constituted by a carbon atom, a nitrogen atom, an oxygen atom, a sulfur atom, or a selenium atom, $X_{b1}^-$ represents —$O^-$, —$S^-$, or —$N^-R_{b1}$, and $R_{b1}$ represents an aliphatic group, an aromatic hydrocarbon group, or a heterocyclic group.

(23) The method described in item (22), wherein the silver halide solvent is the compound represented by the Formula (A-1) or (B-1) below.

Formula (A-1)

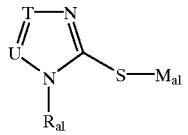

wherein each of $M_{a1}$ and $R_{a1}$ has the same meaning as in Formula (A), each of T and U represents C—$R_{a2}$ or N, $R_{a2}$ represents a hydrogen atom, a hydroxy group, a nitro group, an alkyl group, an alkenyl group, an aralkyl group, an aryl group, a carbonamide group, a sulfonamide group, a ureido group, or a 1- to 4-carbon alkyl group substituted by one or two groups selected from a carboxylic acid or salt thereof and a sulfonic acid or salt thereof.

Formula (B-1)

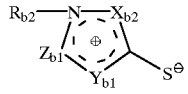

wherein $X_{b2}$ represents N or C—$R_{b3}$, $Y_{b1}$ represents O, S, N, or N—$R_{b4}$, $Z_{b1}$ represents N, N—$R_{b5}$, or C—$R_{b6}$.

Each of $R_{b2}$, $R_{b3}$, $R_{b4}$, $R_{b5}$, and $R_{b6}$ represents an aliphatic group, an aromatic group, a heterocyclic group, an amino group, an acylamino group, a sulfonamide group, a ureido group, a sulfamoylamino group, an acyl group, or a carbamoyl group. $R_{b3}$ and $R_{b6}$ can be a hydrogen atom. Each pair of $R_{b2}$ and $R_{b3}$, $R_{b2}$ and $R_{b5}$, $R_{b2}$ and $R_{b6}$, $R_{b4}$ and $R_{b5}$, and $R_{b4}$ and $R_{b6}$ may be bonded to each other to form a ring.

(24) The method described in item (22), wherein the silver halide solvent is the compound represented by the Formula (A-1) below.

Formula (A-1)

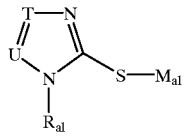

wherein T=U=N and $R_{a1}$ represents a 1- to 4-carbon alkyl group substituted by one or two groups selected from carboxylic acid or its salt and sulfonic acid or its salt.

(25) The method described in item (22), wherein the silver halide solvent is the compound represented by the Formula (B-1) below.

Formula (B-1)

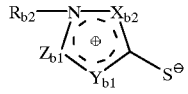

wherein $X_{b2}$ represents N, $Y_{b1}$ represents N—$R_{b4}$, and $Z_{b1}$ represents C—$R_{b6}$, each of $R_{b2}$ and $R_{b4}$ represents a 1- to 3-carbon alkyl group, $R_{b6}$ represents a hydrogen atom or a 1- to 3-carbon alkyl group, at least one alkyl group of $R_{b2}$, $R_{b4}$, and $R_{b6}$ is substituted by a carboxylic acid group or a sulfonic acid group.

(26) A method for forming images comprising the step of performing color development for a material described in item (11) for 25 to 90 sec by using a color developing solution containing at least one of the silver halide solvents selected from thiosulfate, methanethiosulfonate, thiocyanate and the compound represented by the Formulas (A) to (E) below.

Formula (A)

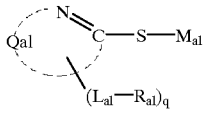

wherein $Q_{a1}$ represents a nonmetal atom group necessary to form a 5- or 6-membered heterocyclic ring which can be condensed with a carbon aromatic ring or a hetero aromatic ring, $L_{a1}$ represents a single bond, a divalent aliphatic group, a divalent aromatic hydrocarbon group, a divalent heterocyclic group, or a linking group as a combination thereof, $R_{a1}$ represents carboxylic acid or a salt thereof, sulfonic acid or a salt thereof, phosphonic acid or a salt thereof, an amino group, or ammonium salt, q represents any integer from 1 to 3, and $M_{a1}$ represents a hydrogen atom or a cation.

Formula (B)

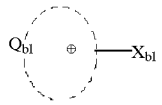

wherein $Q_{b1}$ represents a 5- or 6-membered meso-ionic ring constituted by a carbon atom, a nitrogen atom, an oxygen atom, a sulfur atom, or a selenium atom, $X_{b1}^-$ represents —$O^-$, —$S^-$, or —$N^-R_{b1}$, and $R_{b1}$ represents an aliphatic group, an aromatic hydrocarbon group, or a heterocyclic group.

$$L_{C1}—(A_{C1}—L_{C2})_r—A_{C2}—L_{C3} \qquad \text{Formula (C)}$$

wherein $L_{C1}$ and $L_{C3}$ can be the same or different and each represents an aliphatic group, an aromatic hydrocarbon group, or a heterocyclic group, $L_{C2}$ represents a divalent aliphatic group, a divalent aromatic hydrocarbon group, a divalent heterocyclic linking group, or a linking group as a combination thereof, each of $A_{C1}$ and $A_{C2}$ represents —S—, —O—, —$NR_{C20}$—, —CO—, —$SO_2$—, or a group as a combination thereof, r represents any integer from 1 to 10, at least one of $L_{C1}$ and $L_{C3}$ being substituted by —$SO_3M_{C1}$, —$PO_3M_{C2}M_{C3}$, —$NR_{C1}(R_{C2})$, —$N^+R_{C3}(R_{C4})(R_{C5})\cdot X_{C1}^-$, —$SO_2NR_{C6}(R_{C7})$, —$NR_{C8}SO_2R_{C9}$, —$CONR_{C10}(R_{C11})$, —$NR_{C12}COR_{C13}$, —$SO_2R_{C14}$, —$PO(—NR_{C15}(R_{C16}))_2$, —$NR_{C17}CONR_{C18}(R_{C19})$, —$COOM_{C4}$, or a heterocyclic group, $M_{C1}$, $M_{C2}$, $M_{C3}$, and $M_{C4}$ can be the same or different and each represents a hydrogen atom or a counter cation, $R_{C1}$ to $R_{C20}$ can be the same or different and each represents a hydrogen atom, a substituted or a unsubstituted 1- to 12-carbon aliphatic group, or a substituted or unsubstituted 6- to 12-carbon aromatic group, and $X_{C1}^-$ represents a counter anion, at least one of $A_{C1}$ and $A_{C2}$ representing —S—.

Formula (D)

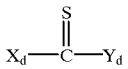

wherein each of $X_d$ and $Y_d$ represents an aliphatic group, an aromatic hydrocarbon group, a heterocyclic group, —$N(R_{d1})R_{d2}$, —$N(R_{d3})N(R_{d4})R_{d5}$, —$OR_{d6}$, or —$SR_{d7}$, $X_d$ and $Y_d$ may be bonded each other to form a ring but being not enolized, and at least one of $X_d$ and $Y_d$ being substituted by carboxylic acid or a salt thereof, sulfonic acid or a salt thereof, phosphonic acid or a salt thereof, an amino group, an ammonium group, or a hydroxyl group, each of $R_{d1}$, $R_{d2}$, $R_{d3}$, $R_{d4}$, and $R_{d5}$ represents a hydrogen atom, an aliphatic group, an aromatic hydrocarbon group, or a heterocyclic group, and each of $R_{d6}$ and $R_{d7}$ represents a hydrogen atom, a cation, an aliphatic group, an aromatic hydrocarbon group, or a heterocyclic group.

Formula (E)

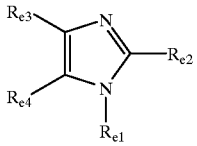

wherein each of $R_{e1}$, $R_{e2}$, $R_{e3}$, and $R_{e4}$ represents a hydrogen atom, an alkyl group, or an alkenyl group.

(27) The method described in item (26), wherein the silver halide solvent is the compound represented by the Formula (A) or (B) below.

Formula (A)

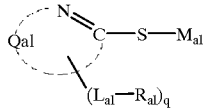

wherein $Q_{a1}$ represents a nonmetal atom group necessary to form a 5- or 6-membered heterocyclic ring which can be condensed with a carbon aromatic ring or a hetero aromatic ring, $L_{a1}$ represents a single bond, a divalent aliphatic group, a divalent aromatic hydrocarbon group, a divalent heterocyclic group, or a linking group as a combination thereof, $R_{a1}$ represents carboxylic acid or a salt thereof, sulfonic acid or a salt thereof, phosphonic acid or a salt thereof, an amino group, or ammonium salt, q represents any integer from 1 to 3, and $M_{a1}$ represents a hydrogen atom or a cation.

Formula (B)

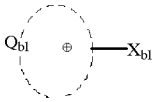

wherein $Q_{b1}$ represents a 5- or 6-membered meso-ionic ring constituted by a carbon atom, a nitrogen atom, an oxygen atom, a sulfur atom, or a selenium atom, $X_{b1}^-$ represents —$O^-$, —$S^-$, or —$N^-R_{b1}$, and $R_{b1}$ represents an aliphatic group, an aromatic hydrocarbon group, or a heterocyclic group.

(28) The method described in item (26), wherein the silver halide solvent is the compound represented by the Formula (A-1) or (B-1) below.

Formula (A-1)

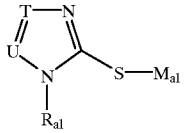

wherein each of $M_{a1}$ and $R_{a1}$ has the same meaning as in Formula (A), each of T and U represents C—$R_{a2}$ or N, $R_{a2}$ represents a hydrogen atom, a hydroxy group, a nitro group, an alkyl group, an alkenyl group, an aralkyl group, an aryl group, a carbonamide group, a sulfonamide group, a ureido group, or a 1- to 4-carbon alkyl group substituted by one or two groups selected from a carboxylic acid or a salt thereof and a sulfonic acid or salt thereof.

Formula (B-1)

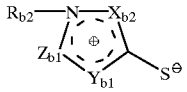

wherein $X_{b2}$ represents N or C—$R_{b3}$, $Y_{b1}$ represents O, S, N, or N—$R_{b4}$, $Z_{b1}$ represents N, N—$R_{b5}$l or C—$R_{b6}$.

Each of $R_{b2}$, $R_{b3}$, $R_{b4}$, $R_{b5}$, and $R_{b6}$ represents an aliphatic group, an aromatic group, a heterocyclic group, an amino group, an acylamino group, a sulfonamide group, a ureido group, a sulfamoylamino group, an acyl group, or a carbamoyl group. $R_{b3}$ and $R_{b6}$ can be a hydrogen atom. Each pair of $R_{b2}$ and $R_{b3}$, $R_{b2}$ and $R_{b5}$, $R_{b2}$ and $R_{b6}$, $R_{b4}$ and $R_{b5}$, and $R_{b4}$ and $R_{b6}$ may be bonded to each other to form a ring.

(29) The method described in item (26), wherein the silver halide solvent is the compound represented by the Formula (A-1) below.

Formula (A-1)

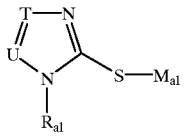

wherein T=U=N and $R_{a1}$ represents a 1- to 4-carbon alkyl group substituted by one or two groups selected from carboxylic acid or its salt and sulfonic acid or its salt.

(30) The method described in item (26), wherein the silver halide solvent is the compound represented by the Formula (B-1) below.

Formula (B-1)

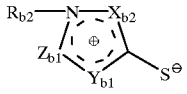

wherein $X_{b2}$ represents N, $Y_{b1}$ represents N—$R_{b4}$, and $Z_{b1}$ represents C—$R_{b6}$l each of $R_{b2}$ and $R_{b4}$ represents a 1- to 3-carbon alkyl group, $R_{b6}$ represents a hydrogen atom or a 1- to 3-carbon alkyl group, at least one alkyl group of $R_{b2}$, $R_{b4}$, and $R_{b6}$ is substituted by a carboxylic acid group or a sulfonic acid group.

BRIEF DESCRIPTION OF THE DRAWINGS

FIGURE shows electron micrographs of crystal structures of silver halide grains observed when silver halide emulsions of the present invention were subjected to predetermined color development.

DETAILED DESCRIPTION OF THE PREFERRED EMBODIMENT

The present invention will be described in more detail below.

In this specification, an aliphatic group, an aromatic hydrocarbon group, and a heterocyclic group are as follows unless stated otherwise.

An aliphatic group represents a substituted or nonsubstituted straight-chain, branched, or cyclic alkyl group, a substituted or nonsubstituted alkinyl group, or a substituted or nonsubstituted alkiny group. A divalent aliphatic group is a divalent form of any of these aliphatic groups and represents a substituted or nonsubstituted straight-chain, branched, or cyclic alkylene group, a substituted or nonsubstituted alkenylene group, or a substituted or nonsubstituted alkynylene group. Examples of the aliphatic group are a methyl, an ethyl, a propyl, a butyl, an isopropyl, a 2-hydroxypropyl, a hexyl, an octyl, a vinyl, a propenyl, a butenyl, a benzyl, and a phenethyl.

An aromatic hydrocarbon group represents a substituted or nonsubstituted aryl group which can be a monocyclic ring or can form a condensed ring together with an aromatic ring or a heterocyclic ring. A divalent aromatic hydrocarbon group represents a substituted or nonsubstituted arylene group which can be a monocyclic ring or can form a condensed ring together with an aromatic ring or a heterocyclic ring. Examples of the aromatic hydrocarbon group are a phenyl, a 2-chlorophenyl, a 3-methoxyphenyl, and a naphthyl.

A heterocyclic group represents a 3- to 10-membered, saturated or unsaturated, substituted or nonsubstituted heterocyclic group which has at least one of a nitrogen atom, an oxygen atom, or a sulfur atom as a hetero atom, and which can be a monocyclic ring or can form a condensed ring together with an aromatic ring or a heterocyclic ring. Examples of the heterocyclic ring are a pyrrole ring, an imidazole ring, a pyrazole ring, a pyridine ring, a pyrazine ring, a pyrimidine ring, a triazole ring, a thiadiazole ring, an oxadiazole ring, a quinoxaline ring, a tetrazole ring, a thiazole ring, and an oxazole ring.

Each group in this specification can be substituted unless stated otherwise. Examples of the substituent group which these groups can have are an alkyl group, an aralkyl group, an alkenyl group, an alkynyl group, an alkoxy group, an aryl group, an amino group, an acylamino group, a sulfonamide group, a ureido group, a urethane group, an aryloxy group, a sulfamoyl group, a carbamoyl group, an alkylthio group, an arylthio group, a sulfonyl group, a sulfinyl group, an acyl group, a hydroxy group, a halogen atom, a cyano group, a sulfo group, a carboxy group, a phosphono group, an aryloxycarbonyl group, an alkoxycarbonyl group, an acyloxy group, a nitro group, a hydroxamic acid group, and a heterocyclic group. Note that in the present invention, a branched alkyl group is regarded as a nonsubstituted alkyl group.

Formula (I) will be described in detail below.

A reaction process in which a compound represented by Formula (I) releases DI during development is represented by the following reaction formula for p=1.

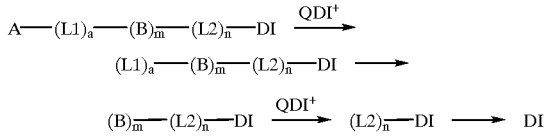

wherein each of A, L1, a, B, m, L2, n, and DI has the same meaning as explained in Formula (I), and $QDI^+$ means a developing agent in oxidized form.

In Formula (I), A more specifically represents a coupler moiety or an oxidation-reduction group.

Examples of the coupler moiety represented by A are a yellow coupler moiety (e.g., an open-chain ketomethylene type coupler moiety such as acylacetanilide or malondianilide), a magenta coupler moiety (e.g., 5-pyrazolone type, pyrazolotriazole type, or imidazopyrazole type coupler moiety), a cyan coupler moiety (e.g., a phenol type coupler moiety, a naphthol type coupler moiety, an imidazole type coupler moiety described in European Patent 249,453, or a pyrazolopyrimidine type coupler moiety described in European Patent 304,001), and a non-dye-forming coupler moiety (e.g., an indanone type or acetophenone type coupler moiety). It is also possible to use heterocyclic type coupler moieties described in U.S. Pat. Nos. 4,315,070, 4,183,752, 4,174,969, 3,961,959, and 4,171,223, and JP-A-52-82423.

When A represents an oxidation-reduction group, this oxidation-reduction group is a group which can be cross-oxidized by a developing agent in oxidized form. Examples of the oxidation-reduction group are hydroquinones, catechols, pyrogallols, 1,4-naphthohydroquinones, 1,2-naphthohydroquinones, sulfonamidophenols, hydrazides, and sulfonamidonaphthols. More specifically, these groups are those described in JP-A-61-230135, JP-A-62-251746, and JP-A-61-278852, U.S. Pat. Nos. 3,364,022, 3,379,529, 3,639,417, and 4,684,604, and J. Org. Chem., 29, 588 (1964).

In Formula (I), examples of the linking group represented by L1 and L2 are a group described in U.S. Pat. Nos. 4,146,396, 4,652,516, or 4,698,297, which uses a cleavage reaction of a hemiacetal; a timing group described in U.S. Pat. Nos. 4,248,962, 4,857,440, or 4,847,185, which causes a cleavage reaction by using an intramolecular nucleophilic reaction; a timing group described in U.S. Pat. Nos. 4,409,323 or 4,421,845, which causes a cleavage reaction by using an electron transfer reaction; a group described in U.S. Pat. No. 4,546,073, which causes a cleavage reaction by using a hydrolytic reaction of an iminoketal; and a group described in West German Patent 2,626,317, which causes a cleavage reaction by using a hydrolytic reaction of an ester. Each of L1 and L2 combines with $$A \text{ or } A—(L1)_a—(B)_m$$

at a hetero atom, preferably an oxygen atom, a sulfur atom, or a nitrogen atom, contained in it.

In Formula (I), the group represented by B is a group which forms an oxidation-reduction group or a coupler after being cleaved from $A—(L1)_a$, and has the same meaning as explained above for A. The group represented by B has a group which reacts with a developing agent in oxidized form and is released (i.e., a group bonded to the right side of B in Formula (I)). Examples of the group represented by B are a group represented by B in U.S. Pat. No. 4,824,772, a group represented by COUP(B) in U.S. Pat. No. 4,438,193, and a group represented by RED in U.S. Pat. No. 4,618,571. It is preferable that B combine with A—$(L1)_a$ at a hetero atom, preferably an oxygen atom or a nitrogen atom, contained in it. Examples of the group represented by DI in Formula (I) are a tetrazolylthio group, a thiazolylthio group, an oxadiazolylthio group, a triazolylthio group, a benzimidazolylthio group, a benzthiazolylthio group, a tetrazolylseleno group, a benzoxazolylthio group, a benzotriazolyl group, a triazolyl group, and a benzoimidazolyl group. These groups are described in, e.g., U.S. Pat. Nos. 3,227,554, 3,384,657, 3,615,506, 3,617,291, 3,733,201, 3,933,500, 3,958,993, 3,961,959, 4,149,886, 4,259,437, 4,095,984, 4,477,563, and 4,782,012, European Patents 354,532A and 348,139A, and U.S. Pat. No. 1,450,479.

A preferable range of a compound represented by Formula (I) will be described below.

In Formula (I), p is preferably 0 or 1.

A compound represented by Formula (I) is preferably a nondiffusion type. Most preferably, this nondiffusion group is contained in A, L1, or B.

In a compound represented by Formula (I), A is most preferably a coupler moiety.

The group represented by DI in Formula (I) is preferably a benzotriazolyl group, a tetrazolylthio group, a thiazolylthio group, or an oxadiazolylthio group. Of these groups, particularly a group having a high diffusibility in a light-sensitive material during color development processing is preferable. The diffusibility of the inhibiting group (DI) is evaluated by, e.g., a method described in JP-B-7-13734 ("JP-B" means Published Examined Japanese Patent Application). A group having a diffusibility of 0.4 or higher when evaluated by this evaluation method is preferably used. More specifically, a benzotriazolyl group is most preferable.

A compound represented by Formula (I) is particularly preferable when a=1, m=0, p=1, and n=0, when a=0, m=1, p=1, and n=0, or when a=1, m=0, p=1, and n=1. Any of these compounds is particularly excellent in color reproduction resulting from an interlayer effect and sharpness resulting from an edge effect.

Other examples of a compound represented by Formula (I) and its synthesis method are described in the well-known patents and literature cited to explain A, L1, B, L2, and DI and in JP-A-63-37346 and JP-A-61-156127.

Specific examples of the compounds represented by Formula (I) are as follows. Nonetheless, the compounds used in the present invention are not limited to these specified below.

(1)

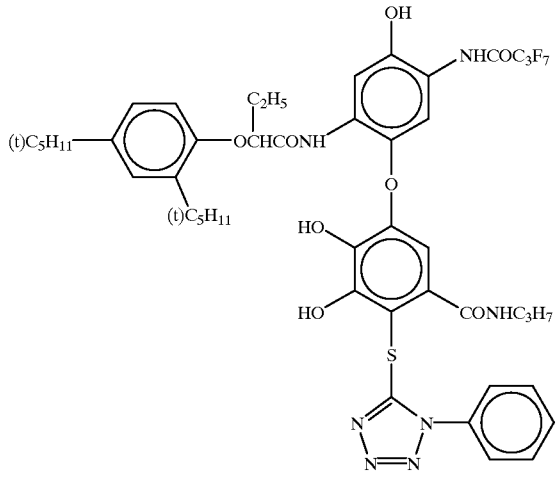

(2)

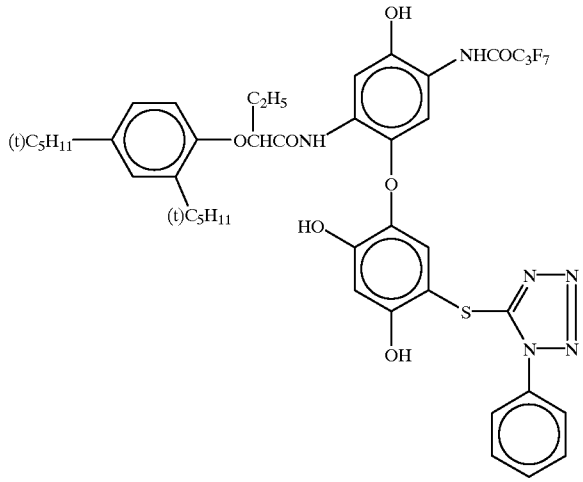

-continued
(3)
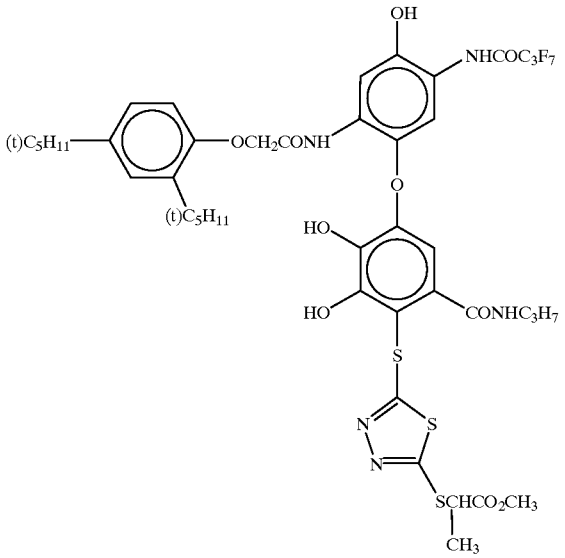
(4)
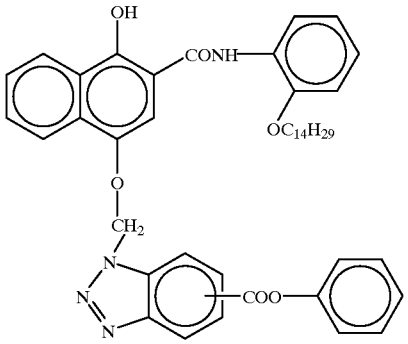
(5)
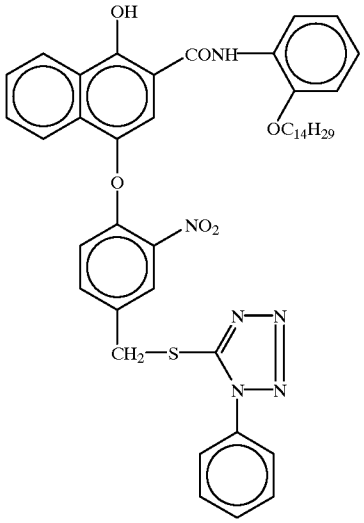

-continued
(6)
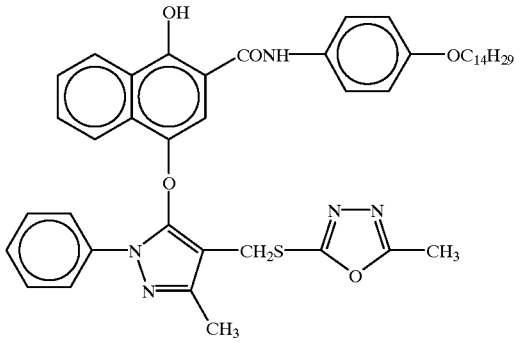
(7)
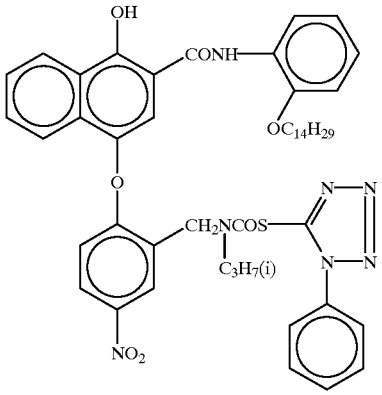
(8)
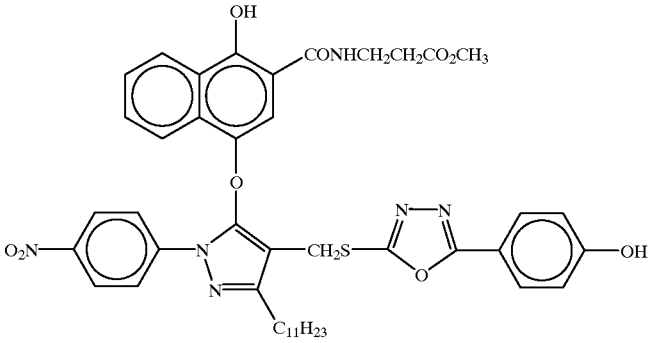
(9)
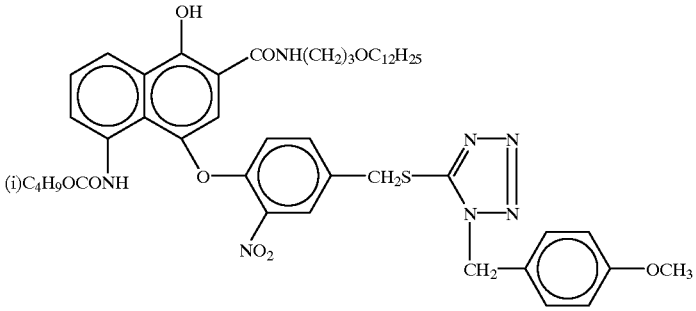

-continued
(10)
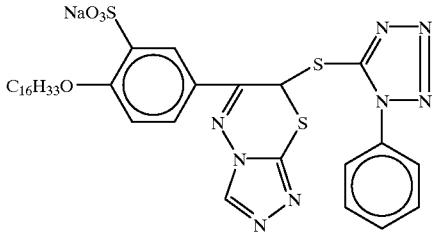
(11)
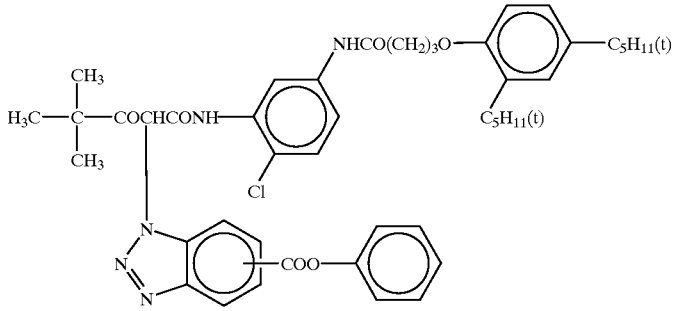
(12)
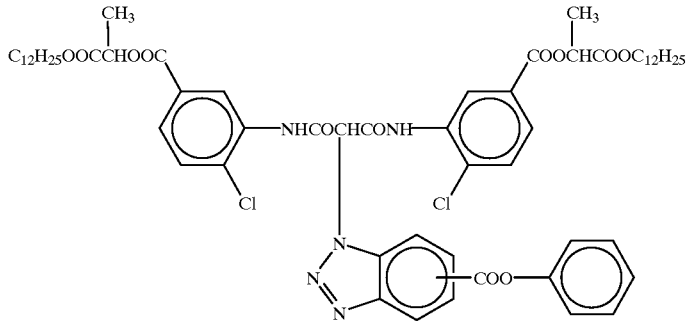
(13)
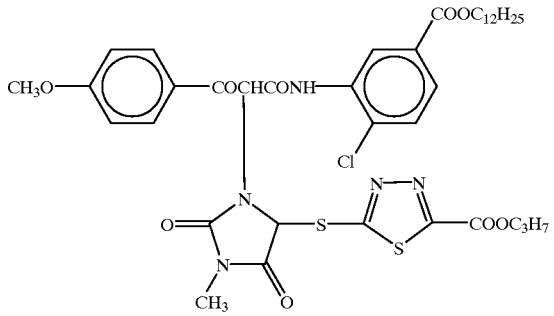

-continued
(14)
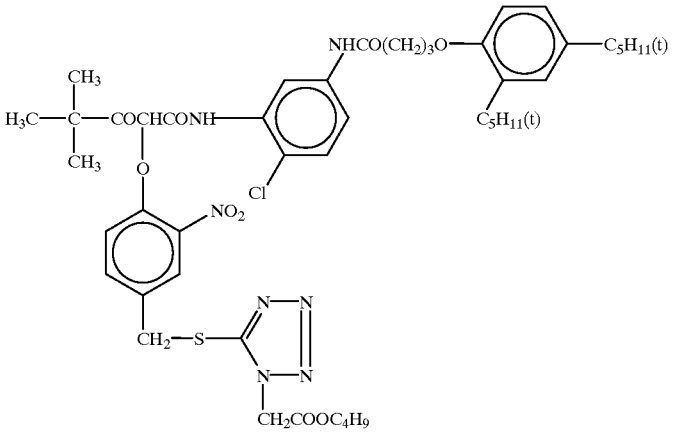
(15)
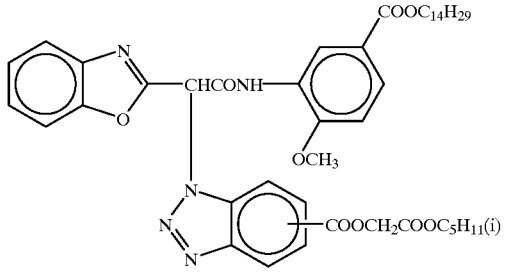
(16)
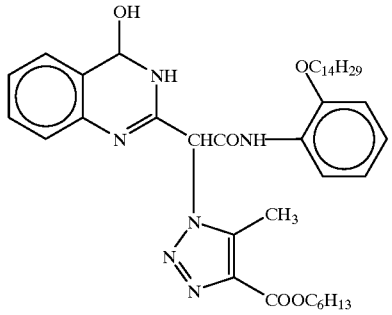
(17)
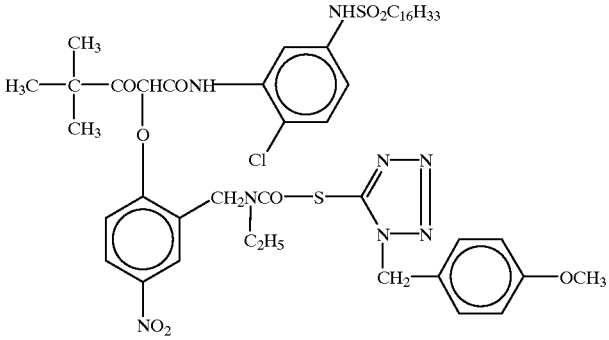

-continued
(18)
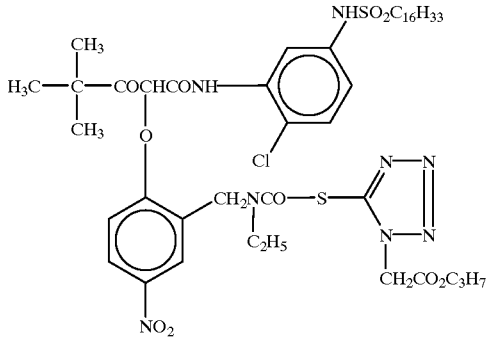
(19)
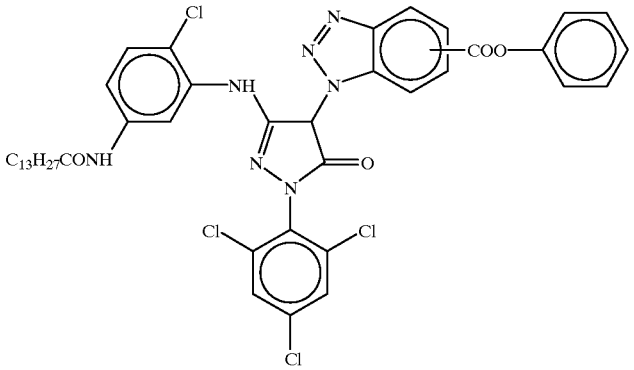
(20)
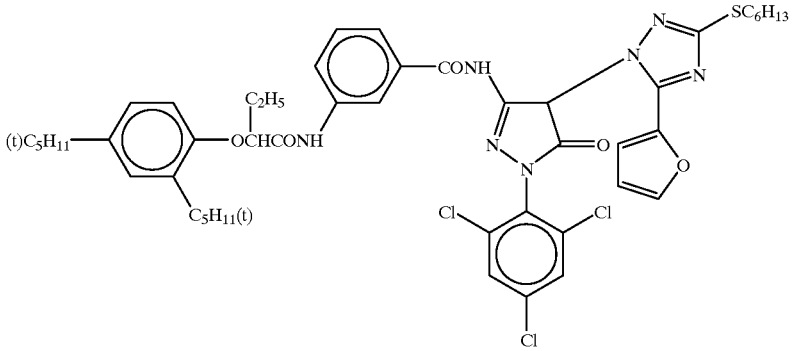
(21)
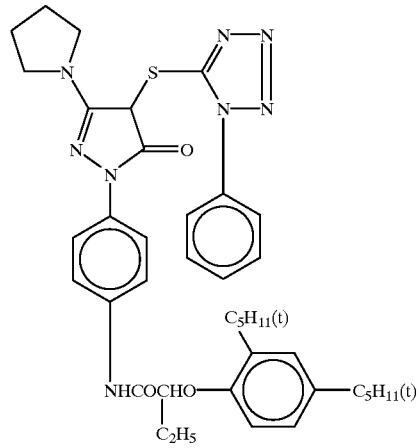

-continued
(22)
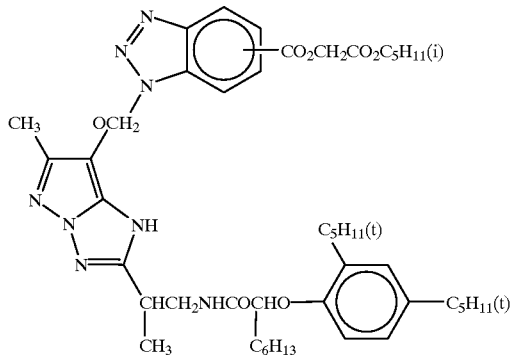
(23)
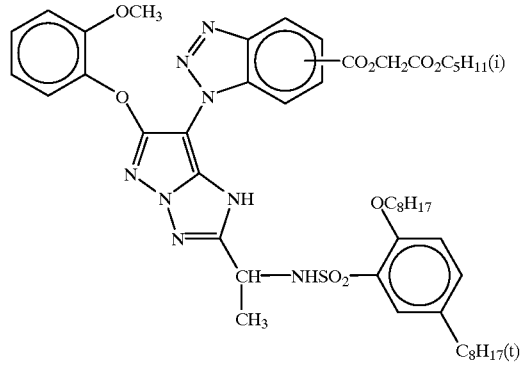
(24)
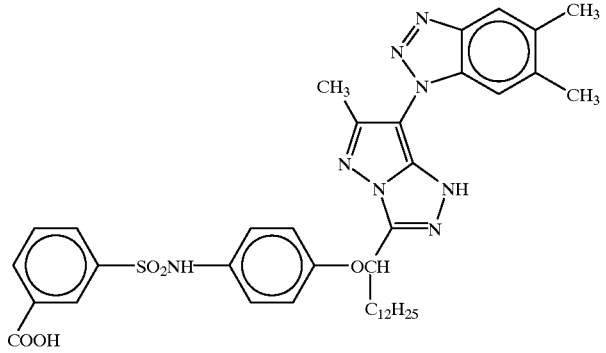
(25)
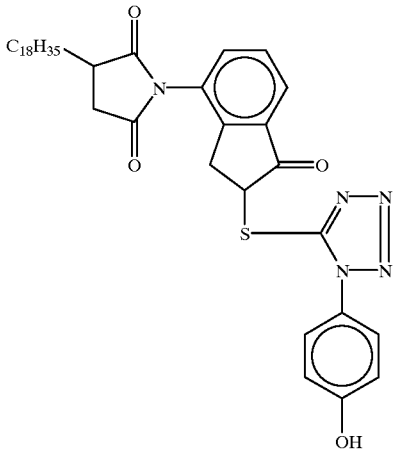

-continued
(26)
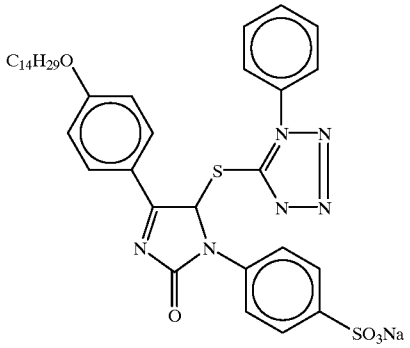
(27)
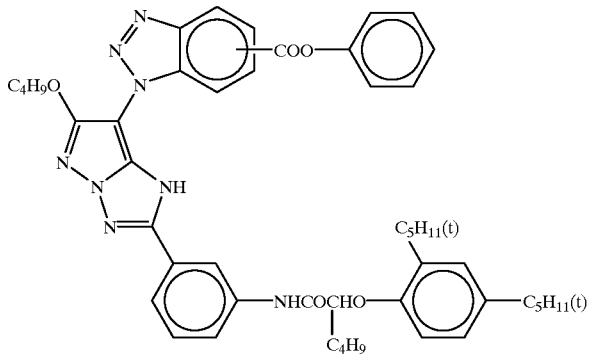
(28)
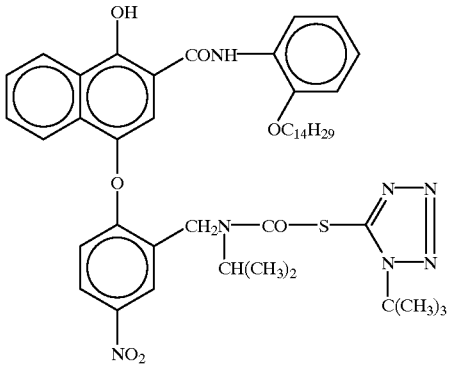

-continued
(29)
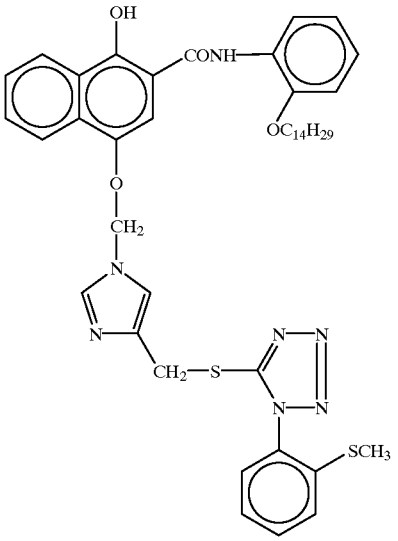
(30)
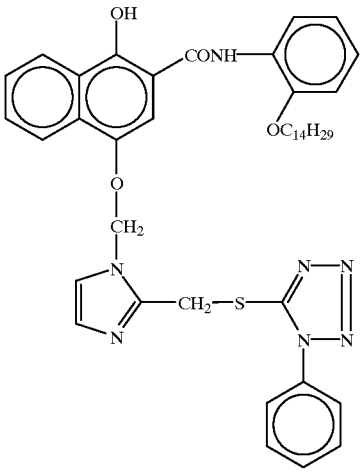

-continued
(31)
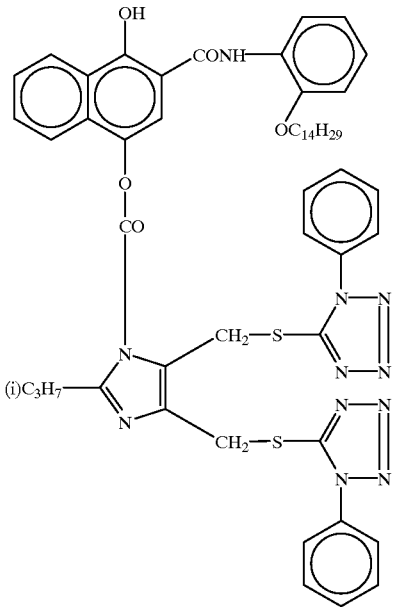
(32)
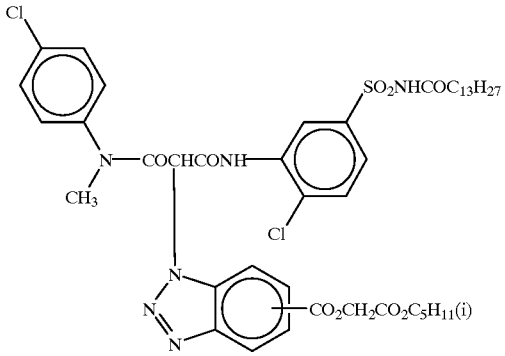
(33)
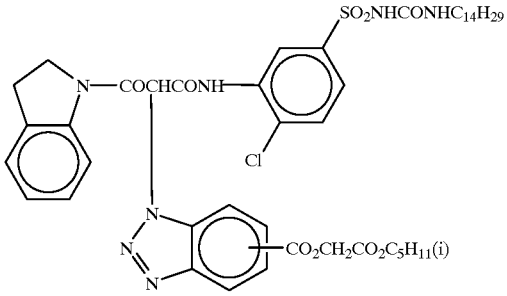

-continued (34)

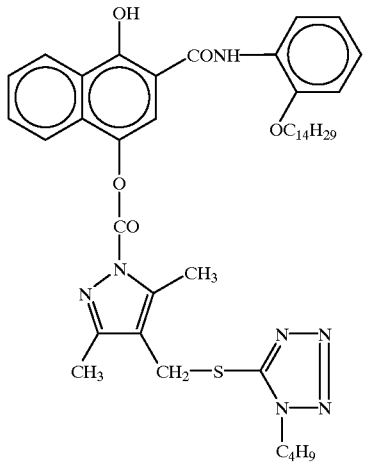

(35)

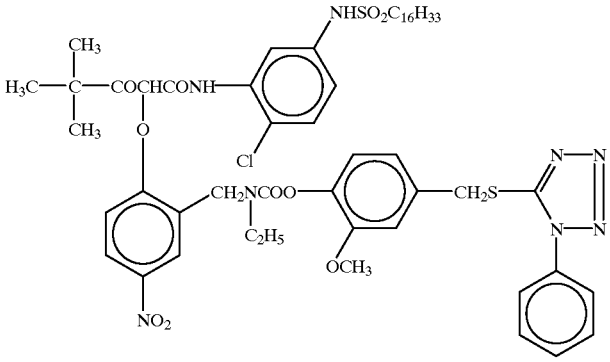

(36)

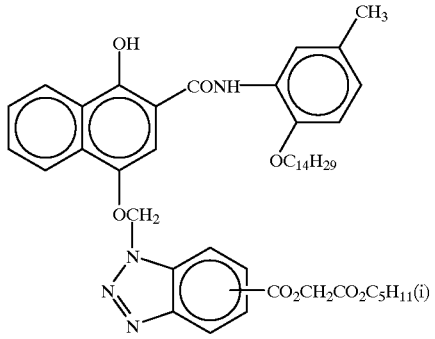

(37)

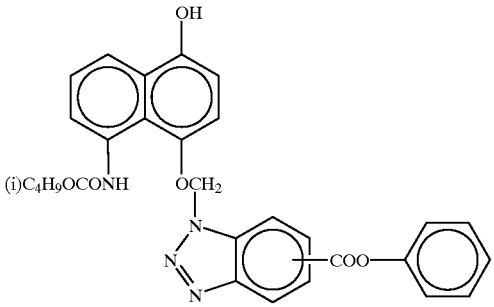

The amount of a compound represented by Formula (I) to be added is $1\times10^{-7}$ to $1\times10^{-2}$ mol, preferably $1\times10^{-6}$ to $1\times10^{-3}$ mol per 1 $m^2$ of a light-sensitive material. Although the compound can be added to any layer, the compound is preferably added to a silver halide emulsion layer containing the silver halide grains of the present invention or an adjacent layer to it, and most preferably is added to a silver halide emulsion layer containing the silver halide grains of the present invention.

A compound represented by Formula (A) will be described in detail below.

In Formula (A), $Q_{a1}$ preferably represents a nonmetal atom group necessary to form a 5- or 6-membered heterocyclic ring constituted by at least one of a carbon atom, a nitrogen atom, an oxygen atom, a sulfur atom, and a selenium atom. This heterocyclic ring can be condensed with a carbon aromatic ring or a hetero aromatic ring.

Examples of the heterocyclic ring are a tetrazole ring, a triazole ring, an imidazole ring, a thiadiazole ring, an oxadiazole ring, a selenadiazole ring, an oxazole ring, a thiazole ring, a benzoxazole ring, a benzthiazole ring, a benzimidazole ring, a pyrimidine ring, a triazaindene ring, a tetrazaindene ring, and a pentazaindene ring.

$R_{a1}$ represents a carboxylic acid or its salt (e.g., sodium salt, potassium salt, ammonium salt, and calcium salt), sulfonic acid or its salt (e.g., sodium salt, potassium salt, ammonium salt, magnesium salt, and calcium salt), phosphonic acid or its salt (e.g., sodium salt, potassium salt, and ammonium salt), a substituted or nonsubstituted amino group (e.g., nonsubstituted amino, dimethylamino, diethylamino, methylamino, and bismethoxyethylamino), a substituted or nonsubstituted ammonium group (e.g., trimethylammonium, triethylammonium, and dimethylbenzylammonium). $L_{a1}$ represents a single bond, a divalent aliphatic group, a divalent aromatic hydrocarbon group, a divalent heterocyclic group, or a linking group combining these groups. $L_{a1}$ is preferably a divalent 1- to 10-carbon alkylene group (e.g., methylene, ethylene, propylene, butylene, isopropylene, 2-hydroxypropylene, hexylene, and octylene), a divalent 2- to 10-carbon alkenylene group (e.g., vinylene, propenylene, and butenylene), a divalent 7- to 12-carbon aralkylene group (e.g., phenethylene), a divalent 6- to 12-carbon arylene group (e.g., phenylene, 2-chlorophenylene, 3-methoxyphenylene, and naphthylene), a divalent 1- to 10-carbon heterocyclic group (e.g., pyridyl, thienyl, furyl, triazolyl, and imidazolyl), a single bond, or a group as an arbitrary combination of these groups. $L_{a1}$ can also be an arbitrary combination of —CO—, —$SO_2$—, —$NR_{202}$—, —O—, and —S— wherein $R_{202}$ represents a hydrogen atom, a 1- to 6-carbon alkyl group (e.g., methyl, ethyl, butyl, and hexyl), a 7- to 10-carbon aralkyl group (e.g., benzyl and phenethyl), or a 6- to 10-carbon aryl group (e.g., phenyl and 4-methylphenyl).

$M_{a1}$ represents a hydrogen atom or a cation (e.g., an alkali metal atom such as a sodium atom or a potassium atom, an alkaline earth metal atom such as a magnesium atom or a calcium atom, and an ammonium group such as an ammonium group or a triethylammonium group).

A heterocyclic group and $R_{a1}$ represented by Formula (A) can be substituted by a nitro group, a halogen atom (e.g., a chlorine atom and a bromine atom), a mercapto group, a cyano group, a substituted or nonsubstituted alkyl group (e.g., methyl, ethyl, propyl, t-butyl, and cyanoethyl), a substituted or nonsubstituted aryl group (e.g., phenyl, 4-methanesulfonamidophenyl, 4-methylphenyl, 3,4-dichlorophenyl, and naphthyl), a substituted or nonsubstituted alkenyl group (e.g., allyl), a substituted or nonsubstituted aralkyl group (e.g., benzyl, 4-methylbenzyl, and phenethyl), a substituted or nonsubstituted sulfonyl group (e.g., methanesulfonyl, ethanesulfonyl, and p-toluenesulfonyl), a substituted or nonsubstituted carbamoyl group (e.g., nonsubstituted carbamoyl, methylcarbamoyl, and phenylcarbamoyl), a substituted or nonsubstituted sulfamoyl group (e.g., nonsubstituted sulfamoyl, methylsulfamoyl, and phenylsulfamoyl), a substituted or nonsubstituted carbonamide group (e.g., acetamide and benzamide), a substituted or nonsubstituted sulfonamide group (e.g., methanesulfonamide, benzenesulfonamide, and p-toluenesulfonamide), a substituted or nonsubstituted acyloxy group (e.g., acetyloxy and benzoyloxy), a substituted or nonsubstituted sulfonyloxy group (e.g., methanesulfonyloxy), a substituted or nonsubstituted ureido group (e.g., nonsubstituted ureido, methylureido, ethylureido, and phenylureido), a substituted or nonsubstituted acyl group (e.g., acetyl and benzoyl), a substituted or nonsubstituted oxycarbonyl group (e.g., methoxycarbonyl and phenoxycarbonyl), a substituted or nonsubstituted oxycarbonylamino group (e.g., methoxycarbonylamino, phenoxycarbonylamino, and 2-ethylhexyloxycarbonylamino), and a hydroxyl group.

q represents any integer from 1 to 3. If q represents 2 or 3, the two or three $R_a1$'s can be the same or different.

In Formula (A), it is preferable that $Q_{a1}$ represent a tetrazole ring, a triazole ring, an imidazole ring, an oxadiazole ring, a triazaindene ring, that a tetrazaindene ring, or a pentazaindene ring, $R_{a1}$ represent a 1- to 6-carbon alkyl group substituted by one or two groups selected from carboxylic acid or its salt and sulfonic acid or its salt, and that q represent 1 or 2.

A compound represented by Formula (A) is more preferably a compound represented by Formula (A-1) below.

Formula (A-1)

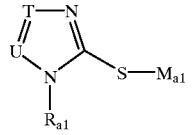

wherein each of $M_{a1}$ and $R_{a1}$ has the same meaning as in Formula (A), each of T and U represents C—$R_{a2}$ or N, $R_{a2}$ represents a hydrogen atom, a hydroxy group, a nitro group, an alkyl group, an alkenyl group, an aralkyl group, an aryl group, a carbonamide group, a sulfonamide group, a ureido group, or $R_{a1}$. or a 1- to 4-carbon alkyl group substituted by one or two groups selected from a carboxylic acid or a salt thereof and a sulfonic acid or salt thereof.

Formula (A-1) will be described in detail below.

Each of T and U represents C—$R_{a2}$ or N. $R_{a2}$ represents a hydrogen atom, a halogen atom (e.g., a chorine atom and a bromine atom), a hydroxy group, a nitro group, an alkyl group (e.g., methyl, ethyl, methoxyethyl, n-butyl, and 2-ethylhexyl), an alkenyl group (e.g., allyl), an aralkyl group (e.g., benzyl, 4-methylbenzyl, phenethyl, and 4-methoxybenzyl), an aryl group (e.g., phenyl, naphthyl, 4-methanesulfonamidophenyl, and 4-methylphenyl), a carbonamide group (e.g., acetylamino, benzoylamino, and methoxypropionylamino), a sulfonamide group (e.g., methanesulfonamide, benzenesulfonamide, and p-toluenesulfonamide), a ureido group (e.g., nonsubstituted ureido, methylureido, and phenylureido), or a 1- to 4-carbon alkyl group substituted by one or two groups selected from a carboxylic acid or a salt thereof and a sulfonic acid or salt thereof.

In Formula (A-1), it is preferable that T=U=N and $R_{a1}$ represent a 1- to 4-carbon alkyl group substituted by one or two groups selected from carboxylic acid or its salt and sulfonic acid or its salt.

Specific examples of a compound represented by Formula (A) of the present invention are presented below. However, the present invention is not limited to these examples.
A-1
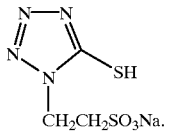
A-2
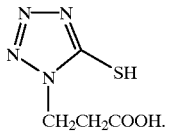
A-3
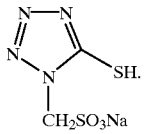
A-4
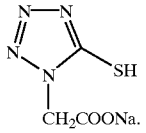
A-5
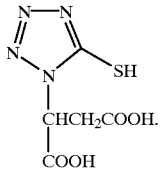
A-6
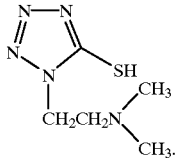
A-7
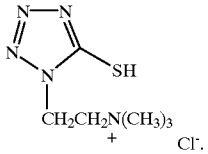
A-8
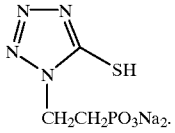
A-9
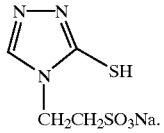
-continued
A-10
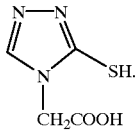
A-11
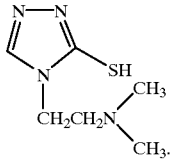
A-12
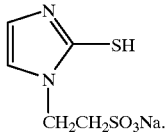
A-13
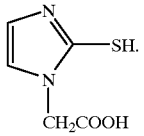
A-14
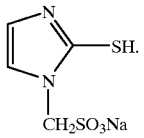
A-15
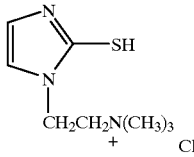
A-16
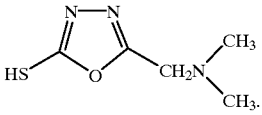
A-17
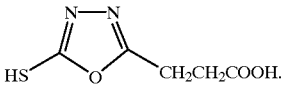
A-18
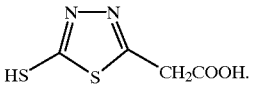
A-19
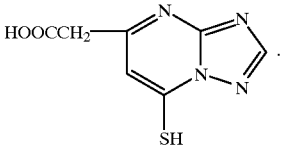
A-20
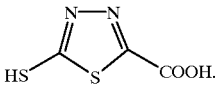

A compound represented by Formula (A) of the present invention can be synthesized in accordance with methods described in Berichte der Deutschen Chemischen Gesellschaft 28, 77 (1895), JP-A-60-61749 and JP-A-60-147735, Berichte der Deutschen Chemischen Gesellschaft 22, 568 (1889), Berichte der Deutschen Chemischen Gesellschaft 29, 2483 (1896), J. Chem. Soc. 1932, 1806, J. Am. Chem. Soc. 71, 4000 (1949), Advances in Heterocyclic Chemistry 9, 165 (1968), organic Synthesis IV, 569 (1963), J. Am. Chem. Soc. 45, 2390 (1923), and Chemische Berichte 9, 465 (1876).

Formula (B) will be described in detail below.

In Formula (B), $Q_{b1}$ represents a 5- or 6-membered meso-ionic ring constituted by a carbon atom, a nitrogen atom, an oxygen atom, a sulfur atom, or a selenium atom, and $X_{b1}^-$ represents —$O^-$, —$S^-$, or —$N^-R_{b1}$. $R_{b1}$ represents an aliphatic group, an aromatic hydrocarbon group, or a heterocyclic group.

A meso-ionic compound represented by Formula (B) of the present invention is any of compounds defined by W. Baker and W. D. Ollis in Quart. Rev. 11, 15 (1957), Advances in Heterocyclic Chemistry 19, 1 (1976), and represents "a 5- or 6-membered heterocyclic compound which cannot be satisfactorily represented by one covalent bond structural formula or polarity structural formula, which is a compound having a π electron sextet relating to all atoms constituting the ring, and in which the ring assumes a partial positive charge to keep in equilibrium with an equal negative charge on an out-of-ring atom or atomic group".

Examples of the meso-ionic ring represented by $Q_{b1}$ are an imidazolium ring, a pyrazolium ring, an oxazolium ring, a thiazolium ring, a triazolium ring, a tetrazolium ring, a thiadiazolium ring, an oxadiazolium ring, a thiatriazolium ring, and an oxatriazolium ring.

$R_{b1}$ represents a substituted or nonsubstituted aliphatic group (e.g., methyl, ethyl, n-propyl, n-butyl, isopropyl, n-octyl, carboxymethyl, dimethylaminoethyl, cyclohexyl, 4-methylcyclohexyl, cyclopentyl, propenyl, 2-methylpropenyl, propargyl, butynyl, 1-methylpropargyl, benzyl, and 4-methoxybenzyl), a substituted or nonsubstituted aromatic group (e.g., phenyl, naphthyl, 4-methylphenyl, 3-methoxyphenyl, and 4-ethoxycarbonylphenyl), or a substituted or nonsubstituted heterocyclic group (e.g., pyridyl, imidazolyl, morpholino, triazolyl, tetrazolyl, and thienyl).

A meso-ionic ring represented by M can be substituted by the substituent groups explained for Formula (A).

Furthermore, a compound represented by Formula (B) can form a salt (e.g., acetate, nitrate, salicylate, hydrochloride, iodate, and bromate).

In Formula (B), $X_{b1}^-$ preferably represents —$S^-$.

A meso-ionic compound represented by Formula (B) used in the present invention is more preferably a compound represented by Formula (B-1) below.

Formula (B-1)

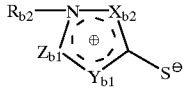

wherein $X_{b2}$ represents N or C—$R_{b3}$, $Y_{b1}$ represents O, S, N, or N—$R_{b4}$, $Z_{b1}$ represents N, N—$R_{b5}$l or C—$R_{b6}$.

Each of $R_{b2}$, $R_{b3}$, $R_{b4}$, $R_{b5}$, and $R_{b6}$ represents an aliphatic group, an aromatic group, a heterocyclic group, an amino group, an acylamino group, a sulfonamide group, a ureido group, a sulfamoylamino group, an acyl group, or a carbamoyl group. $R_{b3}$ and $R_{b6}$ can be a hydrogen atom. Each pair of $R_{b2}$ and $R_{b3}$, $R_{b2}$ and $R_{b5}$, $R_{b2}$ and $R_{b6}$, $R_{b4}$ and $R_{b5}$, and $R_{b4}$ and $R_{b6}$ may be bonded to each other to form a ring.

A compound represented by Formula (B-1) will be described in detail below.

An aliphatic group, an aromatic group, a heterocyclic group, an amino group, an acylamino group, a sulfonamide group, a ureido group, a sulfamoylamino group, an acyl group, and a carbamoyl group represented by $R_{b2}$, $R_{b3}$, $R_{b4}$, $R_{b5}$, and $R_{b6}$ can be substituted.

In formula (B-1), it is preferable that $X_{b2}$ represent N or C—$R_{b3}$, $Y_{b1}$ represent N—$R_{b4}$, S, or O, $Z_{b1}$ represent N or C—$R_{b6}$, $R_{b2}$, $R_{b3}$, or $R_{b6}$ represent a substituted or nonsubstituted alkyl group, a substituted or nonsubstituted alkenyl group, a substituted or nonsubstituted alkinyl group, or a substituted or nonsubstituted heterocyclic group. Each of $R_{b3}$ and $R_{b6}$ can be a hydrogen atom. $R_{b4}$ is preferably a substituted or nonsubstituted alkyl group, a substituted or nonsubstituted alkenyl group, a substituted or nonsubstituted alkinyl group, a substituted or nonsubstituted heterocyclic group, or a substituted or nonsubstituted amino group.

In Formula (B-1), it is more preferable that $X_{b2}$ represent N, $Y_{b1}$ represent N—$R_{b4}$, and $Z_{b1}$ represent C—$R_{b6}$. Each of $R_{b2}$ and $R_{b4}$ represents a 1- to 6-carbon alkyl group, and more preferably 1- to 3-carbon alkyl group. $R_{b6}$ represents a hydrogen atom or a 1- to 6-carbon alkyl group, and more preferably a hydrogen atom or a 1- to 3-carbon alkyl group. At least one alkyl group of $R_{b2}$, $R_{b4}$, and $R_{b6}$ is substituted by preferably a carboxylic acid group, a sulfonic acid group, an amino group, or a phosphono group, and most preferably a carboxylic acid group or a sulfonic acid group.

A compound represented by Formula (B-2) below is an example of similar compounds of Formula (B-1).

Formula (B-2)

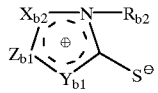

wherein $X_{b2}$, $Y_{b1}$, $Z_{b1}$, and $R_{b2}$ have exactly the same meanings as in Formula (B-1).

Specific examples of a compound represented by Formula (B) of the present invention are presented below. However, the present invention is not limited to these examples.

(B-1)

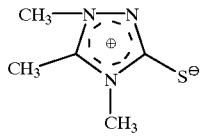

(B-2)

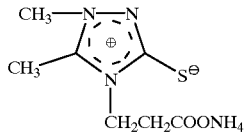

(B-3)

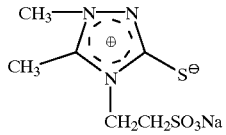

-continued
(B-4)
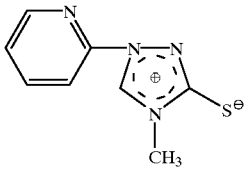
(B-5)
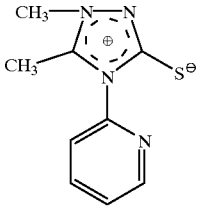
(B-6)
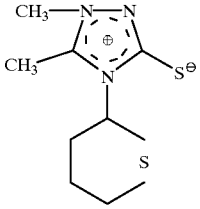
(B-7)
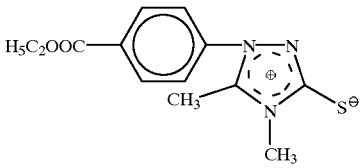
(B-8)
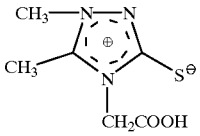
(B-9)
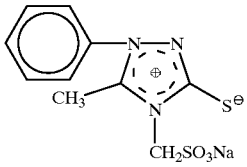
(B-10)
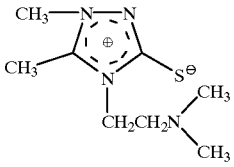
(B-11)
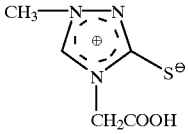
-continued
(B-12)
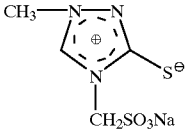
(B-13)
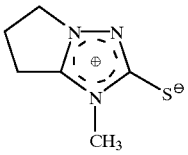
(B-14)
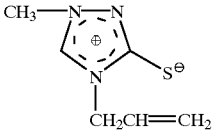
(B-15)
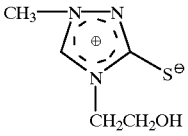
(B-16)
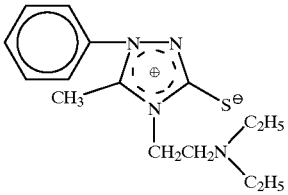
(B-17)
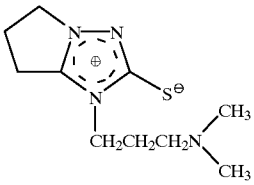
(B-18)
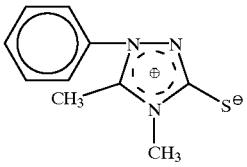
(B-19)
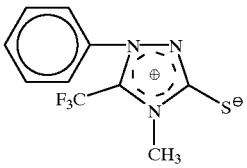

-continued
(B-20)
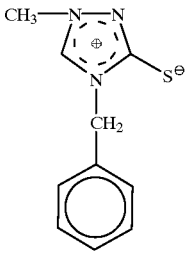
(B-21)
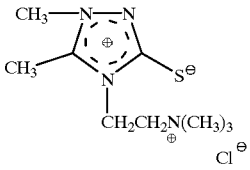
(B-22)
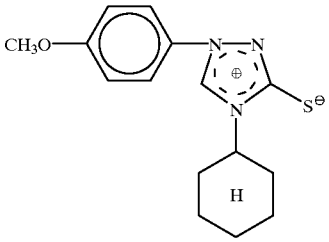
(B-23)
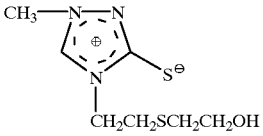
(B-24)
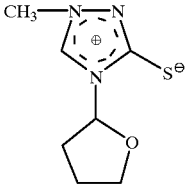
(B-25)
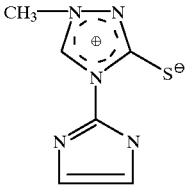
(B-26)
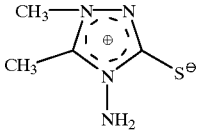
-continued
(B-27)
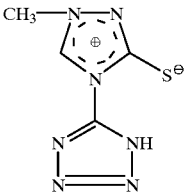
(B-28)
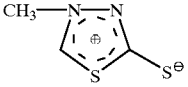
(B-29)
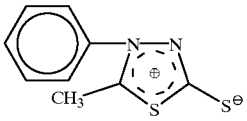
(B-30)
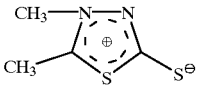
(B-31)
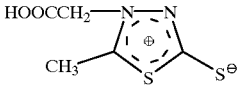
(B-32)
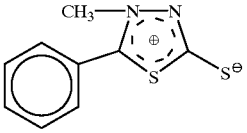
(B-33)
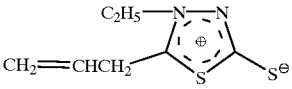
(B-34)
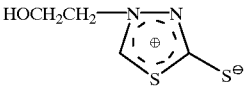
(B-35)
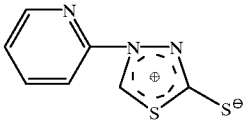
(B-36)
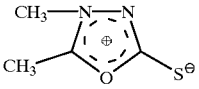
(B-37)
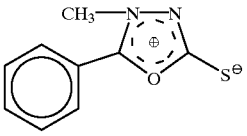

-continued (B-38)

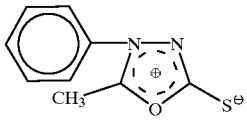

(B-39)

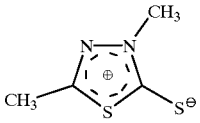

(B-40)

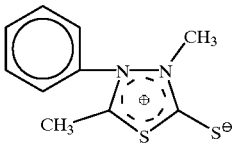

(B-41)

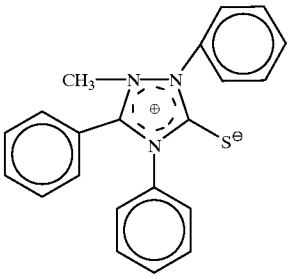

(B-42)

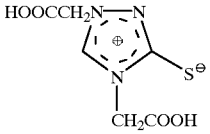

(B-43)

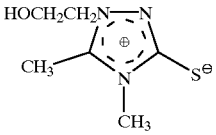

(B-44)

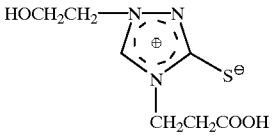

(B-45)

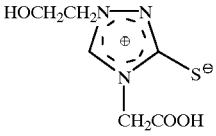

(B-46)

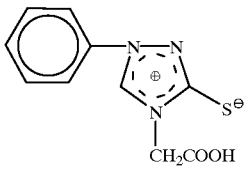

-continued (B-47)

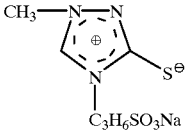

(B-48)

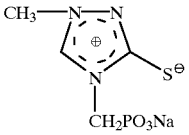

(B-49)

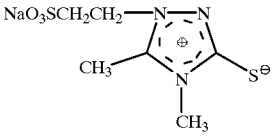

(B-50)

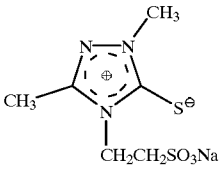

A compound represented by Formula (B) of the present invention can be synthesized by methods described in JP-A-1-201659 and JP-A-4-143755.

Formula (C) will be described in detail below.

Each of $L_{C1}$ and $L_{C3}$ represents a substituted or nonsubstituted 1- to 10-carbon aliphatic group (e.g., methyl, ethyl, propyl, hexyl, isopropyl, carboxyethyl, benzyl, phenethyl, vinyl, propenyl, and 1-methylvinyl), a substituted or nonsubstituted 6- to 12-carbon aromatic group (e.g., phenyl, 4-methylphenyl, and 3-methoxyphenyl), or a substituted or nonsubstituted 1- to 10-carbon heterocyclic group (e.g., pyridyl, furyl, thienyl, and imidazolyl). $L_{C2}$ represents a substituted or nonsubstituted 1- to 12-carbon divalent aliphatic group (e.g., methylene, ethylene, trimethylene, tetramethylene, pentamethylene, hexamethylene, 1-methylethylene, 1-hydroxytrimethylene, and 1,2-xylylene), a substituted or nonsubstituted 6- to 12-carbon divalent aromatic group (e.g., phenylene and naphthylene), or a substituted or nonsubstituted 1- to 10-carbon divalent heterocyclic linking group (e.g.,

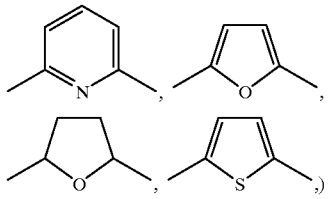

or a linking group

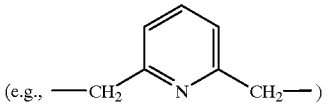

combining them.

Each of $A_{C1}$ and $B_{C1}$ represents —S—, —O—, —$NR_{C20}$—, —CO—, —CS—, —$SO_2$—, or a group as an arbitrary combination of them. Examples of the arbitrary combination group are —$CONR_{C21}$—, —$NR_{C22}CO$—, —$NR_{C23}CONR_{C24}$—, —COO—, —OCO—, —$SO_2NR_{C25}$—, —$NR_{C26}SO_2$—, and —$NR_{C27}CONR_{C28}$—.

r represents any integer from 1 to 10.

At least one of $L_{C1}$ and $L_{C3}$ is substituted by —$SO_3M_{C1}$, —$PO_3M_{C2}M_{C3}$, —$NR_{C1}(R_{C2})$ (which can take the form of a salt such as hydrochloride and acetate, e.g., nonsubstituted amino, methylamino, dimethylamino, N-methyl-N-hydroxyethylamino, and N-ethyl-N-carboxyethylamino), —$N^+R_{C3}(R_{C4})(R_{C5})\cdot X_{C1}^-$ (e.g., trimethylammoniochloride), —$SO_2NR_{C6}(R_{C7})$ (e.g., nonsubstituted sulfamoyl and dimethylsulfamoyl), —$NR_{C8}SO_2R_{C9}$ (e.g., methanesulfonamide and benzenesulfonamide), —$CONR_{C10}(R_{C11})$ (e.g., nonsubstituted carbamoyl, N-methylcarbamoyl, and N,N-bis (hydroxyethyl)carbamoyl), —$NR_{C12}COR_{C13}$ (e.g., formamide, acetamide, and 4-methylbenzoylamino), —$SO_2R_{14}$ (e.g., methanesulfonyl and 4-chlorophenylsulfonyl), —PO(—$NR_{C15}$)$(R_{C16})_2$ (e.g., nonsubstituted phosphonamide and tetramethylphosphonamide), —$NR_{C17}CONR_{C18}(R_{C19})$ (e.g., nonsubstituted ureido and N,N-dimethylureido), a heterocyclic group (e.g., pyridyl, imidazolyl, thienyl, and tetrahydrofuranyl), or —$COOM_{C4}$.

Each of $M_{C1}$, $M_{C2}$, $M_{C3}$ and $M_{C4}$ represents a hydrogen atom or a counter cation (e.g., an alkali metal atom such as a sodium atom or a potassium atom, an alkaline earth metal atom such as a magnesium atom or a calcium atom, and an ammonium group such as ammonium or triethylammonium).

Each of $R_{C1}$ to $R_{C28}$ represents a hydrogen atom, a substituted or nonsubstituted 1- to 12-carbon aliphatic group (e.g., methyl, ethyl, propyl, hexyl, isopropyl, benzyl, phenethyl, vinyl, propenyl, and 1-methylvinyl), or a substituted or nonsubstituted 6- to 12-carbon aromatic group (e.g., phenyl, 4-methylphenyl, and 3-methoxyphenyl). $X^-$ represents a counter anion (e.g., a halogen ion such as chlorine ion or bromine ion, nitric acid ion, sulfuric acid ion, acetic acid ion, and p-toluenesulfonic acid ion).

If the groups represented by $L_{C1}$, $L_{C2}$, $L_{C3}$, and $R_{C1}$ to $R_{C28}$ have substituent groups, examples of these substituent groups are a 1- to 4-carbon lower alkyl group (e.g., methyl and ethyl), a 6- to 10-carbon aryl group (e.g., phenyl and 4-methylphenyl), a 7- to 10-carbon aralkyl group (e.g., benzyl), a 2- to 4-carbon alkenyl group (e.g., propenyl), a 1- to 4-carbon alkoxy group (e.g., a methoxy and an ethoxy), a halogen atom (e.g., a chlorine atom and a bromine atom), a cyano group, a nitro group, a carboxylic acid group (which can take the form of a salt), and a hydroxy group.

If r is 2 or larger, each of $A_{C1}$ and $L_{C2}$ can be an arbitrary combination of the groups enumerated previously.

At least one of $A_{C1}$ and $B_{C1}$ represents —S—.

In Formula (C), it is preferable that at least one of $L_{C1}$ and $L_{C3}$ represent —$SO_3M_{C1}$, —$PO_3M_{C2}M_{C3}$, —$NR_{C1}(R_{C2})$, —$N^+R_{C3}(R_{C4})(R_{C5})\cdot X_{C1}^-$, or a 1- to 6-carbon alkyl group substituted by a heterocyclic group —$COOM_{C4}$, $L_{C2}$ represent a 1- to 6-carbon alkylene group, each of $A_{C1}$ and $B_{C1}$ represent —S—, —O—, or —$NR_{C20}$—, each of $R_{C1}$, $R_{C2}$, $R_{C3}$, $R_{C4}$, $R_{C5}$, and $R_{C20}$ represent a hydrogen atom or a 1- to 6-carbon alkyl group, and r represent any integer from 1 to 6.

In Formula (C), it is more preferable that each of $L_{C1}$ and $L_{C3}$ be a 1- to 4-carbon alkyl group substituted by —$SO_3M_{C1}$ or —$PO_3M_{C2}M_{C3}$—$COOM_{C4}$, each of $A_{C1}$ and $B_{C1}$ represent —S—, and r represent any integer from 1 to 3.

Specific examples of a compound represented by Formula (C) of the present invention are presented below. However, the present invention is not limited to these examples.

C-1. $NaO_3S(CH_2)_2S(CH_2)_2S(CH_2)_2SO_3Na$

C-2. $NaO_3S(CH_2)_2(SCH_2CH_2)_2S(CH_2)_2SO_3Na$

C-3. $NaO_3S(CH_2)_2(SCH_2CH_2)_3S(CH_2)_2SO_3Na$

C-4. $NaO_3S(CH_2)_2(SCH_2CH_2)_4S(CH_2)_2SO_3Na$

C-5. $NaO_3S(CH_2)_3S(CH_2)_2\ S(CH_2)_3SO_3Na$

C-6. $NaO_3S(CH_2)_3(SCH_2CH_2)_2$—$S(CH_2)_3SO_3Na$

C-7. $NaO_3S(CH_2)_3(SCH_2CH_2)_3$—$S(CH_2)_3SO_3Na$

C-8. $NaO_3S(CH_2)_3\ S(CH_2)_2O(CH_2)_2S(CH_2)_3SO_3Na$

C-9.

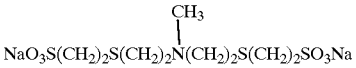

C-10.

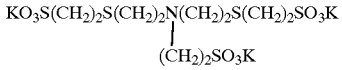

C-11.

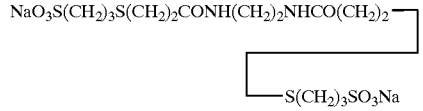

C-12.

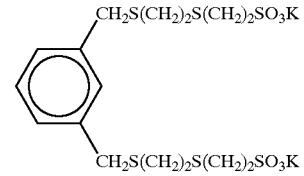

C-13.

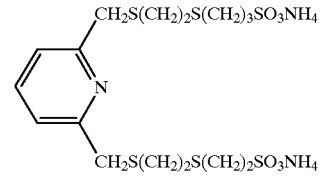

C-14. $Na_2O_3P(CH_2)_2S(CH_2)_2S(CH_2)_2PO_3Na_2$

C-15. $Na_2O_3P(CH_2)_2(SCH_2CH_2)_2S(CH_2)_2PO_3Na_2$

C-16. $Na_2O_3P(CH_2)_3(SCH_2CH_2)_3S(CH_2)_3PO_3Na_2$

C-17.

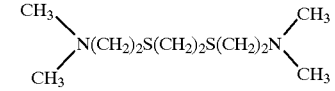

C-18. $(CH_3)_3\overset{+}{N}(CH_2)_2S(CH_2)_2S(CH_2)_2\overset{+}{N}(CH_3)_3\ 2Cl^-$ -continued C-19. $(CH_3)_2N(CH_2)_2S(CH_2)_3S(CH_2)_2SO_3Na$ C-20. $(CH_3)_3N(CH_2)_2S(CH_2)_2S(CH_2)_2SO_3Na$ +

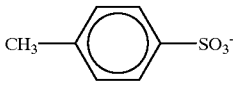

C-21. $H_2N(CH_2)_2S(CH_2)_2S(CH_2)_2NH_2$

C-22. $H_2NO_2S(CH_2)_2S(CH_2)_2S(CH_2)_2SO_2NH_2$

C-23. $CH_3SO_2N(CH_3)(CH_2)_2NH(CH_2)_2S(CH_2)_2CONH_2$

C-24. $CH_3S(CH_2)_3SO_2(CH_2)_3S(CH_2)_2SO_3Na$

C-25.

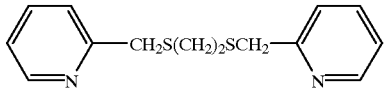

C-26.

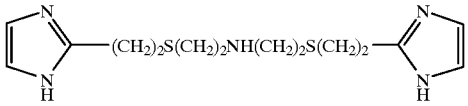

C-27. $H_2NC(=S)NH(CH_2)_2S(CH_2)_2S(CH_2)_2SO_3Na$

A compound represented by Formula (C) of the present invention can be synthesized by methods described in, e.g., JP-A-2-44355 and European Patent 458277.

Formula (D) will be described in detail below.

In Formula (D), examples of an aliphatic group, an aromatic group, and a heterocyclic group represented by $X_d$, $Y_d$, $R_{d1}$, $R_{d2}$, $R_{d3}$, $R_{d4}$, $R_{d5}$, $R_{d6}$, and $R_{d7}$ are a substituted or nonsubstituted 1- to 10-carbon alkyl group (e.g., methyl, ethyl, propyl, hexyl, isopropyl, carboxyethyl, sulfoethyl, aminoethyl, dimethylaminoethyl, phosphonopropyl, carboxymethyl, and hydroxyethyl), a substituted or nonsubstituted 2- to 10-carbon alkenyl group (e.g., vinyl, propenyl, and 1-methylvinyl), a substituted or nonsubstituted 7- to 12-carbon aralkyl group (e.g., benzyl, phenethyl, 3-carboxyphenylmethyl, and 4-sulfophenylethyl), a substituted or nonsubstituted 6- to 12-carbon aryl group (e.g., phenyl, naphthyl, 4-carboxyphenyl, and 3-sulfophenyl), and a substituted or nonsubstituted 1- to 10-carbon heterocyclic group (e.g., 5- and 6-membered rings such as pyridyl, furyl, thienyl, imidazolyl, pyrrolyl, pyrazolyl, pyrimidinyl, quinolyl, piperidyl, and pyrrolidyl are preferable).

These alkyl, alkenyl, aralkyl, aryl, and heterocyclic groups can also be substituted. Examples of the substituent group are an alkyl group, an aralkyl group, an alkenyl group, an alkynyl group, an aryl group, an alkoxy group, an aryloxy group, an acylamino group, a ureido group, a urethane group, a sulfonylamino group, a sulfamoyl group, a carbamoyl group, a sulfonyl group, a sulfinyl group, an alkyloxycarbonyl group, an aryloxycarbonyl group, an acyl group, an acyloxy group, a halogen atom, a cyano group, and a nitro group. These groups can also be further substituted. If there are two or more substituent groups, these groups can be the same or different.

In Formula (D), $X_d$ and $Y_d$ may be bonded each other to form a ring but one that is not enolized. Examples of the ring formed by $X_d$ and $Y_d$ are a 4-imidazoline-2-thion ring, an imidazoline-2-thion ring, a 4-thiazoline-2-thion ring, a thiazolidine-2-thion ring, a 4-oxazoline-2-thion ring, an oxazolidine-2-thion ring, a pyrrolidine-2-thion ring, and a benzo condensed ring of any of these rings.

In Formula (D), at least one of $X_d$ and $Y_d$ is substituted by at least one of carboxylic acid or its salt (e.g., alkali metal salt and ammonium salt), sulfonic acid or its salt (e.g., alkali metal salt and ammonium salt), phosphonic acid or its salt (e.g., alkali metal salt and ammonium salt), an amino group (e.g., nonsubstituted amino, dimethylamino, methylamino, and hydrochloride of dimethylamino) or ammonium (e.g., trimethylammonium and dimethylbenzylammonium), and a hydroxyl group.

In Formula (D), a cation represented by $R_{d6}$ and $R_{d7}$ represents, e.g., a hydrogen atom, an alkali metal, or ammonium.

In Formula (D), each of $X_d$ and $Y_d$ of the present invention preferably represents a 1- to 10-carbon alkyl group, a 1- to 10-carbon heterocyclic group, 0- to 10-carbon —$N(R_{d1})R_{d2}$, 0- to 10-carbon —$N(R_{d3})N(R_{d4})R_{d5}$, or 0- to 10-carbon —$OR_{d6}$, each of which is substituted by at least one or two groups selected from carboxylic acid or its salt, sulfonic acid or its salt, phosphonic acid or its salt, an amino group or an ammonium group, and a hydroxyl group. Each of $R_{d1}$, $R_{d2}$, $R_{d3}$, $R_{d4}$, $R_{d5}$, and $R_{d6}$ represents a hydrogen atom or an alkyl group.

In Formula (D), each of $X_d$ and $Y_d$ more preferably represents a 1- to 6-carbon alkyl group, 0- to 6-carbon —$N(R_{d1})R_{d2}$, 0- to 6-carbon —$N(R_{d3})N(R_{d4})R_{d5}$, or 0- to 6-carbon —$OR_{d6}$, each of which is substituted by at least one or two groups selected from carboxylic acid or its salt and sulfonic acid or its salt. Each of $R_{d1}$, $R_{d2}$, $R_{d3}$, $R_{d4}$, $R_{d5}$, and $R_{d6}$ represents a hydrogen atom or an alkyl group.

Specific examples of a compound represented by Formula (D) of the present invention are presented below. However, the present invention is not limited to these examples.

D-1. $H_2NC(=S)NHCH_2SO_3Na$

D-2. $H_2NC(=S)NHCH_2CH_2SO_3Na$

D-3. $CH_3NHC(=S)NHCH_2CH_2SO_3Na$

D-4. $H_2NC(=S)NHCH_2CH_2COOH$

D-5. $(CH_3)_2N(CH_3)_2C(=S)NHCH_2CH_2N$

D-6. $H_2NC(=S)NHCH_2CH_2CH_2N(C_2H_5)_2$

D-7. $(CH_3)_2N(CH_3)_2C(=S)N$ $CH_2COOH$

D-8. $CH_3NHC(=S)NHCH_2CH_2OH$

D-9. $H_2NC(=S)NHCH_2CH_2PO_3Na_2$

-continued
D-10.
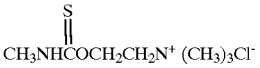
D-11.
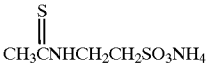
D-12.
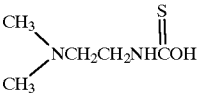
D-13.
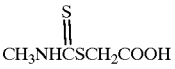
D-14.
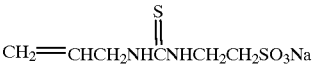
D-15.
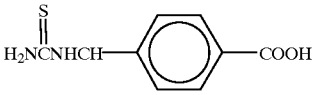
D-16.
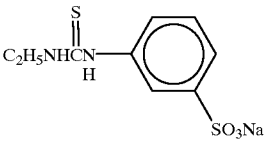
D-17.
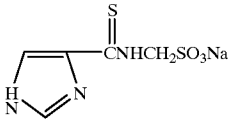
D-18.
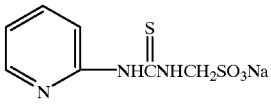
D-19.
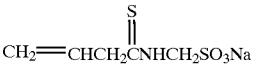
D-20.
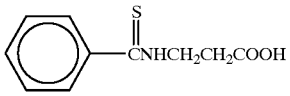
D-21.
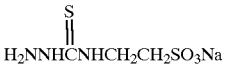
D-22.
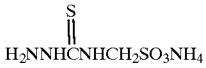
D-23.
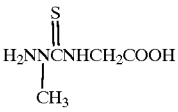
D-24.
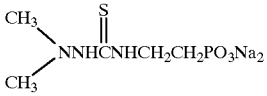
D-25.
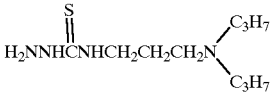
D-26.
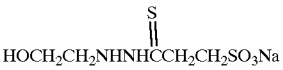
-continued
D-27.
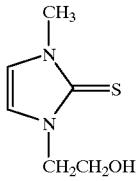
D-28.
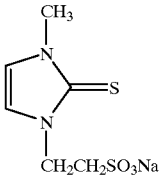
D-29.
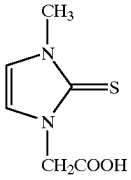
D-30.
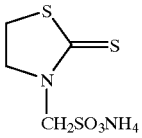
D-31.
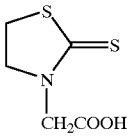
D-32.
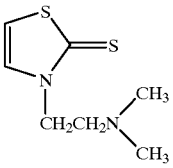
D-33.
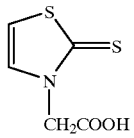
D-34.
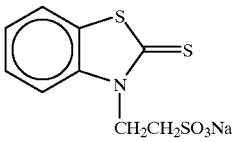
D-35.
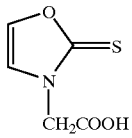
D-36.
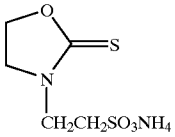

-continued

D-37.

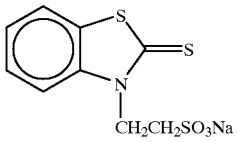

A compound represented by Formula (D) of the present invention can be synthesized with reference to, e.g., J. Org. Chem. 24, 470–473 (1959), J. Heterocycl. Chem. 4, 605–609 (1967), "Chemical Magazine" 82, 36–45 (1962), JP-B-39-26203, JP-A-63-229449, and OLS-2,043,944.

Formula (E) will be described in detail below.

In Formula (E), each of $R_{e1}$, $R_{e2}$($R_{e3}$, and $R_{e4}$ represents a hydrogen atom, an alkyl group, or an alkenyl group.

An alkyl group can have substituent groups such as a hydroxy group, a carboxyl group, a sulfo group, an amino group, and a nitro group and contains preferably 1 to 5 carbon atoms, and most preferably 1 or 2 carbon atoms.

An alkenyl group can have the above substituent groups and contains preferably 2 to 5 carbon atoms, and most preferably 2 or 3 carbon atoms.

In the present invention, each of $R_{e1}$ to $R_{e4}$ is preferably a hydrogen atom or a substituted or nonsubstituted 1- to 2-carbon alkyl group, and $R_{e1}$ is particularly preferably a substituted alkyl group. As the substituents, a hydroxy group, a carboxyl group, and a sulfo group are preferable, and a carboxyl group and a sulfo group are most preferable.

Specific examples of a compound represented by Formula (E) are presented below. However, the present invention is not limited to these examples.

(E-1) imidazole
(E-2) 1-methylimidazole
(E-3) 2-methylimidazole
(E-4) 4-methylimidazole
(E-5) 4-hydroxymethylimidazole
(E-6) 1-ethylimidazole
(E-7) 1-vinylimidazole
(E-8) 4-aminomethylimidazole
(E-9) 2,4-dimethylimidazole
(E-10) 2,4,5-trimethylimidazole
(E-11) 2-aminoethylimidazole
(E-12) 2-nitroethylimidazole
(E-13) 1-carboxymethyl-2-methyl-imidazole
(E-14) 1-carboxymethyl-2,4-dimethyl-imidazole
(E-15) 1-carboxyethyl-2-methyl-4-β-phydroxyethyl-imidazole
(E-16) 1-sulfoethyl-2-methyl-imidazole
(E-17) 1-sulfoethyl-2,4-dimethyl-imidazole
(E-18) 1-sulfomethyl-4,5-dimethyl-imidazole
(E-19) 1-sulfomethyl-2,5-dimethyl-imidazole
(E-20) 1-sulfoethyl-imidazole Among other silver halide solvents of the present invention, sodium thiosulfate, sodium methanethiosulfonate, A-1, A-2, A-3, A-4, A-9, A-10, B-3, B-8, B-9, B-11, B-12, D-2, and D-3 are preferable, and A-1, A-2, A-3, A-4, B-3, B-8, B-9, B-11, and B-12 are most preferable.

The amount of the silver halide solvent of the present invention to be added is preferably 0.1 to 50 mmols, more preferably 0.1 to 10 mmols, and most preferably 0.5 to 5.0 mmols per 1 l of a color developer. If the amount is added less than 0.1 mmol/l, the effect of the present invention is extremely decreased. If the amount added exceeds 50 mmols, the fog density in an unexposed portion is significantly increased.

Two or more types of the silver halide solvents of the present invention can be used together in accord with the intended use.

In the tabular silver halide emulsion of the present invention, 20% or more of grains started to be developed have a cavity extending through the major planes when developed with the color developer of the present invention for 60 sec. The determination method will be described in detail below.

The silver halide light-sensitive material of the present invention is determined under the following exposure and development conditions. Exposure is done by using white light with a color temperature of 4800° K., and determination is performed for a sample exposed with an exposure amount at the middle point of an exposure amount corresponding to a density of (fog+0.1) and a density of (maximum color density−0.1) on a characteristic curve, i.e., for a sample given a density equivalent to an average value (logE1+logE2)/2 of an exposure amount logE1 by which a density equivalent to (fog+0.1) is given on a characteristic curve and an exposure amount logE2 by which a density equivalent to (maximum color density−0.1) is given on the characteristic curve. Color development is performed in accordance with steps in processing C of Example 1 to be described later and in solution composition of color developer C used therein. Development is performed at a development temperature of 45.0° C. for a development time of 60 sec and immediately stopped by dipping the developed sample into a 3% aqueous solution of acetic acid for 3 min. The resultant sample is washed with flowing water at 25° C. for 3 min, dried, and observed. A cavity ratio is calculated for grains started to be developed, and the emulsion of the present invention contains 20% or more of grains having a cavity. Assuming that the ratio of grains started to be developed is about 25% of all grains, the lower limit of the cavity ratio is 20%×0.25=5% with respect to all grains.

The silver halide light-sensitive material processed as above was dipped into a 2% actinase (proteolytic enzyme) solution and gradually dissolved to an emulsion layer to be observed. Silver halide grains exposed to the surface were observed and photographed with a scanning electron microscope. FIGURE shows the scanning electron micrographs showing silver halide grains having no cavity (left) and silver halide grains of the present invention having a cavity (right). Filament-like developed silver is observed in the both micrographs.

In the micrographs shown in FIGURE, filament-like developed silver is found in silver halide grains started to be developed. With an exposure amount by which the number of silver halide grains started to be developed (development started grains) was 50% or less of all silver halide grains in the photographs, the ratio (%) of silver halide grains having a cavity extending through the major faces with respect to the number of development started grains (100 grains) was calculated.

High-sensitivity, high-quality images were obtained when the ratio of silver halide grains having a cavity extending through the major planes was 20% or higher. The ratio is preferably 40% or higher, more preferably 60% or higher, and most preferably 80% or higher.

The color developer of the present invention used in determining whether an emulsion is the silver halide emulsion of the present invention will be described below. The color developer of the present invention is basically an alkali solution containing a silver halide solvent and a p-phenylenediamine-based color developing agent and has a high solubility for a silver halide.

Preferable silver halide solvents are silver halide solvents (B-3), (B-9), and (B-12) of the present invention, and the addition amount is 0.5 to 3 mmols/l. The p-phenylenediamine-based color developing agent is preferably an N-hydroxy-substituted-alkyl-p-phenylenediamine derivative, and most preferably 2-methyl-4-(N-ethyl-N-(P-hydroxyethyl)amino)aniline, and the addition amount is preferably 30 to 45 mmols/l. The pH of the color developer is preferably 10.0 to 10.2, and the color developer preferably contains 0.2 to 0.3 mol/l of potassium carbonate as a buffering agent.

The most preferable example of a practical solution composition is the solution composition of a color developer C in Example 1 of the present invention.

The tabular silver halide grain of the present invention having a cavity extending through the major planes is effective in rapid processing. The reason presently estimated by the present inventors will be described below. To increase the speed of color development it must be essential to increase the developing speed of silver halide grains. Since a substance such as a color developing agent essential in development diffuses from a developer into a light-sensitive material, it must be important to increase the developing speed of silver halide grains particularly in light-sensitive silver halide emulsion layers closer to a support. As a means for accelerating development of silver halide grains, it is possible to use silver halide grains having a halogen composition with a high solubility. The solubility of a silver halide increases in the order of silver iodide, silver bromide, and silver chloride. In effect, the developing speed increases when the silver chloride content is increased. However, no appropriate gradation can be obtained (latitude is narrow), and the image quality such as graininess is degraded. Therefore, the present inventors changed the conception and considered what would happen if the developing speed is increased by using a color developer with a high solubility.

When the solubility is increased by adding a silver halide solvent (which is considered to form a complex with silver ions and dissolve them) conventionally well known as a fixing agent in a color developer, development occurs even in a silver halide in an unexposed portion, or a latent image formed on the surface of a silver halide also is dissolved, resulting in a low sensitivity or development interference. Sulfurous acid ion is added to common color developers in order to increase the stability of a solution. Although sulfurous acid ion has solubility for a silver halide, this solubility is very small and almost no development accelerating effect is found. The present inventors predicted that the object of the present invention is achieved if development is accelerated by increasing the solubility of a silver halide without destroying a latent image formed on the surface of a silver halide, and have made extensive studies and reached the present invention.

That is, the present inventors consider that when the tabular silver halide grains of the present invention are color-developed with the color developer of the present invention having a high solubility, a latent image on the surface of a silver halide is not destroyed because the surface is sparingly soluble. The silver halide dissolves from its interior and releases halogen ions, silver ions move in the solution or cause electron transfer in the silver halide grains to accelerate formation of silver in the latent image, and this increases the developing speed. It is estimated that as a result the tabular silver halide grain of the present invention has a cavity after the development.

To produce the silver halide grain having a cavity according to the present invention, it is preferable to add a compound (DIR compound) which reacts with an oxidized form of a color developing agent and releases a compound which adsorbs on the surface of a silver halide grain and decreases the solubility. The reason is estimated that the surface of a silver halide grain is made more sparingly soluble and the interior of the grain is made to dissolve more easily.

The tabular silver halide grains of the present invention will be described in detail below.

A silver halide emulsion used in the silver halide emulsion layer of the present invention consists of tabular silver halide grains having no cavity extending through two major planes opposing each other and having an average aspect ratio of 1.5 or more. The aspect ratio is the ratio of the diameter of a silver halide grains to its thickness. The diameter means the diameter of a circle having an area equal to the projected area of a grain when a silver halide emulsion is observed with a microscope or an electron microscope. Accordingly, when the aspect ratio is 2 the diameter of this circle is twice the thickness of the grain. The average aspect ratio is an arithmetic mean of the aspect ratios of a plurality of grains.

In the tabular silver halide grains of the present invention, the average aspect ratio is 1.5 or more, preferably 2 to 50, more preferably 3 to 25, and most preferably 5 to 10.

In a grain with a low aspect ratio, a cavity is difficult to form through the major planes. In a grain with a high aspect ratio, a peripheral portion also becomes readily soluble to make the formation of a cavity difficult.

The major surface of the tabular grain of the present invention can be selected from a (111) face, a (100) face, and a (110) face. A tabular grain having a (111) face as its major plane is particularly preferable. The present inventors estimate that this grain is a preferred form of the present invention because the grain has a plurality of (111) twin planes, a tabular grain having a high aspect ratio can be easily formed, and the dissolving activity of a (111) face is high. The next preferable tabular grain is a grain having a (100) face as its major plane. Anisotropic growth can be accelerated by making a slight amount of a halogen impurity exist in nucleation and introducing two structural lines.

The halogen composition of the tabular grain of the present invention can be selected from combinations of silver chloride, silver bromide, and silver iodide. It is preferable to select a mixed crystal of silver chlorobromide, silver bromochloroiodide, and silver iodobromide. A particularly preferable halogen composition is silver iodobromide. The present inventors estimate that a cavity can be selectively formed easily in major planes because silver iodobromide is appropriate to the solubility of a color developer. It is in some instances more preferable to make silver iodobromide containing 10 mol % or less of silver chloride. The silver iodide content is preferably 1 to 15 mol %, more preferably 2 to 10%, and most preferably 3 to 8 mol %. The next preferable halogen composition is silver chlorobromide. It is preferable that silver chlorobromide contain 5% or less of silver iodide. The silver chloride content is preferably 99.5 to 70 mol % or 5 to 30%.

The tabular grain of the present invention preferably has a distribution or a structure associated with a halogen composition in the grain. A typical example of such a grain is a core-shell or double structure grain having different halogen compositions in its interior and surface layer as disclosed in, e.g., JP-B-43-13162, JP-A-61-215540, JP-A-60-222845, JP-A-60-143331, or JP-A-61-7537. The structure need not be a simple double structure but may be a triple structure or a multiple structure larger than the triple structure as disclosed in JP-A-60-222844. It is also possible to bond a thin silver halide having a different composition from that of a core-shell double-structure grain on the surface of the grain.

The structure to be formed inside a grain need not be the surrounding structure as described above but may be a so-called Functioned structure. Examples of the Functioned structure are disclosed in JP-A-59-133540 and JP-A-58-108526, European Patent 199,290A2, JP-B-58-24772, and JP-A-59-16254. A crystal to be junctioned can be formed on the edge, the corner, or the face of a host crystal to have a different composition from that of the host crystal. Such a junctioned crystal can be formed regardless of whether a host crystal is uniform in halogen composition or has a core-shell structure.

In the case of the Functioned structure, it is naturally possible to use a combination of silver halides. However, it is also possible to form the junctioned structure by combining a silver halide and a silver salt compound not having a rock salt structure, such as silver rhodanide or silver carbonate. In addition, a non-silver salt compound, such as lead oxide, can also be used provided that formation of the junctioned structure is possible.

In the tabular grain of the present invention, a preferable structure is a multiple structure consisting of a core and a shell whose halogen composition is different from that of the core. A multiple structure grain consisting of a plurality of (two to six) shells is particularly preferable. The halogen compositions of a core, shells, and adjacent shells preferably have an iodide ion gap, bromide ion gap, and a chloride ion gap. An iodide ion gap is particularly preferable.

The iodide ion gap is preferably 1 to 30 mol %, more preferably 2 to 20 mol %, and most preferably 3 to 15 mol %. The bromide and chloride ion gaps are preferably 5 to 80 mol %, more preferably 10 to 60 mol %, and most preferably 20 to 50 mol %. The most preferable structure is a multiple structure tabular grain in which the halogen composition in an outer peripheral portion of a major plane is more slightly soluble than the composition in a central portion. That is, it is preferable that the iodide content or the bromide content in the outer peripheral portion be higher than that in the central portion. It is particularly preferable that the iodide content be higher.

The present inventors estimate that a cavity is readily formed in the major planes because a structural defect caused by a proper halogen gap triggers selective dissolution. It is also considered that a silver halide whose central portion is soluble is preferred because solution starts from the structural defect by the halogen gap.

Whether a grain structure is a preferable one of the present invention can be readily determined by those skilled in the art by checking the grain preparation formulation. Also, a grain structure can be easily checked by performing the most advanced grain structure instrumental analyzing means, e.g., a slice technique by which a grain is thinly sliced parallel or perpendicular to the major planes and a halogen composition analysis using an analytical electron microscope.

In a silver halide grain in which two or more silver halides are present as a mixed crystal or with a structure, it is important to control the distribution of halogen compositions between grains. A method of measuring the distribution of halogen compositions between grains is described in JP-A-60-254032. A uniform halogen distribution between grains is a desirable characteristic. In particular, a highly uniform emulsion having a variation coefficient of 20% or less is preferable.

Dislocation lines of a tabular grain can be observed by using a transmission electron microscope. Emulsion grains containing dislocation lines are very suited to the present invention. It is possible to select dislocation lines introduced linearly with respect to a specific direction of a crystal orientation of a grain or dislocation lines curved with respect to that direction. It is also possible to selectively introduce dislocation lines throughout an entire grain or only to a particular portion of a grain, e.g., the fringe portion of a grain. In the emulsion of the present invention, the number of dislocation lines per grain is preferably 10 or more, more preferably 20 or more, and most preferably 50 or more, i.e., high-density of dislocation lines is preferable. The introduction position of dislocation lines is preferably a fringe portion or a major plane. A fringe dislocation lines-type tabular grain is particularly preferable.

A silver halide emulsion used in the present invention can be subjected to a treatment for rounding grains, as disclosed in European Patent 96,727B1 or European Patent 64,412B1, or surface modification, as disclosed in West German Patent 2,306,447C2 or JP-A-60-221320.

Although a flat grain surface is common, intentionally forming projections and recesses on the surface is preferable in some cases.

The grain size of an emulsion used in the present invention can be evaluated in terms of the equivalent-circle diameter of the projected area of a grain obtained by using an electron microscope, the equivalent-sphere diameter of the volume of a grain calculated from the projected area and the thickness of the grain, or the equivalent-sphere diameter of the volume of a grain obtained by a Coulter counter method. It is possible to selectively use various grains from a very fine grain having an equivalent-sphere diameter of 0.05 $\mu$m or less to a large grain having that of 10 $\mu$m or more. It is preferable to use a grain having an equivalent-sphere diameter of 0.5 to 3 $\mu$m as a light-sensitive silver halide grain.

In the present invention, it is possible to use a so-called polydisperse emulsion having a wide grain size distribution or a monodisperse emulsion having a narrow grain size distribution in accordance with the intended use. However, the use of a monodisperse emulsion is preferred. As a measure representing the size distribution, a variation coefficient of either the equivalent-circle diameter of the projected area of a grain or the equivalent-sphere diameter of the volume of a grain is commonly used. When a monodisperse emulsion is to be used, it is desirable to use an emulsion having a size distribution with a variation coefficient of preferably 25% or less, more preferably 20% or less, and most preferably 15% or less.

In order for a light-sensitive material to satisfy its target gradation, it is preferable to mix two or more monodisperse silver halide emulsions having different grain sizes in the same emulsion layer in an emulsion layer having essentially the same color sensitivity.

Photographic emulsions used in the present invention can be prepared by the methods described in, e.g., P. Glafkides, Chimie et Physique Photographique, Paul Montel, 1967; G. F. Duffin, Photographic Emulsion Chemistry, Focal Press, 1966; and V. L. Zelikman et al., Making and Coating Photographic Emulsion, Focal Press, 1964. That is, any of an acid method, a neutral method, and an ammonia method can be used. In forming grains by a reaction of a soluble silver salt and a soluble halogen salt, any of a single-jet method, a double-jet method, and a combination of these methods can be used. A neutral and double-jet method is preferable in the present invention. As one type of the double-jet method, a method in which the pAg of a liqcid phase for producing a silver halide is maintained constant, i.e., a so-called controlled double-jet method can be used. This method is a preferable form of the present invention.

It is preferable to make use of a method of adding silver halide grains already formed by precipitation to a reactor vessel for emulsion preparation, and the methods described in U.S. Pat. Nos. 4,334,012, 4,301,241, and 4,150,994. These silver halide grains can be used as seed crystal and are also effective when supplied as a silver halide for growth. The seed crystal method is a preferable preparation method of the present invention. In the latter case, addition of an emulsion with a small grain size is preferable. The total amount of an emulsion can be added at one time, or an emulsion can be separately added a plurality of times or added continuously. In addition, it is effective in the present invention to add grains having several different halogen compositions in order to modify the surface.

As a grain growth method other than the method of adding a soluble silver salt and a halogen salt at a constant concentration and a constant flow rate, it is preferable to use a grain formation method in which the concentration or the flow rate is changed, such as described in British Patent 1,469,480 and U.S. Pat. Nos. 3,650,757 and 4,242,445. Increasing the concentration or the flow rate can change the amount of a silver halide to be supplied as a linear function or a quadratic function of the addition time.

For preparation of the emulsion of the present invention, the addition method of increasing the silver halide amount to be supplied is very preferable.

A mixing vessel for reacting solutions of soluble silver salts and soluble halogen salts can be selected from those described in U.S. Pat. Nos. 2,996,287, 3,342,605, 3,415,650, and 3,785,777 and West German Patents 2,556,885 and 2,555,364.

A silver halide solvent is useful for the purpose of accelerating ripening. As an example, it is known to make an excess of halogen ion exist in a reactor vessel in order to accelerate ripening. Another ripening agent can also be used. The total amount of these ripening agents can be mixed in a dispersing medium placed in a reactor vessel before addition of silver and a halide salt or can be introduced to the reactor vessel simultaneously with addition of a halide salt, a silver salt, and a deflocculant.

Examples of the ripening agent are ammonia, thiocyanate (e.g., potassium rhodanide and ammonium rhodanide), an organic thioether compound (e.g., compounds described in U.S. Pat. Nos. 3,574,628, 3,021,215, 3,057,724, 3,038,805, 4,276,374, 4,297,439, 3,704,130, and 4,782,013 and JP-A-57-104926), a thione compound (e.g., 4-substituted thioureas described in JP-A-53-82408 and JP-A-55-77737, and U.S. Pat. No. 4,221,863, and compounds described in JP-A-53-144319), mercapto compounds capable of accelerating growth of silver halide grains, described in JP-A-57-202531, and an amine compound (e.g., JP-A-54-100717).

It is advantageous to use gelatin as a protective colloid for use in preparation of emulsions of the present invention or as a binder for other hydrophilic colloid layers. However, another hydrophilic colloid can also be used in place of gelatin.

Examples of the hydrophilic colloid are protein, such as a gelatin derivative, a graft polymer of gelatin and another high polymer, albumin, and casein; a cellulose derivative such as hydroxyethylcellulose, carboxymethylcellulose, and cellulose sulfates; soda alginate; a sugar derivative such as starch derivative; and a variety of synthetic hydrophilic high polymers, such as homopolymers or copolymers, e.g., polyvinyl alcohol, polyvinyl alcohol partial acetal, poly-N-vinylpyrrolidone, polyacrylic acid, polymethacrylic acid, polyacrylamide, polyvinylimidazole, and polyvinylpyrazole.

Examples of gelatin are lime-processed gelatin, acid-processed gelatin, and enzyme-processed gelatin described in Bull. Soc. Sci. Photo. Japan. No. 16, page 30 (1966). In addition, a hydrolyzed product or an enzyme-decomposed product of gelatin can also be used.

It is preferable to wash an emulsion of the present invention to form a newly prepared protective colloid dispersion for a desalting purpose. Although the temperature of washing can be selected in accordance with the intended use, it is preferably 5° C. to 50° C. Although the pH of washing can also be selected in accordance with the intended use, it is preferably 2 to 10, and more preferably 3 to 8. The pAg of washing is preferably 5 to 10, though it can also be selected in accordance with the intended use. The washing method can be selected from noodle washing, dialysis using a semipermeable membrane, centrifugal separation, coagulation precipitation, and ion exchange. The coagulation precipitation can be selected from a method using sulfate, a method using an organic solvent, a method using a water-soluble polymer, and a method using a gelatin derivative.

In the preparation of an emulsion of the present invention, it is preferable to make salt of metal ion exist during grain formation, desalting, or chemical sensitization, or before coating in accordance with the intended use. The metal ion salt is preferably added during grain formation in performing doping for grains, and after grain formation and before completion of chemical sensitization in decorating the grain surface or when used as a chemical sensitizer. The doping can be performed for any of an overall grain, only the core, the shell, or the epitaxial portion of a grain, and only a substrate grain. Examples of the metal are Mg, Ca, Sr, Ba, Al, Sc, Y, La, Cr. Mn, Fe, Co, Ni, Cu, Zn, Ga, Ru, Rh, Pd, Re, Os, Ir, Pt, Au, Cd, Hg, Tl, In, Sn, Pb, and Bi. These metals can be added as long as they are in the form of salt that can be dissolved during grain formation, such as ammonium salt, acetate, nitrate, sulfate, phosphate, hydroacid salt, 6-coordinated complex salt, or 4-coordinated complex salt. Examples are $CdBr_2$, $CdCl_2$, $Cd(NO_3)_2$, $Pb(NO_3)_2$, $Pb(CH_3COO)_2$, $K_3(Fe(CN)_6)$, $(NH_4)_4(Fe(CN)_6)$, $K_3IrCl_6$, $(NH_4)_3RhCl_6$, and $K_4Ru(CN)_6$. The ligand of a coordination compound can be selected from halo, aquo, cyano, cyanate, thiocyanate, nitrosyl, thionitrosyl, oxo, and carbonyl. These metal compounds can be used either singly or in the form of a combination of two or more types of them.

It is sometimes useful to perform a method of adding a chalcogen compound during preparation of an emulsion, such as described in U.S. Pat. No. 3,772,031. In addition to S, Se, and Te, cyanate, thiocyanate, selenocyanate acid, carbonate, phosphate, and acetate can be present.

In formation of silver halide grains of the present invention, at least one of sulfur sensitization, selenium sensitization, gold sensitization, palladium sensitization or noble metal sensitization, and reduction sensitization can be performed at any point during the process of manufacturing a silver halide emulsion. The use of two or more different sensitizing methods is preferable. Several different types of emulsions can be prepared by changing the timing at which the chemical sensitization is performed. The emulsion types are classified into: a type in which a chemical sensitization speck is embedded inside a grain, a type in which it is embedded at a shallow position from the surface of a grain, and a type in which it is formed on the surface of a grain. In emulsions of the present invention, it is preferable to form at least one chemical sensitization speck on or near the surface.

One chemical sensitization which can be preferably performed in the present invention is chalcogen sensitization, noble metal sensitization, or a combination of these. The sensitization can be performed by using an active gelation as described in T. H. James, The Theory of the Photographic Process, 4th ed., Macmillan, 1977, pages 67 to 76. The sensitization can also be performed by using any of sulfur, selenium, tellurium, gold, platinum, palladium, and iridium, or by using a combination of a plurality of these sensitizers at pAg 5 to 10, pH 5 to 8, and a temperature of 30 to 80° C., as described in Research Disclosure, Vol. 120, April, 1974, 12008, Research Disclosure, Vol. 34, June, 1975, 13452, U.S. Pat. Nos. 2,642,361, 3,297,446, 3,772,031, 3,857,711, 3,901,714, 4,266,018, and 3,904,415, and British Patent 1,315,755. In the noble metal sensitization, salts of noble metals, such as gold, platinum, palladium, and iridium, can be used. In particular, gold sensitization, palladium sensitization, or a combination of the both is preferable. In the gold sensitization, it is possible to use known compounds, such as chloroauric acid, potassium chloroaurate, potassium aurithiocyanate, gold sulfide, and gold selenide. A palladium compound means a divalent or tetravalent salt of palladium. A preferable palladium compound is represented by $R_2PdX_6$ or $R_2PdX_4$ wherein R represents a hydrogen atom, an alkali metal atom, or an ammonium group and X represents a halogen atom, i.e., a chlorine, bromine, or iodine atom.

More specifically, the palladium compound is preferably $K_2PdCl_4$, $(NH_4)_2PdCl_6$, $Na_2PdCl_4$, $(NH_4)_2PdCl_4$, $Li_2PdCl_4$, $Na_2PdCl_6$, or $K_2PdBr_4$. It is preferable that the gold compound and the palladium compound be used in combination with thiocyanate or selenocyanate.

Examples of a sulfur sensitizer are hypo, a thiourea-based compound, a rhodanine-based compound, and sulfur-containing compounds described in U.S. Pat. Nos. 3,857,711, 4,266,018, and 4,054,457. The chemical sensitization can also be performed in the presence of a so-called chemical sensitization aid. Examples of a useful chemical sensitization aid are compounds, such as azaindene, azapyridazine, and azapyrimidine, which are known as compounds capable of suppressing fog and increasing sensitivity in the process of chemical sensitization.

Examples of the chemical sensitization aid and the modifier are described in U.S. Pat. Nos. 2,131,038, 3,411,914, and 3,554,757, JP-A-58-126526, and G. F. Duffin, Photographic Emulsion Chemistry, pages 138 to 143.

It is preferable to also perform gold sensitization for emulsions of the present invention. An amount of a gold sensitizer is preferably $1\times10^{-4}$ to $1\times10^{-7}$ mol, and more preferably $1\times10^{-5}$ to $5\times10^{-7}$ mol. A preferable amount of a palladium compound is $1\times10^{-3}$ to $5\times10^{-7}$. A preferable amount of a thiocyan compound or a selenocyan compound is $5\times10^{-2}$ to $1\times10^{-6}$.

An amount of a sulfur sensitizer with respect to silver halide grains of the present invention is preferably $1\times10^{-4}$ to $1\times10^{-7}$ mol, and more preferably $1\times10^{-5}$ to $5\times10^{-7}$ mol per mol of a silver halide.

Selenium sensitization is a preferable sensitizing method for emulsions of the present invention. Known labile selenium compounds are used in the selenium sensitization. Specific examples of the selenium compound are colloidal metal selenium, selenoureas (e.g., N,N-dimethylselenourea and N,N-diethylselenourea), selenoketones, and selenoamides. In some cases, it is preferable to perform the selenium sensitization in combination with one or both of the sulfur sensitization and the noble metal sensitization.

Silver halide emulsions of the present invention are preferably subjected to reduction sensitization during grain formation, after grain formation and before or during chemical sensitization, or after chemical sensitization.

The reduction sensitization can be selected from a method of adding reduction sensitizers to a silver halide emulsion, a method called silver ripening in which grains are grown or ripened in a low-pAg ambient at pAg 1 to 7, and a method called high-pH ripening in which grains are grown or ripened in a high-pH ambient at pH 8 to 11. It is also possible to perform two or more of these methods together.

The method of adding reduction sensitizers is preferable in that the level of reduction sensitization can be finely adjusted.

Known examples of the reduction sensitizer are stannous chloride, ascorbic acid and its derivative, amines and polyamines, a hydrazine derivative, formamidinesulfinic acid, a silane compound, and a borane compound. In the reduction sensitization of the present invention, it is possible to selectively use these known reduction sensitizers or to use two or more types of compounds together. Preferable compounds as the reduction sensitizer are stannous chloride, thiourea dioxide, dimethylamineborane, and ascorbic acid and its derivative. Although an addition amount of the reduction sensitizers must be so selected as to meet the emulsion manufacturing conditions, a preferable amount is $10^{-7}$ to $10^{-3}$ mol per mol of a silver halide.

The reduction sensitizers are dissolved in water or a solvent, such as alcohols, glycols, ketones, esters, or amides, and the resultant solution is added during grain growth. Although adding to a reactor vessel in advance is acceptable, adding at a given timing during grain growth is more preferable. It is also possible to add the reduction sensitizers to an aqueous solution of a water-soluble silver salt or a water-soluble alkali halide to precipitate silver halide grains by using this aqueous solution. Alternatively, a solution of the reduction sensitizers can be added separately several times or continuously over a long time period during grain growth.

It is preferable to use an oxidizer for silver during the process of manufacturing emulsions of the present invention. The oxidizer for silver means a compound having an effect of converting silver metal into silver ion. A particularly effective compound is the one that converts very fine silver grains, as a by-product in the process of formation of silver halide grains and chemical sensitization, into silver ion. The silver ion produced can form a silver salt hard to dissolve in water, such as a silver halide, silver sulfide, or silver selenide, or a silver salt easy to dissolve in water, such as silver nitrate. The oxidizer for silver can be either an inorganic or organic substance. Examples of the inorganic oxidizer are ozone, hydrogen peroxide and its adduct (e.g., $NaBO_2\cdot H_2O_2\cdot 3H_2O$, $2NaCO_3\cdot 3H_2O_2$, $Na_4P_2O_7\cdot 2H_2O_2$, and $2Na_2SO_4\cdot H_2O_2\cdot 2H_2O$), peroxy acid salt (e.g., $K_2S_2O_8$, $K_2C_2O_6$, and $K_2P_2O_8$), a peroxy complex compound (e.g., $K_2(Ti(O_2)C_2O_4)\cdot 3H_2O$, $4K_2SO_4\cdot Ti(O_2)OH\cdot SO_4\cdot 2H_2O$, and $Na_3(VO(O_2)(C_2H_4)_2)\cdot 6H_2O$), permanganate (e.g., $KMnO_4$), an oxyacid salt such as chromate (e.g., $K_2Cr_2O_7$), a halogen element such as iodine and bromine, perhalogenate (e.g., potassium periodate), a salt of a high-valence metal (e.g., potassium hexacyanoferrate(II)), and thiosulfonate.

Examples of the organic oxidizer are quinones such as p-quinone, an organic peroxide such as peracetic acid and perbenzoic acid, and a compound for releasing active halogen (e.g., N-bromosuccinimide, chloramine T, and chloramine B).

Preferable oxidizers of the present invention are an inorganic oxidizer such as ozone, hydrogen peroxide and its adduct, a halogen element, and thiosulfonate, and an organic oxidizer such as quinones. A combination of the reduction sensitization described above and the oxidizer for silver is preferable. In this case, the reduction sensitization can be performed after the oxidizer is used or vice versa, or the reduction sensitization and the use of the oxidizer can be performed at the same time. These methods can be selectively performed during grain formation or chemical sensitization.

Photographic emulsions used in the present invention may contain various compounds in order to prevent fog during the preparing process, storage, or photographic processing of a light-sensitive material, or to stabilize photographic properties. Usable compounds are those known as an antifoggant or a stabilizer, for example, thiazoles, such as benzothiazoles, nitroimidazoles, nitrobenzimidazoles, chlorobenzimidazoles, bromobenzimidazoles, mercaptothiazoles, mercaptobenzothiazoles, mecaptobenzimidazoles, mercaptothiadiazoles, aminotriazoles, benzotriazoles, nitrobenzotriazoles, and mercaptotetrazoles (particularly 1-phenyl-5-mercaptotetrazole); mercaptopyrimidines; mercaptotriazines; a thioketo compound such as oxadolinethione; azaindenes, such as triazaindenes, tetrazaindenes (particularly hydroxy-substituted(1,3,3a,7)tetrazaindenes), and pentazaindenes. For example, compounds described in U.S. Pat. Nos. 3,954,474 and 3,982,947 and JP-B-52-28660 can be used. One preferable compound is described in JP-A-63-21293. Antifoggants and stabilizers can be added at any of several different timings, such as before, during, and after grain formation, during washing with water, during dispersion after the washing, before,wduring, and after chemical sensitization, and before coating, in accord with the intended application. The antifoggants and the stabilizers can be added during preparation of an emulsion to achieve their original fog preventing effect and stabilizing effect. In addition, the antifoggants and the stabilizers can be used for various purposes of, e.g., controlling the crystal habit of grains, decreasing grain size, decreasing the solubility of grains, controlling chemical sensitization, and controlling an arrangement of dyes.

Photographic emulsions used in the present invention are preferably subjected to spectral sensitization by methine dyes and the like in order to achieve the effects of the present invention. Usable dyes involve a cyanine dye, a merocyanine dye, a composite cyanine dye, a composite merocyanine dye, a holopolar cyanine dye, a hemicyanine dye, a styryl dye, and a hemioxonole dye. Most useful dyes are a cyanine dye, a merocyanine dye, and a composite merocyanine dye. Any nucleus commonly used as a basic heterocyclic nucleus in cyanine dyes can be applied to these dyes. Examples of an applicable nucleus are a pyrroline nucleus, an oxazoline nucleus, a thiozoline nucleus, a pyrrole nucleus, an oxazole nucleus, a thiazole nucleus, a selenazole nucleus, an imidazole nucleus, a tetrazole nucleus, and a pyridine nucleus; a nucleus in which an aliphatic hydrocarbon ring is fused to any of the above nuclei; and a nucleus in which an aromatic hydrocarbon ring is fused to any of the above nuclei, e.g., an indolenine nucleus, a benzindolenine nucleus, an indole nucleus, a benzoxadole nucleus, a naphthoxazole nucleus, a benzthiazole nucleus, a naphthothiazole nucleus, a benzoselenazole nucleus, a benzimidazole nucleus, and a quinoline nucleus. These nuclei can be substituted on a carbon atom.

It is possible to apply to a merocyanine dye or a composite merocyanine dye a 5- to 6-membered heterocyclic nucleus as a nucleus having a ketomethylene structure. Examples are a pyrazoline-5-one nucleus, a thiohydantoin nucleus, a 2-thiooxazolidine-2,4-dione nucleus, a thiazolidine-2,4-dione nucleus, a rhodanine nucleus, and a thiobarbituric acid nucleus.

Although these sensitizing dyes may be used singly, they can also be used together. The combination of sensitizing dyes is often used for a supersensitization purpose. Representative examples of the combination are described in U.S. Pat. Nos. 2,688,545, 2,977,229, 3,397,060, 3,522,052, 3,527,641, 3,617,293, 3,268,964, 3,666,480, 3,672,898, 3,679,428, 3,703,377, 3,769,301, 3,814,609, 3,837,862, and 4,026,707, British Patents 1,344,281 and 1,507,803, JP-B-43-4936 and JP-B-53-12375, and JP-A-52-110618 and JP-A-52-109925.

Emulsions can contain, in addition to the sensitizing dyes, dyes having no spectral sensitizing effect or substances not essentially absorbing visible light and presenting supersensitization.

The sensitizing dyes can be added to an emulsion at any point in preparation of an emulsion, which is conventionally known to be useful. Most ordinarily, the addition is performed after completion of chemical sensitization and before coating. However, it is possible to perform the addition at the same time as addition of chemical sensitizing dyes to perform spectral sensitization and chemical sensitization simultaneously, as described in U.S. Pat. Nos. 3,628,969 and 4,225,666. It is also possible to perform the addition prior to chemical sensitization, as described in JP-A-58-113928, or before completion of formation of silver halide grain precipitation to start spectral sensitization. Alternatively, as disclosed in U.S. Pat. No. 4,225,666, these compounds can be added separately; a portion of the compounds may be added prior to chemical sensitization, while the remaining portion is added after that. That is, the compounds can be added at any time during formation of silver halide grains, including the method disclosed in U.S. Pat. No. 4,183,756.

The addition amount can be $4\times10^{-6}$ to $8\times10^{-3}$ mol per mol of a silver halide. However, for a more preferable silver halide grain size of 0.2 to 1.2 $\mu$m, an addition amount of about $5\times10^{-5}$ to $2\times10^{-3}$ mol is more effective.

Although the several different additives described above can be used in the light-sensitive material according to the present invention, a variety of other additives can also be used in accordance with the intended use.

The details of these additives are described in Research Disclosures Item 17643 (December, 1978), Item 18716 (November, 1979), and Item 308119 (December, 1989), and these portions are summarized in a table below.

| | Additives | RD17643 | RD18716 |
|---|---|---|---|
| 1. | Chemical sensitizers | page 23 | page 648, right column |
| 2. | Sensitivity increasing agents | | page 648, right column |
| 3. | Spectral sensitizers, super sensitizers | pages 23–24 | page 648, right column to page 649, right column |
| 4. | Brighteners | page 24 | page 648, right column |
| 5. | Antifoggants and stabilizers | pages 24–25 | page 649, right column |
| 6. | Light absorbent, filter dye, ultraviolet absorbents | pages 25–26 | page 649, right column to page 650, left column |
| 7. | Stain preventing agents | page 25, right column | page 650, left to right columns |
| 8. | Dye image stabilizer | page 25 | page 650, left column |
| 9. | Hardening agents | page 26 | page 651, left column |

-continued

| | | | |
|---|---|---|---|
| 10. | Binder | page 26 | page 651, left column |
| 11. | Plasticizers, lubricants | page 27 | page 650, right column |
| 12. | Coating aids, surface active agents | pages 26–27 | page 650, right column |
| 13. | Antistatic agents | page 27 | page 650, right column |
| 14. | Matting agent | | |

| | Additives | RD308119 |
|---|---|---|
| 1. | Chemical sensitizers | page 996 |
| 2. | Sensitivity increasing agents | |
| 3. | Spectral sensitizers, super sensitizers | page 996, right column to page 998, right column |
| 4. | Brighteners | page 998, right column |
| 5. | Antifoggants and stabilizers | page 998, right column to page 1,000, right column |
| 6. | Light absorbent, filter dye, ultraviolet absorbents | page 1,003, left column to page 1,003, right column |
| 7. | Stain preventing agents | page 1,002, right column |
| 8. | Dye image stabilizer | page 1,002, right column |
| 9. | Hardening agents | page 1,004, right column to page 1,005, right column |
| 10. | Binder | page 1,003, right column to page 1,004, right column |
| 11. | Plasticizers, lubricants | page 1,006, left to right columns |
| 12. | Coating aids, surface active agents | page 1,005, left column to page 1,006, left column |
| 13. | Antistatic agents | page 1,006, right column to page 1,007, left column |
| 14. | Matting agent | page 1,008, left column to page 1,009, left column |

The light-sensitive material of the present invention needs only to have at least one of a silver halide emulsion layer, i.e., a blue-sensitive layer, a green-sensitive layer, and a red-sensitive layer, formed on a support. The number or order of the silver halide emulsion layers and the non-light-sensitive layers are not particularly limited. A typical example is a silver halide photographic light-sensitive material having, on a support, at least one light-sensitive layer constituted by a plurality of silver halide emulsion layers which are sensitive to essentially the same color but have different sensitivities or speeds. The unit light-sensitive layer is sensitive to blue, green, or red. In a multilayered silver halide color photographic light-sensitive material, the unit light-sensitive layers are generally arranged such that red-, green-, and blue-sensitive layers are formed from a support side in the order named. However, according to the intended use, this arrangement order may be reversed, or light-sensitive layers sensitive to the same color may sandwich another light-sensitive layer sensitive to a different color. Non-light-sensitive layers such as various types of interlayers can be formed between the silver halide light-sensitive layers and as the uppermost layer and the lowermost layer. These non-light-sensitive layers can contain, e.g., couplers, DIR compounds, and color amalgamation inhibitors to be described later. As a plurality of silver halide emulsion layers constituting each unit light-sensitive layer, as described in DE 1,121,470 or GB 923,045, high- and low-speed emulsion layers are preferably arranged such that the sensitivity is sequentially decreased toward a support. In addition, as described in JP-A-57-112751, JP-A-62-200350, JP-A-62-206541, and JP-A-62-206543, layers may be arranged such that a low-speed emulsion layer is formed remotely from a support and a high-speed layer is formed close to the support.

More specifically, layers may be arranged from the farthest side from a support in an order of low-speed blue-sensitive layer (BL)/high-speed blue-sensitive layer (BH)/high-speed green-sensitive layer (GH)/low-speed green-sensitive layer (GL)/high-speed red-sensitive layer (RH)/low-speed red-sensitive layer (RL), an order of BH/BL/GL/GH/RH/RL, or an order of BH/BL/GH/GL/RL/RH.

In addition, as described in JP-B-55-34932, layers may be arranged from the farthest side from a support in an order of blue-sensitive layer/GH/RH/GL/RL. Furthermore, as described in JP-A-56-25738 and JP-A-62-63936, layers may be arranged from the farthest side from a support in an order of blue-sensitive layer/GL/RL/GH/RH.

As described in JP-B-49-15495, three layers may be arranged such that a silver halide emulsion layer having the highest sensitivity is arranged as an upper layer, a silver halide emulsion layer having sensitivity lower than that of the upper layer is arranged as an intermediate layer, and a silver halide emulsion layer having sensitivity lower than that of the interlayer is arranged as a lower layer, i.e., three layers having different sensitivities may be arranged such that the sensitivity is sequentially decreased toward the support. When a layer structure is constituted by three layers having different sensitivities, these layers may be arranged in an order of medium-speed emulsion layer/high-speed emulsion layer/low-speed emulsion layer from the farthest side from a support in a layer sensitive to one color as described in JP-A-59-202464.

In addition, an order of high-speed emulsion layer/low-speed emulsion layer/medium-speed emulsion layer or low-speed emulsion layer/medium-speed emulsion layer/high-speed emulsion layer may be adopted. Furthermore, the arrangement can be changed as described above even when four or more layers are formed.

In order to improve the color reproduction, a donor layer (CL) with an interlayer effect, which is described in U.S. Pat. Nos. 4,663,271, 4,705,744, or 4,707,436, or JP-A-62-160448 or JP-A-63-89580 and different from the main light-sensitive layers BL, GL, and RL in spectral sensitivity distribution, is preferably formed adjacent to or close to the main light-sensitive layers.

The silver halide grains of the present invention are preferably contained in a light-sensitive layer closest to a support. When this light-sensitive layer consists of two or more layers different in light sensitivity, it is particularly preferable that the silver halide grains be contained in a light-sensitive layer except the one with the highest sensitivity.

Various dye formation couplers can be used in the light-sensitive material of the present invention, and the following couplers are particularly preferable.

Yellow couplers: couplers represented by Formulas (I) and (II) in EP502,424A; couplers (particularly Y-28 on page 18) represented by Formulas (1) and (2) in EP513,496A; a coupler represented by Formula (I) in claim 1 of EP568,037A; a coupler represented by Formula (I) in column 1, lines 45 to 55, in USP5,066,576; a coupler represented by Formula (I) in paragraph 0008 of JP-A-4-274425; couplers (particularly D-35 on page 18) described in claim 1 on page 40 in EP498,381A1; couplers (particularly Y-1 (page 17) and Y-54 (page 41)) represented by Formula (Y) on page 4 in EP447,969A1; and couplers (particularly II-17, II-19 (column 17), and II-24 (column 19)) represented by Formulas (II) to (IV) in column 7, lines 36 to 58, in U.S. Pat. No. 4,476,219.

Magenta couplers: JP-A-3-39737 (L-57 (page 11, lower right column), L-68 (page 12, lower right column), and L-77 (page 13, lower right column); [A-4]-63 (page 134), and [A-4]-73 and [A-4]-75 (page 139) in EP456,257; M-4 and M-6 (page 26), and M-7 (page 27) in EP486,956; M-45 (page 19) in EP571,959A; (M-1) (page 6) in JP-A-5-204106; and M-22 in paragraph 0237 of JP-A-4-362631.

Cyan couplers: CX-1, CX-3, CX-4, CX-5, CX-11, CX-12, CX-14, and CX-15 (pages 14 to 16) in JP-A-4-204843; C-7 and C-10 (page 35), C-34 and C-35 (page 37), and (I-1) and (I-17) (pages 42 and 43) in JP-A-4-43345; and couplers represented by Formulas (Ia) and (Ib) in claim 1 of JP-A-6-67385.

Polymer couplers: P-1 and P-5 (page 11) in JP-A-2-44345.

Couplers for forming a colored dye with a proper diffusibility are preferably those described in U.S. Pat. No. 4,366,237, GB2,125,570, EP96,873B, and DE3,234,533.

Couplers for correcting unnecessary absorption of a colored dye are preferably yellow colored cyan couplers (particularly YC-86 on page 84) represented by Formulas (CI), (CII), (CIII), and (CIV) described on page 5 in EP456,257A1; yellow colored magenta couplers ExM-7 (page 202), EX-1 (page 249), and EX-7 (page 251) in EP456,257A1; magenta colored cyan couplers CC-9 (column 8) and CC-13 (column 10) described in U.S. Pat. No. 4,833,069; (2) (column 8) in U.S. Pat. No. 4,837,136; and colorless masking couplers (particularly compound examples on pages 36 to 45) represented by Formula (A) in WO92/11575.

Examples of a compound (including a coupler) which reacts with a developing agent in oxidized form and releases a photographically useful compound residue are as follows. Bleaching accelerator release compounds: compounds (particularly (60) and (61) on page 61) represented by Formulas (I) and (I') on page 5 of EP310,125A2, and compounds (particularly (7) (page 7)) represented by Formula (I) in claim 1 of JP-A-6-59411; ligand release compound: compounds (particularly compounds in column 12, lines 21 to 41) represented by LIG-X described in claim 1 of U.S. Pat. No. 4,555,478; leuco dye release compounds: compounds 1 to 6 in columns 3 to 8 of U.S. Pat. No. 4,749,641; fluorescent dye release compounds: compounds (particularly compounds 1 to 11 in columns 7 to 10) represented by COUP-DYE in claim 1 of U.S. Pat. No. 4,774,181; development accelerators or fogging agent release compounds: compounds (particularly (I-22) in column 25) represented by Formulas (1), (2), and (3) in column 3 of U.S. Pat. No. 4,656,123, and ExZK-2 on page 75, lines 36 to 38, in EP450,637A2; compounds which release a group which does not function as a dye unless it splits off: compounds (particularly Y-1 to Y-19 in columns 25 to 36) represented by Formula (I) in claim 1 of U.S. Pat. No. 4,857,447.

Preferable examples of additives other than couplers are as follows.

Dispersants of an oil-soluble organic compound: P-3, P-5, P-16, P-19, P-25, P-30, P-42, P-49, P-54, P-55, P-66, P-81, P-85, P-86, and P-93 (pages 140 to 144) in JP-A-62-215272; impregnating latexes of an oil-soluble organic compound: latexes described in U.S. Pat. No. 4,199,363; developing agent oxidized form scavengers: compounds (particularly I-(1), I-(2), I-(6), and I-(12) (columns 4 and 5)) represented by Formula (I) in column 2, lines 54 to 62, in U.S. Pat. No. 4,978,606, and formulas (particularly compound 1 (column 3)) in column 2, lines 5 to 10, in U.S. Pat. No. 4,923,787; stain inhibitors: Formulas (I) to (III) on page 4, lines 30 to 33, particularly I-47, I-72, III-1, and III-27 (pages 24 to 48) in EP298321A; brown inhibitors: A-6, A-7, A-20, A-21, A-23, A-24, A-25, A-26, A-30, A-37, A-40, A-42, A-48, A-63, A-90, A-92, A-94, and A-164 (pages 69 to 118) in EP298321A, II-III-23, particularly III-10, in columns 25 to 38 of U.S. Pat. No. 5,122,444, I-1 to III-4, particularly II-2, on pages 8 to 12 in EP471347A, and A-1 to A-48, particularly A-39 and A-42, in columns 32 to 40 of U.S. Pat. No. 5,139,931; materials which reduce the use amount of a color enhancer or a color amalgamation inhibitor: I-1 to II-15, particularly I-46, on pages 5 to 24 in EP411324A; formalin scavengers: SCV-1 to SCV-28, particularly SCV-8, on pages 24 to 29 in EP477932A; film hardeners: H-1, H-4, H-6, H-8, and H-14 on page 17 in JP-A-1-214845, compounds (H-1 to H-54) represented by Formulas (VII) to (XII) in columns 13 to 23 of U.S. Pat. No. 4,618,573, compounds (H-1 to H-76), particularly H-14, represented by Formula (6) on page 8, lower right column, in JP-A-2-214852, and compounds described in claim 1 of U.S. Pat. No. 3,325,287; development inhibitor precursors: P-24, P-37, and P-39 (pages 6 and 7) in JP-A-62-168139; compounds described in claim 1, particularly 28 and 29 in column 7, of U.S. Pat. No. 5,019492; antiseptic agents and mildewproofing agents: I-1 to III-43, particularly II-1, II-9, II-10, II-18, and III-25, in columns 3 to 15 of U.S. Pat. No. 4,923,790; stabilizers and antifoggants: I-1 to (14), particularly I-1, I-60, (2), and (13), in columns 6 to 16 of U.S. Pat. No. 4,923,793, and compounds 1 to 65, particularly compound 36, in columns 25 to 32 of U.S. Pat. No. 4,952,483; dyes: a-1 to b-20, particularly a-1, a-12, a-18, a-27, a-35, a-36, and b-5, on pages 15 to 18 and V-i to V-23, particularly V-1, on pages 27 to 29 in JP-A-3-156450, F-I-1 to F-II-43, particularly F-I-11 and F-II-8, on pages 33 to 55 in EP445627A, III-1 to III-36, particularly III-1 and III-3, on pages 17 to 28 in EP457153A, fine crystal dispersions of Dye-1 to Dye-124 on pages 8 to 26 in WO88/04794, compounds 1 to 22, particularly compound 1, on pages 6 to 11 in EP319999A. compounds D-1 to D-87 (pages 3 to 28) represented by Formulas (1) to (3) in EP519306A, compounds 1 to 22 (columns 3 to 10) represented by Formula (I) in U.S. Pat. No. 4,268,622, and compounds (1) to (3) (columns 2 to 9) represented by Formula (I) in U.S. Pat. No. 4,923,788; UV absorbents: compounds (18b) to (18r) and 101 to 427 (pages 6 to 9) represented by Formula (1) in JP-A-46-3335, compounds (3) to (66) (pages 10 to 44) and compounds HBT-1 to HBT-10 (page 14) represented by Formula (III) in EP520938A, and compounds (1) to (31) (columns 2 to 9) represented by Formula (1) in EP521823A.

The present invention can be applied to various color light-sensitive materials such as a color negative film for a general purpose or a movie, a color reversal film for a slide or a television, color paper, a color positive film, and color reversal paper. The present invention is also suitable for film units with a lens described in JP-B-2-32615 and JU-B3-39784 ("JU-B" means Published Examined Japanese utility Model Application).

A support which can be suitably used in the present invention is described in, e.g., RD. No. 17643, page 28, RD. No. 18716, from the right column, page 647 to the left column, page 648, and RD. No. 307105, page 879.

In the light-sensitive material of the present invention, the total film thickness of all hydrophilic colloid layers on the side having emulsion layers is preferably 28 μm or less, more preferably 23 μm or less, particularly preferably 18 μm or less, and most preferably 16 μm or less. A film swell speed $T_{1/2}$ is preferably 30 sec or less, and more preferably, 20 sec or less. $T_{1/2}$ is defined as a time which the film thickness requires to reach ½ of the saturation film thickness which is 90% of a maximum swell film thickness reached when processing is performed by using a color developer at 30° C. for 3 min and 15 sec. The film thickness means the thickness of a film measured under moisture conditioning at a temperature of 25° C. and a relative humidity of 55% (two days). $T_{1/2}$ can be measured by using a swell meter described in Photogr. Sci. Eng., A. Green et al., Vol. 19, No. 2, pp. 124 to 129. $T_{1/2}$ can be adjusted by adding a film hardening agent to gelatin as a binder or changing aging conditions after coating. The swell ratio is preferably 150 to 400%. The swell ratio can be calculated from the maximum swell film thickness under the conditions mentioned above by using (maximum swell film thickness—film thickness)/film thickness.

In the light-sensitive material of the present invention, hydrophilic colloid layers (called back layers) having a total dried film thickness of 2 to 20 μm are preferably formed on the side opposite to the side having emulsion layers. The back layers preferably contain, e.g., the light absorbent, the filter dye, the ultraviolet absorbent, the antistatic agent, the film hardener, the binder, the plasticizer, the lubricant, the coating aid, and the surfactant described above. The lubrication ratio of the back layers is preferably 150% to 500%.

A transparent magnetic recording layer used in the present invention will be described below.

A transparent magnetic recording layer used in the present invention is formed by coating the surface of a support with an aqueous or organic solvent-based coating solution which is prepared by dispersing magnetic grains in a binder.

As the magnetic grains used in the present invention, it is possible to use grains of, e.g., ferromagnetic iron oxide such as $\gamma Fe_2O_3$, Co-deposited $\gamma Fe_2O_3$, Co-deposited magnetite, Co-containing magnetite, ferromagnetic chromium dioxide, a ferromagnetic metal, a ferromagnetic alloy, Ba ferrite of a hexagonal system, Sr ferrite, Pb ferrite, and Ca ferrite. Co-deposited ferromagnetic iron oxide such as Co-deposited $\gamma Fe_2O_3$ is preferable. The grain can take the shape of any of, e.g., a needle, a rice grain, a sphere, a cube, and a plate. A specific area is preferably 20 $m^2/g$ or more, and more specifically 30 $m^2/g$ or more as $S_{BET}$. The saturation magnetization (σs) of the ferromagnetic substance is preferably $3.0\times10^4$ to $3.0\times10^5$ A/m, and most preferably $4.0\times10^4$ to $2.5\times10^5$ A/m. A surface treatment can be performed for the ferromagnetic grains by using silica and/or alumina or an organic material. Also, the surface of the ferromagnetic grain can be treated with a silane coupling agent or a titanium coupling agent as described in JP-A-6-161032. A ferromagnetic grain whose surface is coated with an inorganic or organic substance, described in JP-A-4-259911 or JP-A-5-81652, also can be used.

As the binder used together with the magnetic grains, it is possible to use a thermoplastic resin, a thermosetting resin, a radiation-curing resin, a reactive resin, an acid, an alkali or biodegradable polymer, a natural polymer (e.g., a cellulose derivative and a sugar derivative), and their mixtures described in JP-A-4-219569. Tg of the resin is −40° C. to 300° C., and its weight average molecular weight is 2000 to 1,000,000. Examples are a vinyl copolymer, cellulose derivatives such as cellulosediacetate, cellulosetriacetate, celluloseacetatepropionate, celluloseacetatebutylate, and cellulosetripropionate, an acrylic resin, and a polyvinylacetal resin. Gelatin is also preferable. Cellulosedi(tri)acetate is particularly preferable. The binder can be hardened by the addition of an epoxy, aziridine, or isocyanate crosslinking agent. Examples of the isocyanate crosslinking agent are isocyanates such as tolylenediisocyanate, 4,4'-diphenylmethanediisocyanate, hexamethylenediisocyanate, and xylylenediisocyanate, reaction products of these isocyanates and polyalcohol (e.g., a reaction product of 3 mols of tolylenediisocyanate and 1 mol of trimethilolpropane), and polyisocyanate produced by condensation of any of these isocyanates. These examples are described in JP-A-6-59357.

As a method of dispersing the magnetic substance in the binder, as described in JP-A-6-35092, the use of a kneader, a pin type mill, or an annular mill is preferable, and the combination of them also is preferable. Dispersants described in JP-A-5-88283 and other known dispersants can be used. The thickness of the magnetic recording layer is 0.1 to 10 μm, preferably 0.2 to 5 μm, and more preferably 0.3 to 3 μm. The weight ratio of the magnetic grains to the binder is preferably 0.5:100 to 60:100, and more preferably 1:100 to 30:100. The coating amount of the magnetic grains is 0.005 to 3 $g/m^2$, preferably 0.01 to 2 $g/m^2$, and more preferably 0.02 to 0.5 $g/m^2$. The magnetic recording layer used in the present invention can be formed in the whole area of, or into the shape of stripes on, the back surface of a photographic support by coating or printing. As a method of coating the magnetic recording layer, it is possible to use any of an air doctor, a blade, an air knife, squeegee, impregnation, a reverse roll, a transfer roll, gravure, kiss, cast, spray, dip, a bar, and extrusion. A coating solution described in JP-A-5-341436 is preferable.

The magnetic recording layer can be given a lubricating property improving function, a curling adjusting function, an antistatic function, an adhesion preventing function, and a head polishing function. Alternatively, another functional layer can be formed and these functions can be given to that layer. A polishing agent in which at least one type of grains are aspherical inorganic grains having a Mohs hardness of 5 or more is preferable. The composition of the aspherical inorganic grain is preferably an oxide such as aluminum oxide, chromium oxide, silicon dioxide, titanium dioxide, and silicon carbide, a carbide such as silicon carbide and titanium carbide, or a fine powder of diamond. The surfaces of the grains constituting these polishing agents can be treated with a silane coupling agent or a titanium coupling agent. These grains can be added to the magnetic recording layer or overcoated (as, e.g., a protective layer or a lubricant layer) on the magnetic recording layer. The binder used together with the grains can be any of those described above and is preferably the same binder as in the magnetic recording layer. Light-sensitive materials having the magnetic recording layer are described in U.S. Pat. Nos. 5,336,589, 5,250,404, 5,229,259 and 5,215,874, and European Patent 466,130.

A polyester support used in the present invention will be described below. Details of the polyester support and light-sensitive materials, processing, cartridges, and examples (to be described later) are described in Journal of Technical Disclosure No. 94-6023 (JIII; Mar. 15, 1994). Polyester used in the present invention is formed by using diol and aromatic dicarboxylic acid as essential components. Examples of the aromatic dicarboxylic acid are 2,6-, 1,5-, 1,4-, and 2,7-naphthalenedicarboxylic acids, terephthalic acid, isophthalic acid, and phthalic acid. Examples of the diol are diethyleneglycol, triethyleneglycol, cyclohexanedimethanol, bisphenol A, and bisphenol. Examples of the polymer are homopolymers such as polyethyleneterephthalate, polyethylenenaphthalate, and polycyclohexanedimethanolterephthalate. Polyester containing 50 to 100 mol % of 2,6-naphthalenedicarboxylic acid is particularly preferable. Polyethylene-2,6-naphthalate is most preferable among other polymers. The average molecular weight ranges between about 5,000 and 200,000. Tg of the polyester of the present invention is 50° C. or higher, preferably 90° C. or higher.

To give the polyester support resistance to curling, the polyester support is heat-treated at a temperature of 40° C. to less than Tg, more preferably Tg −20° C. to less than Tg. The heat treatment can be performed at a fixed temperature within this range or can be performed together with cooling. The heat treatment time is 0.1 to 1500 hours, more preferably 0.5 to 200 hours. The heat treatment can be performed for a roll-like support or while a support is conveyed in the form of a web. The surface shape also can be improved by forming undulations (e.g., coating conductive inorganic fine grains such as $SnO_2$ or $Sb_2O_5$ grains) on the surface. It is desirable to knurl and slightly raise the end portion, thereby preventing the cut portion of the core from being photographed. These heat treatments can be performed in any stage after support film formation, after surface treatment, after back layer coating (e.g., an antistatic agent or a lubricating agent), and after undercoating. A preferable time is after the antistatic agent is coated.

An ultraviolet absorbent can be incorporated into this polyester. Also, to prevent light piping, dyes or pigments such as Diaresin manufactured by Mitsubishi Kasei Corp. or Kayaset manufactured by NIPPON KAYAKU CO. LTD. commercially available for polyester can be incorporated.

In the present invention, it is preferable to perform a surface treatment in order to adhere the support and the light-sensitive material constituting layers. Examples of the surface treatment are surface activation treatments such as a chemical treatment, a mechanical treatment, a corona discharge treatment, a flame treatment, an ultraviolet treatment, a high-frequency treatment, a glow discharge treatment, an active plasma treatment, a laser treatment, a mixed acid treatment, and an ozone oxidation treatment. Among other surface treatments, the ultraviolet irradiation treatment, the flame treatment, the corona treatment, and the glow treatment are preferable.

The undercoating layer can consist of a single layer or two or more layers. Examples of the undercoating layer binder are copolymers formed by using, as the starting material, a monomer selected from vinylchloride, vinylidenechloride, butadiene, methacrylic acid, acrylic acid, itaconic acid, and maleic anhydride. Other examples are polyethyleneimine, an epoxy resin, grafted gelatin, nitrocellulose, and gelatin. Resorcin and p-chlorophenol are examples of compounds that swell the support. Examples of a gelatin hardener added to the undercoating layer are chromium salt (e.g., chromium alum), aldehydes (e.g., formaldehyde and glutaraldehyde), isocyanates, an active halogen compound (e.g., 2,4-dichloro-6-hydroxy-s-triazine), an epichlorohydrin resin, and an active vinylsulfone compound. $SiO_2$, $TiO_2$, inorganic fine grains, or polymethylmethacrylate copolymer fine grains (0.01 to 10 μm) can also be contained as a matting agent.

In the present invention, antistatic agents are preferably used. Examples of these antistatic agents are carboxylic acid and carboxylate, a macromolecule containing sulfonate, a cationic macromolecule, and an ionic surfactant compound.

As the antistatic agent, it is most preferable to use fine grains of at least one crystalline metal oxide selected from ZnO, $TiO_2$, $SnO_2$, $Al_2O_3$, $In_2O_3$, $SiO_2$, MgO, BaO, $MoO_3$, and $V_2O_5$ and having a volume resistivity of $10^7$ ω·cm or less, more preferably $10^5$ ω·cm or less and a grain size of 0.001 to 1.0 μm, fine grains of composite oxides (e.g., Sb, P, B, In, S, Si, and C) of these metal oxides, fine grains of sol metal oxides, or fine grains of composite oxides of these sol metal oxides. The content in the light-sensitive material is preferably 5 to 500 mg/m$^2$, and most preferably 10 to 350 mg/m$^2$. The ratio of a conductive crystalline oxide or its composite oxide to the binder is preferably 1/300 to 100/1, and more preferably 1/100 to 100/5.

The light-sensitive material of the present invention preferably has a slip property. Slip agent-containing layers are preferably formed on the surfaces of both a light-sensitive layer and a back layer. A preferable slip property is 0.01 to 0.25 as a coefficient of kinetic friction. This represents a value obtained when a stainless steel sphere 5 mm in diameter is conveyed at a speed of 60 cm/min (25° C., 60% RH). In this evaluation, a value of nearly the same level is obtained when the surface of a light-sensitive layer is used as the sample to be measured.

Examples of the slip agent usable in the present invention are polyorganocyloxane, higher fatty acid amide, higher fatty acid metal salt, and esters of higher fatty acid and higher alcohol. As the polyorganocyloxane, it is possible to use polydimethylcyloxane, polydiethylcyloxane, polystyrylmethylcyloxane, and polymethylphenylcyloxane. Polydimethylcyloxane or ester having a long-chain alkyl group is particularly preferable. A layer to which the slip agent is added is preferably the outermost emulsion layer or the back layer.

The light-sensitive material of the present invention preferably contains a matting agent. The matting agent can be added to either the emulsion surface or the back surface and is most preferably added to the outermost emulsion layer. The matting agent can be either soluble or insoluble in processing solutions, and the use of both types of matting agents is preferable. Preferable examples are polymethylmethacrylate grains, poly(methylmethacrylate/methacrylic acid=9/1 or 5/5 (molar ratio)) grains, and polystyrene grains. The grain size is preferably 0.8 to 10 μm, and a narrow grain size distribution is preferable. It is preferable that 90% or more of all grains have grain sizes 0.9 to 1.1 times the average grain size. To increase the matting property, it is preferable to simultaneously add fine grains with a grain size of 0.8 μm or smaller. Examples are polymethylmethacrylate grains (0.2 μm), poly(methylmethacrylate/methacrylic acid=9/1 (molar ratio, 0.3 μm) grains, polystyrene grains (0.25 μm), and colloidal silica grains (0.03 μm).

A film magazine used in the present invention will be described below. The principal material of the cartridge used in the present invention can be a metal or synthetic plastic.

Preferable plastic materials are polystyrene, polyethylene, polypropylene, and polyphenylether. The cartridge of the present invention can also contain various antistatic agents. For this purpose, carbon black, metal oxide grains, nonion-, anion-, cation-, and betaine-surfactants, or a polymer can be preferably used. These cartridges subjected to the antistatic treatment are described in JP-A-1-312537 and JP-A-1-312538. It is particularly preferable that the resistance be $10^{12}$ Ω or less at 25° C. and 25% RH. Commonly, plastic cartridges are manufactured by using plastic into which carbon black or pigments are incorporated in order to give a light-shielding property. The cartridge size can be a presently available 135 size. To miniaturize cameras, it is effective to decrease the diameter of a 25-mm cartridge of 135 size to 22 mm or less. The volume of a cartridge case is 30 cm$^3$ or less, preferably 25 cm$^3$ or less. The weight of plastic used in the cartridge and the cartridge case is preferably 5 to 15 g.

Furthermore, a cartridge which feeds a film by rotating a spool can be used in the present invention. It is also possible to use a structure in which a film leader is housed in a cartridge main body and fed through a port of the cartridge to the outside by rotating a spool shaft in the film feed direction. These structures are disclosed in U.S. Pat. Nos. 4,834,306 and 5,226,613. Photographic films used in the present invention can be so-called raw films before being developed or developed photographic films. Also, raw and developed photographic films can be accommodated in the same new cartridge or in different cartridges.

The silver halide light-sensitive material of the present invention was developed for 25 to 90 sec by using the color developer of the present invention. As a consequence, high-sensitivity, high-quality images were obtained within a very short development time compared to a conventional development time exceeding 3 min.

The development time is preferably 35 to 75 sec, and more preferably 45 to 65 sec. The color developer used in the image formation method of the present invention will be described in detail below.

The color developer used in the image formation method of the present invention contains a silver halide solvent of the present invention. Preferable examples of the silver halide solvent used in the present invention are described previously.

A color developing agent used in the color developing solution of the present invention is a p-phenylenediamine derivative. Preferable typical examples of the p-phenylenediamine derivative are as follows.

(D-1) 2-methyl-4-(N-ethyl-N-(β-hydroxyethyl)amino) aniline (D-2) 2-methyl-4-(N-ethyl-N-(3-hydroxypropyl)amino) aniline (D-3) 2-methyl-4-(N-ethyl-N-(4-hydroxybutyl)amino) aniline (D-4) 2-methyl-N,N-diethyl-p-phenylenediamine (D-5) 2-methyl-4-(N-ethyl-N-(β-methanesulfonamidoethyl) amino)aniline (D-6) 2-methoxy-4-(N-ethyl-N-(β-hydroxyethyl)amino) aniline (D-7) 4-amino-3-methoxy-N,N-bis(3-hydroxypropyl) aniline (D-8) 4-amino-3-isopropioxy-N,N-bis(β-hydroxyethyl) aniline (D-9) 1-(β-hydroxyethyl)-5-amino-6-methyl-indoline (D-10) 1,2,3,4-tetrahydro-1-(3,4-dihydroxybutyl)-2,2,4,7-tetramethyl-6-amino-quinoline (D-11) 1,2,3,4-tetrahydro-1-(β-hydroxyethyl)-4-hydroxymethyl-6-amino-7-methyl-quinoline In the color development processing of the present invention, examples of the color developing agent are preferably N-hydroxy-substituted-alkyl-p-phenylenediamine derivatives, particularly D-1, D-2, D-3, D-6, D-7, and D-8, and most preferably D-1, D-2, and D-3.

The concentration of the developing agent of the present invention is preferably 25 to 80 mmols, more preferably 27 to 60 mmols, and most preferably 30 to 50 mmols per 1l of the color developer.

If the concentration is less than 25 mmols, sufficiently high processing speed cannot be obtained. If the concentration exceeds 80 mmols, the stability of the color developer significantly decreases. Consequently, variations in the photographic properties increase if processing is continuously performed. It is also possible to combine two or more different types of the developing agents described above within this range of the developing agent concentration.

The concentration of bromine ions in the color developing solution of the present invention is preferably 12 to 85 mmols, more preferably 14 to 45 mmols, and most preferably 16 to 30 mmols per 1 l of the color developer.

In addition to bromine ions, iodide ions or chlorine ions also can be added as halogen ions where necessary. The concentration of iodine ions is preferably 0.1 mmol/l or less because iodine ions very strongly inhibit development.

The quantity of replenisher of the color developing solution of the present invention is preferably 50 to 800 ml, and more preferably 100 to 300 ml per 1 m of the light-sensitive material. The bromide ion concentration in the replenisher solution is preferably 4 mmols/l or less, and most preferably 2 mmols/l or less. To achieve ultimate low replenishment, it is preferable that no bromine ions be contained.

The temperature of the color developing solution of the present invention is 40 to 60° C., preferably 42 to 55° C., and most preferably 43 to 50° C. The pH of the color developer of the present invention is 9.9 to 11.0, preferably 10.0 to 10.5.

The color developing solution of the present invention can contain a compound which directly preserves the developing agent. Examples are hydroxams described in JP-A-63-43138, hydrazines or hydrazides described in JP-A-63-146041, phenols described in JP-A-63-44657 and JP-A-63-58443, α-hydroxyketones and α-aminoketones described in JP-A-63-44656, and various sugars described in JP-A-63-36244. In addition to these compounds, it is also possible to use monoamines described in JP-A-63-4235, JP-A-63-24254, JP-A-63-21647, JP-A-63-146040, JP-A-63-27841, JP-A-63-25654, diamines described in JP-A-63-30845, JP-A-63-14640, and JP-A-63-43139, polyamines described in JP-A-63-21647, JP-A-63-26655, and JP-A-63-44655, nitroxy radicals described in JP-A-63-53551, alcohols described in JP-A-63-43140 and JP-A-63-53549, oximes described in JP-A-63-56654, and tertiary amines described in JP-A-63-239447.

The color developing solution of the present invention can also contain, as preservatives, various metals described in JP-A-57-44148 and JP-A-57-53749, salicylic acids described in JP-A-59-180588, alkanolamines described in JP-A-54-3582, polyethyleneimines described in JP-A-56-94349, and aromatic polyhydroxy compounds described in U.S. Pat. No. 3,746,544.

Particularly preferable preservatives are hydroxylamines represented by Formula (I) in JP-A-3-144446, particularly compounds having a sulfo group or a carboxy group. The most preferable examples are N,N-bis(sulfonateethyl) hydroxylamine and monosulfonateethylhydroxyamine.

In addition, various additives described in JP-A-3-144446 can be used in the color developing solution of the present invention. Examples of a buffering agent for holding pH are carbonic acids, boric acids, phosphoric acids, and hydroxybenzoic acids described in JP-A-3-144446, page 9, upper right column, line 6 to lower left column, line 1. Examples of a chelating agent are various aminopolycarboxylic acids, phosphonic acids, and sulfonic acids described on page 9, lower left column, line 2 to lower right column, line 18, preferably ethylenediaminetetraacetic acid, triethylenetetraminehexaacetic acid, 1,3-diaminopropanoltetraacetic acid, 1-hydroxyethylidene-1,1-diphosphonic acid, 4,5-dihydroxybenzene-1,3-disulfonic acid, diethylenetriaminepentaacetic acid, ethylenediamine-N,N,N',N'-tetrakis (methylenephosphonic acid), and catechol-3,5-disulfonic acid. Examples of a development accelerator are various additives described in JP-A-3-144446, page 9, lower left column, line 19 to page 10, upper right column, line 7. Examples of an antifoggant are halogenated ions and organic antifoggants described in JP-A-3-144446, page 10, upper right column, line 8 to lower left column, line 5. It is also possible to add various surfactants such as alkylsulfonic acid, arylsulfonic acid, aliphatic carboxylic acid, and aromatic carboxylic acid where necessary.

When processing is performed with an automatic processor by using the color developing solution of the present invention, an area (aperture area) in which the color developing solution contacts the air is preferably as small as possible. As an example, assuming the value obtained by dividing the aperture area (cm) by the volume (cm) of the developer is an aperture rate, this aperture rate is preferably 0.01 $cm^{-1}$ or less, and more preferably 0.005 $cm^{-1}$ or less.

The color developing solution can be regenerated and reused. To regenerate the color developer is. one may use an anion exchange resin, perform electrodialysis for a used color developing solution, or add a chemical called a regenerator to a used color developing solution, thereby raising the activity of the color developing solution and reusing the developer. The regeneration ratio (the ratio of an overflow solution in a replenisher solution) is preferably 50% or more, and most preferably 70% or more. In the processing using the regeneration of the color developing solution, the overflow solution of the color developing solution is regenerated and used as a replenisher solution.

As the method for regeneration of the color developing solution, the use of an anion exchange resin is preferable. Particularly preferable anion exchange resin compositions and resin regeneration methods are described in Diaion Manual (I) (1986, the 14th ed.) issued by Mitsubishi Kasei Corp. Among other anion exchange resins those having compositions described in JP-A-2-952 and JP-A-1-281152 are preferable.

Processing solutions in a color developer replenishment tank or other processing tanks are preferably shielded with a liquid agent such as a high-boiling-point organic solvent, thereby decreasing the contact area with air. This liquid shield agent is most preferably liquid paraffin. Also, it is particularly preferable that the liquid shield agent be used in the replenisher.

In the image formation method of the present invention, the light-sensitive material of the present invention is desilvered after being subjected to the color development of the present invention. Practical examples of the desilvering processing are as follows.

Bleaching-fixing

Bleaching-washing-fixing

Bleaching-bleach-fix

Bleaching-washing-bleach-fix

Bleaching-bleach-fix-fixing

Bleach-fix

Examples of a bleaching agent used in a processing solution having a bleaching power are an aminopolycarboxylic acid iron(III) complex, persulfate, bromate, hydrogen peroxide, and red prussiate of potash. Among bleaching agents the aminopolycarboxylic acid iron(III) complex can be most preferably used.

Ferric complex salt used in the present invention can be added and dissolved as a previously formed iron complex salt. Alternatively, a complex salt can be formed in a solution having a bleaching power in the presence of both a complex forming compound and ferric salt (e.g., ferric sulfate, ferric chloride, ferric bromide, iron(III) nitrate, and iron(III) sulfate ammonium).

The complex forming compound can be added in a larger amount than is necessary to form a complex with ferric ions. When an excess complex forming compound is added, the excess amount is preferably 0.01 to 10%.

In the present invention, examples of the compound for forming ferric complex salt in the solution having a bleaching power are ethylenediaminetetraacetic acid (EDTA), 1,3-propanediaminetetraacetic acid (1,3-PDTA), diethylenetriaminepentaacetic acid, 1,2-cyclohexanediaminetetraacetic acid, iminodiacetic acid, methyliminodiacetic acid, N-(2-acetamido)iminodiacetic acid, nitrilotriacetic acid, N-(2-carboxyethyl)iminodiacetic acid, N-(2-carboxymethyl) iminodipropionic acid, β-alaninediacetic acid, 1,4-diaminobutanetetraacetic acid, glycoletherdiaminetetraacetic acid, N-(2-carboxyphenyl) iminodiacetic acid, ethylenediamine-N-(2-carboxyphenyl)-N,N',N'-triacetic acid, ethylenediamine-N,N'-disuccinic acid, 1,3-diaminopropane-N,N'-disuccinic acid, ethylenediamine-N,N'-dimalonic acid, and 1,3-diaminopropane-N,N'-dimalonic acid. However, the compound is not particularly limited to these examples.

The concentration of the ferric complex salt in the processing solution having a bleaching power is suitably 0.005 to 1.0 mmol/l, preferably 0.01 to 0.50 mol/l, and more preferably 0.02 to 0.30 mol/l.

The concentration of the ferric complex salt in the replenisher solution of the processing solution having a bleaching power is preferably 0.005 to 2 mols/l and more preferably 0.01 to 1.0 mol/l.

Various compounds can be used as bleaching accelerators in baths having a bleaching power and their preceding baths. Examples are mercapto groups and compounds having a disulfide bond described in U.S. Pat. No. 3,893,858, German Patent 1,290,812, JP-A-53-95630, and Research Disclosure No. 17129 (July, 1978), thiourea compounds described in JP-B-45-8506, JP-A-52-20832 and JP-A-53-32735, and U.S. Pat. No. 3,706,561, and halides such as iodine and bromine ions. These compounds are preferable because they have a high bleaching capacity.

In addition, the baths having a bleaching power applicable to the present invention can contain a rehalogenating agent such as bromide (e.g., potassium bromide, sodium bromide, and ammonium bromide), chloride (e.g., potassium chloride, sodium chloride, and ammonium chloride), or iodide (e.g., ammonium iodide). It is possible, where necessary, to add one or more types of inorganic acids and organic acids having a pH buffering power, such as borax, sodium metaborate, acetic acid, sodium acetate, sodium carbonate, potassium carbonate, phosphorus acid, phosphoric acid, sodium phosphate, citric acid, sodium citrate, tartaric acid, malonic acid, succinic acid, and glutaric acid, alkali metals or ammonium salts of these acids, or a corrosion inhibitor such as ammonium nitrate or guanidine.

The baths having bleaching power can also contain various brightening agents, antifoaming agents, surfactants, polyvinylpyrrolidone, and organic solvents such as methanol.

The fixing agent components in the bleach-fixing solution and the fixing solution are well-known fixing agents, i.e., thiosulfate such as sodium thiosulfate and ammonium thiosulfate; thiocyanate such as sodium thiocyanate and ammonium thiocyanate; thioether compounds such as ethylenebisthioglycolic acid and 3,6-dithia-1,8-octanediol, and water-soluble silver halide solvents such as a meso-ionic compound and thioureas. It is possible to use a mixture of one or more types of these compounds. It is also possible to use a special bleach-fixing solution, described in JP-A-55-

155354, which consists of a combination of a fixing agent and a large amount of a halide such as potassium iodide. In the present invention, the use of thiosulfate, particularly ammonium thiosulfate and sodium thiosulfate is preferable. The amount of the fixing agent per 1 l is preferably 0.3 to 2 mols, and more preferably 0.5 to 1.0 mol.

It is desirable to make the bleach-fixing solution and the fixing solution contain the sulfite (or bisulfite or metabisulfite) described previously as a preservative. The content is preferably 0.08 to 0.4 mol/l, and more preferably 0.1 to 0.3 mol/l. By using this concentration range and the final bath of the present invention, not only the magnetic recording performance was greatly improved but also desirable results were obtained in the image stability.

The bleach-fixing solution and the fixing solution can contain, as preservatives, the above-mentioned sulfite ion release compounds such as sulfite (e.g., sodium sulfite, potassium sulfite, and ammonium sulfite), bisulfite (e.g., ammonium bisulfite, sodium bisulfite, and potassium bisulfite), metabisulfite (e.g., potassium metabisulfite, sodium metabisulfite, and ammonium metabisulfite). In addition to these compounds, the bleach-fixing solution and the fixing solution can be added with aldehydes (e.g., benzaldehyde and acetaldehyde), ketones (e.g., acetone), ascorbic acids, and hydroxylamines, where necessary.

Buffering agents, brightening agents, chelating agents, antifoaming agents, and mildewproofing agents can also be added to the bleaching solution, the bleach-fixing solution, and the fixing solution where necessary.

In the bleaching solution and the bleach-fixing solution used in the present invention, the pH range is preferably 4.5 to 6.2, and more preferably 5 to 6. The magnetic recording performance cannot be sufficiently achieved in some cases if the pH is too high or too low. The pH is desirably 5 to 8 in the fixing solution.

The quantity of replenisher of the bleaching solution, the bleach-fixing solution, and the fixing solution used in the present invention is preferably 50 to 2000 ml, and most preferably 100 to 1000 ml per 1 m of a light-sensitive material. It is also possible, where necessary, to replenish the washing water or the overflow solution in the stabilizing bath as a succeeding bath.

The processing temperature in the bleaching solution, the bleach-fixing solution, and the fixing solution is 20 to 50° C., preferably 30 to 45° C. The processing time is 10 sec to 3 min, preferably 20 sec to 2 min. To increase the processing speed, the processing time is most preferably 20 sec to 1 min 30 sec. The effect of the present invention is enhanced as the desilvering time is shortened.

It is particularly preferable to perform aeration of the processing solution having bleaching power during processing, since the photographic properties are extremely stably held. Any means well known to those skilled in the art can be used in the aeration. It is possible to blow air into the processing solution having bleaching power or absorb air by using an ejector.

In performing the air blowing, it is preferable to release air into a solution through an air diffusing pipe having fine pores. Such air diffusing pipes are widely used in air exposure tanks in active sludge processing. As the aerator, it is possible to use items described in Z-121, Using Process C-41, the 3rd ed. (1982), pages BL-1 to BL-2, issued by Eastman Kodak Co. In the processing using the processing solutions having bleaching power according to the present invention, stirring is preferably strengthened. To strengthen stirring, the contents described in JP-A-3-33847, page 8, upper light column, line 6 to lower left column, line 2 can be directly used.

In the desilvering step, stirring is preferably made as strong as possible. Examples of the method of strengthening stirring are a method described in JP-A-62-183460 by which a jet stream of the processing solution is collided against the emulsion surface of the light-sensitive material, a method described in JP-A-62-183461 by which the stirring effect is enhanced by using a rotating means, a method in which the stirring effect is improved by moving the light-sensitive material while the emulsion surface is in contact with a wiper blade provided in the solution and thereby causing disturbance on the emulsion surface, and a method of increasing the circulating flow amount in the overall processing solution. These stirring improving means are effective in any of the bleaching solution, the bleach-fixing solution, and the fixing solution. It is considered that the improvement in stirring increases the speed of supply of the bleaching agent and the fixing agent into the emulsion film, and this consequently increases the desilvering speed. The above stirring improving means are particularly effective when the bleaching accelerator is used. That is, it is possible to greatly increase the effect of acceleration or eliminate the action of inhibiting fixation.

A washing step is commonly performed after the processing steps using the fixing solution and/or the bleach-fixing solution. After the processing using the processing solutions having bleaching power, it is also possible to perform a simple processing method in which stabilization using a stabilizer is performed essentially without performing washing.

The washing water used in the washing step and the stabilizer used in the stabilization step can contain various surfactants to prevent water stains formed when the light-sensitive material is dried after the processing. The use of a nonionic surfactant is preferable, and an alkylphenolethyleneoxide adduct is particularly preferable. Octyl, nonyl, dodecyl, and dinonylphenol are preferable examples of the alkylphenyl, and the number of addition mols of ethyleneoxide is particularly preferably 8 to 14. The use of a silicone-based surfactant having a high anti-foaming effect is also preferable.

The washing water and the stabilizer can also contain various anti-bacteria agents and mildewproofing agents in order to prevent water dirt or mildew in the processed light-sensitive material. It is also preferable that the washing water and the stabilizer contain various chelating agents. Examples of the chelating agents are aminopolycarboxylic acid such as ethylenediaminetetraacetic acid and diethylenetriaminepentaacetic acid, organic phosphonic acid such as 1-hydroxyethylidene-1,1-diphosphonic acid and diethylenetriamine-N,N,N'N'-tetramethylenephosphonic acid, and a hydrolytic product of an anhydrous maleic acid polymer described in European Patent 345172A1. It is also preferable that the washing water and the stabilizing solution contain the preservatives which can be contained in the fixing solution and the bleach-fixing solution described above.

As the stabilizer used in the stabilization step, it is possible to use a processing solution which stabilizes a dye image, e.g., an organic acid, a solution having a buffering power of pH 3 to 6, or a solution containing aldehyde (e.g., formalin and glutaraldehyde). The stabilizer can contain all compounds which can be added to the washing water. In addition, ammonium compounds such as ammonium chloride and ammonium sulfite, metal compounds of Bi and Al, brightening agents, film hardeners, and alkanolamine described in U.S. Pat. No. 4,786,583 also can be used.

In the present invention, the stabilizer does not essentially contain formaldehyde as a dye image stabilizing agent. "Not essentially containing formaldehyde" means that the total of free formaldehyde and its hydrate is 0.003 mol or less per 1 l of the stabilizer.

By using such a stabilizer it is possible to suppress scattering of formaldehyde vapor during the processing. To stabilize magenta dyes, it is preferable that a formaldehyde substitute compound be present in the stabilizer, or the bleaching solution or its preceding bath (e.g., a control bath).

Compounds preferable as the formaldehyde substitute compound are hexamethylenetetramine and its derivative, a formaldehyde bisulfite adduct, an N-methylol compound, and an azolylmethylamine compound. In addition to stabilizing magenta dyes, these preferable compounds prevent yellow stains from taking place with time.

As hexamethylenetetramine and its derivative, compounds described in "Beilsteins Handbuch der Organishen Chemie", enlarged edition II, Vol. 26, pp. 200 to 212 can be used. Hexamethylenetetramine is particularly preferable.

As the formaldehyde bisulfite adduct, sodium formaldehydebisulfite is preferable.

Preferable examples of the N-methylol compound are N-methylol compounds of pyrazole and its derivative, N-methylol compounds of triazole and its derivative, and N-methylol compounds of urazol and its derivative.

Specific examples of these N-methylol compounds are 1-hydroxymethylpyrazole, 1-hydroxymethyl-2-methylpyrazole, 1-hydroxymethyl-2,4-dimethylpyrazole, 1-hydroxymethyl-1,2,4-triazole, and 1-hydroxymethylurazol. 1-hydroxymethylpyrazole and 1-hydroxymethyl-1,2,4-triazole are particularly preferable among other compounds.

The above N-methylol compound can be easily synthesized by reacting an amine compound having no methylol group with formaldehyde or paraformaldehyde.

When the above N-methylol compound is to be used, an amine compound having no methylol group is preferably present in the processing solution. The molar concentration of this amine compound is preferably 0.2 to 10 times that of the N-methylol compound.

Examples of the azolylmethylamine compound are 1,4-bis(1,2,4-triazole-1-ylmethyl) piperazine and 1,4-bis (pyrazole-1-ylmethyl)piperazine. It is particularly preferable to simultaneously use azole such as 1,2,4-triazole or pyrazole (described in JP-A-4-359249), since this increases the image stability and decreases the formaldehyde vapor pressure.

The addition amount of the formaldehyde substitute compound is 0.003 to 0.2 mol, preferably 0.005 to 0.05 mol per 1 l of the processing solution.

It is also possible to use two or more different types of these formaldehyde substitute compounds in the bath.

The pH of the stabilizer is preferably 3 to 9, and more preferably 4 to 7.

The washing step and the stabilization step are preferably done by a multistage countercurrent method, and the number of stages is preferably 2 to 4. The quantity of replenisher per unit area is 1 to 50 times, preferably 1 to 30 times, and more preferably 1 to 10 times as large as the amount carried over from the preceding bath.

As the washing and stabilization steps carried out in the present invention, it is possible to preferably perform the process described in JP-A-3-33847, page 11, lower right column, line 9 to page 12, upper right column, line 19.

Tap water can be used in the washing step and the stabilization step. However, it is preferable to use water deionized to have Ca and Mg ion concentrations of 5 mg/l or less by using an ion exchange resin, or water sterilized by a halogen or ultraviolet germicidal lamp.

It preferable to flow the overflow solution from the washing step or the stabilization step to the bath having fixing power as the preceding bath, in order to reduce the amount of effluent.

In the processing of the present invention, it is preferable to replenish a proper amount of water, a compensating solution, or a processing replenisher in order to compensate for the thickening caused by evaporation. A practical method of water replenishment is not particularly restricted. Among other methods it is particularly preferable to use methods described in JP-A-1-254959 and JP-A-1-254960 in which a monitor water tank is prepared in addition to a bleaching tank, the evaporation amount of water in this monitor water tank is obtained, the evaporation amount of water in the bleaching tank is calculated from this water evaporation amount, and water is replenished to the bleaching tank in proportion to the calculated evaporation amount, and evaporation compensation methods described in JP-A-3-248155, JP-A-3-249644, JP-A-3-249645, JP-A-3-248646, and JP-A-4-14042 in which a liquid level sensor or an overflow sensor is used. Tap water can be used as the water for compensating for the evaporation of each processing solution. However, the use of deionized water or sterilized water preferably used in the washing step is preferable.

An automatic processor used in the processing of the present invention preferably has light-sensitive material conveying means described in JP-A-60-191257, JP-A-60-191258, and JP-A-60-191259. As described in JP-A-60-191257, conveying means of this sort can greatly decrease the amount of a processing solution carried over from a preceding bath to a succeeding bath and thereby highly effectively prevent deterioration in the performance of the processing solution. This effect is particularly useful to shorten the processing time or reduce the quantity of replenisher of the processing solution in each processing step.

The supply form of a processing agent used in the present invention can be any of a liquid having the concentration of a use solution, a concentrated liquid, a granule, a powder, a pellet, a paste, and an emulsion. Examples of the processing agent are a liquid contained in a low-oxygen-permeability vessel disclosed in JP-A-63-17453, vacuum-packaged powders or granules disclosed in JP-A-4-19655 and JP-A-4-230748, granules containing a water-soluble polymer disclosed in JP-A-4-221951, pellets disclosed in JP-A-51-61837 and JP-A-6-102628, and a paste processing agent disclosed in PCT national Publication No. 57-500485. Any of these forms can be preferably used. However, in respect of simplicity in use, the use of a liquid already prepared to have a concentration in use is preferable.

The material of vessels containing these processing agents can be any of polyethylene, polypropylene, polyvinylchloride, polyethyleneterephthalate, and nylon. These materials can be used singly or in the form of a composite material. The materials are so selected as to meet the level of a necessary oxygen permeability. Low-oxygen-permeability materials are suited to a solution such as a color developing solution which is readily oxidized. Practical examples are polyethyleneterephthalate and a composite material of polyethylene and nylon. The thickness of a vessel made from any of these materials is 500 to 1500 $\mu$m. The oxygen permeability is preferably 20 ml/m·24 hrs·atm.

EXAMPLES

The present invention will be described in more detail below by way of the following examples. However, the present invention is not limited to these examples as long as the invention does not depart from the gist of the invention.

Example 1

1) Support

A support used in this example was formed as follows.

100 parts by weight of a polyethylene-2,6-naphthalate polymer and 2 parts by weight of Tinuvin P.326 (manufactured by Ciba-Geigy Co.) as an ultraviolet absorbent were dried, melted at 300° C., and extruded from a T-die. The resultant material was longitudinally oriented by 3.3 times at 140° C., laterally oriented by 3.3 times at 130° C., and thermally fixed at 250° C. for 6 sec. The result was a 90-μm thick PEN film. Note that amounts of blue, magenta, and yellow dyes (I-1, I-4, I-6, I-24, I-26, I-27, and II-5 described in Journal of Technical Disclosure No. 94-6023) were added to this PEN film. The PEN film was wound around a stainless steel core 20 cm in diameter and given a thermal history of 110° C. and 48 hours, manufacturing a support with a high resistance to curling.

2) Coating of Undercoat Layer

The two surfaces of the support were subjected to corona discharge, UV discharge, and glow discharge and coated with an undercoat solution (10 cc/$m^2$, by using a bar coater) consisting of 0.1 g/$m^2$ of gelatin, 0.01 g/$m^{22}$ of sodiumasulfodi-2-ethylhexylsuccinate, 0.04 g/$m^2$ of salicylic acid, 0.2 g/$m^2$ of p-chlorophenol, 0.012 g/$m^2$ of $(CH_2{=}CHSO_2CH_2CH_2NHCO)_2CH_2$, and 0.02 g/$m^2$ of a polyamido-epichlorohydrin polycondensate, forming undercoat layers on sides at a high temperature upon orientation. Drying was performed at 115° C. for 6 min (all rollers and conveyors in the drying zone were at 115° C.).

3) Coating of Back Layers

On one surface of the undercoated support, an antistatic layer, a magnetic recording layer, and a slip layer having the following compositions were coated as back layers.

3-1) Coating of Antistatic Layer 0.2 g/$m^2$ of a dispersion (secondary aggregation grain size=about 0.08 μm) of a fine-grain powder, having a specific resistance of 5 Ω·cm, of a tin oxide-antimony oxide composite material with an average grain size of 0.005 μm was coated together with 0.05 g/$m^2$ of gelatin, 0.02 g/$m^2$ of $(CH_2{=}CHSO_2CH_2CH_2NHCO)_2CH_2$, 0.005 g/$m^2$ of polyoxyethylene-p-nonylphenol (polymerization degree 10), and resorcin.

3-2) Coating of magnetic recording layer 0.06 g/$m^2$ of cobalt-γ-iron oxide (specific area 43 $m^2$/g, major axis 0.14 μm, minor axis 0.03 μm, saturation magnetization 89 emu/g, $Fe^{+2}/Fe^{+3}$=6/94, the surface was treated with 2 wt % of iron oxide by aluminum oxide silicon oxide) coated with 3-polyoxyethylene-propyloxytrimethoxysilane (polymerization degree 15, 15 wt %) was coated by a bar coater together with 1.2 g/$m^2$ of diacetylcellulose (iron oxide was dispersed by an open kneader and a sand mill) by using 0.3 g/$m^2$ of $C_2H_5C(CH_2OCONH\text{-}C_6H_3(CH_3)NCO)_3$ as a hardener and acetone, methylethylketone, and cyclohexane as solvents, forming a 1.2-μm thick magnetic recording layer. 10 mg/$m^2$ of silica grains (0.3 μm) were added as a matting agent, and 10 mg/$m^2$ of aluminum oxide (0.15 μm) coated with 3-polyoxyethylene-propyloxytrimethoxysilane (polymerization degree 15, 15 wt %) were added as a polishing agent. Drying was performed at 115° C. for 6 min (all rollers and conveyors in the drying zone were at 115° C.). The color density increase of DB of the magnetic recording layer measured by an X-light (blue filter) was about 0.1. The saturation magnetization moment, coercive force, and squareness ratio of the magnetic recording layer were 4.2 emu/g, 7.3×104 A/m, and 65%, respectively.

3-3) Preparation of Slip Layer

Diacetylcellulose (25 mg/$m^2$) and a mixture of $C_6H_{13}CH(OH)C_{10}H_{20}COOC_{40}H_{81}$ (compound a, 6 mg/$m^2$)/$C_{50}H_{101}O(CH_2CH_2O)_{16}H$ (compound b, 9 mg/$m^2$ were coated. Note that this mixture was melted in xylene/propylenemonomethylether (1/1) at 105° C., dispersed in propylenemonomethylether (tenfold amount), and formed into a dispersion (average grain size 0.01 μm) in acetone before being added. 15 mg/$m^2$ of silica grains (0.3 μm) were added as a matting agent, and 15 mg/$m^2$ of 3-polyoxyethylene-propyloxytrimethoxysiliane (polymerization degree 15, aluminum oxide coated by 15 wt %, 0.15 μm) were added as a polishing agent. Drying was performed at 115° C. for 6 min (all rollers and conveyors in the drying zone were at 115° C.). The resultant slip layer was found to have excellent characteristics. That is, the coefficient of kinetic friction was 0.06 (5 mmϕ stainless steel hard sphere, load 100 g, speed 6 cm/min), and the coefficient of static friction was 0.07 (clip method). The coefficient of kinetic friction between an emulsion surface (to be described later) and the slip layer also was excellent, 0.12.

4) Coating of Light-Sensitive Layers

On the side away from the back layers formed as above, a plurality of layers having the following compositions were coated to manufacture sample 101 as a multilayered color light-sensitive material. (Compositions of light-sensitive layers)

The main materials used in the individual layers were classified as follows.

ExC: Cyan coupler
ExM: Magenta coupler
ExY: Yellow coupler
ExS: Sensitizing dye
UV: Ultraviolet absorbent
HBS: High-boiling organic solvent
H: Gelatin hardener The number corresponding to each component indicates the coating amount in units of g/$m^2$. The coating amount of a silver halide is represented by the amount of silver. The coating amount of each sensitizing dye is represented in units of mols per mol of a silver halide in the same layer.

| (Sample 101) | | |
|---|---|---|
| 1st layer (Antihalation layer) | | |
| Black colloidal silver | silver | 0.09 |
| Gelatin | | 1.60 |
| ExM-1 | | 0.12 |
| ExF-1 | | $2.0 \times 10^{-3}$ |
| Solid dispersion dye ExF-2 | | 0.030 |
| Solid dispersion dye ExF-3 | | 0.040 |
| HBS-1 | | 0.15 |
| HBS-2 | | 0.02 |
| 2nd layer (Interlayer) | | |
| Silver iodobromide emulsion (AgI 1.0 mol %, uniform structure octahedral grain) | silver | 0.065 |
| ExC-2 | | 0.04 |
| Polyethylacrylate latex | | 0.20 |
| Gelatin | | 1.04 |
| 3rd layer (Low-speed red-sensitive emulsion layer) | | |
| Silver iodobromide emulsion (AgI 1.6 mol %, uniform structure tabular grain) | silver | 0.22 |
| Silver iodobromide emulsion (AgI 3.5 mol %, triple structure tabular grain) | silver | 0.22 |
| ExS-1 | | $6.0 \times 10^{-5}$ |
| ExS-2 | | $1.6 \times 10^{-5}$ |
| ExS-3 | | $2.7 \times 10^{-4}$ |
| ExC-1 | | 0.15 |

-continued (Sample 101)

| | | |
|---|---|---|
| ExC-3 | | 0.030 |
| ExC-4 | | 0.08 |
| ExC-5 | | 0.020 |
| ExC-6 | | 0.012 |
| Cpd-2 | | 0.025 |
| HBS-1 | | 0.10 |
| Gelatin | | 0.85 |
| 4th layer (Medium-speed red-sensitive emulsion layer) | | |
| Silver iodobromide emulsion (1) | silver | 1.26 |
| ExS-1 | | $4.0 \times 10^{-4}$ |
| ExS-2 | | $3.2 \times 10^{-5}$ |
| ExS-3 | | $6.5 \times 10^{-4}$ |
| ExC-1 | | 0.12 |
| ExC-2 | | 0.060 |
| ExC-3 | | 0.0070 |
| ExC-4 | | 0.088 |
| ExC-5 | | 0.015 |
| ExC-6 | | 0.0080 |
| Cpd-2 | | 0.023 |
| HBS-1 | | 0.10 |
| Gelatin | | 0.76 |
| 5th layer (High-speed red-sensitive emulsion layer) | | |
| Silver iodobromide emulsion (AgI 8.9 mol %, triple structure tabular grain) | silver | 1.40 |
| ExS-1 | | $2.4 \times 10^{-4}$ |
| ExS-2 | | $1.0 \times 10^{-4}$ |
| ExS-3 | | $3.4 \times 10^{-4}$ |
| ExC-1 | | 0.10 |
| ExC-3 | | 0.045 |
| ExC-6 | | 0.020 |
| ExC-7 | | 0.010 |
| Cpd-2 | | 0.050 |
| HBS-1 | | 0.22 |
| HBS-2 | | 0.050 |
| Gelatin | | 1.10 |
| 6th layer (Interlayer) | | |
| Cpd-1 | | 0.090 |
| Solid dispersion dye ExF-4 | | 0.030 |
| HBS-1 | | 0.050 |
| Polyethylacrylate latex | | 0.15 |
| Gelatin | | 1.10 |
| 7th layer (Low-speed green-sensitive emulsion layer) | | |
| Silver iodobromide emulsion (AgI 1.7 mol %, uniform structure tabular grain) | silver | 0.15 |
| Silver iodobromide emulsion (AgI 3.5 mol %, triple structure tabular grain) | silver | 0.10 |
| Silver iodobromide emulsion (AgI 8.8 mol %, triple structure tabular grain) | silver | 0.10 |
| ExS-4 | | $3.0 \times 10^{-5}$ |
| ExS-5 | | $2.1 \times 10^{-4}$ |
| ExS-6 | | $8.0 \times 10^{-4}$ |
| ExM-2 | | 0.33 |
| ExM-3 | | 0.086 |
| ExY-1 | | 0.015 |
| HBS-1 | | 0.30 |
| HBS-3 | | 0.010 |
| Gelatin | | 0.73 |
| 8th layer (Medium-speed green-sensitive emulsion layer) | | |
| Silver iodobromide emulsion (AgI 8.8 mol %, triple structure tabular grain) | silver | 0.80 |
| ExS-4 | | $3.2 \times 10^{-5}$ |
| ExS-5 | | $2.2 \times 10^{-4}$ |
| ExS-6 | | $8.4 \times 10^{-4}$ |
| ExC-8 | | 0.010 |
| ExM-2 | | 0.10 |
| ExM-3 | | 0.025 |
| ExY-1 | | 0.018 |
| ExY-4 | | 0.010 |

-continued (Sample 101)

| | | |
|---|---|---|
| ExY-5 | | 0.040 |
| HBS-1 | | 0.13 |
| HBS-3 | | $4.0 \times 10^{-3}$ |
| Gelatin | | 0.80 |
| 9th layer (High-speed green-sensitive emulsion layer) | | |
| Silver iodobromide emulsion (AgI 8.9 mol %, triple structure tabular grain) | silver | 1.25 |
| ExS-4 | | $3.7 \times 10^{-5}$ |
| ExS-5 | | $8.1 \times 10^{-5}$ |
| ExS-6 | | $3.2 \times 10^{-4}$ |
| ExC-1 | | 0.010 |
| ExM-1 | | 0.020 |
| ExM-4 | | 0.025 |
| ExM-5 | | 0.040 |
| Cpd-3 | | 0.040 |
| HBS-1 | | 0.25 |
| Polyethylacrylate latex | | 0.15 |
| Gelatin | | 1.33 |
| 10th layer (Yellow filter layer) | | |
| Yellow colloidal silver | silver | 0.015 |
| Cpd-1 | | 0.16 |
| Solid dispersion dye ExF-5 | | 0.060 |
| Solid dispersion dye ExF-6 | | 0.060 |
| Oil-soluble dye ExF-7 | | 0.010 |
| HBS-1 | | 0.60 |
| Gelatin | | 0.60 |
| 11th layer (Low-speed blue-sensitive emulsion layer) | | |
| Silver iodobromide emulsion (AgI 1.7 mol %, uniform structure tabular grain) | silver | 0.09 |
| Silver iodobromide emulsion (AgI 8.8 mol %, triple structure tabular grain) | silver | 0.09 |
| ExS-7 | | $8.6 \times 10^{-4}$ |
| ExC-8 | | $7.0 \times 10^{-3}$ |
| ExY-1 | | 0.050 |
| ExY-2 | | 0.22 |
| ExY-3 | | 0.50 |
| ExY-4 | | 0.020 |
| Cpd-2 | | 0.10 |
| Cpd-3 | | $4.0 \times 10^{-3}$ |
| HBS-1 | | 0.28 |
| Gelatin | | 1.20 |
| 12th layer (High-speed blue-sensitive emulsion layer) | | |
| Silver iodobromide emulsion (AgI 14.0 mol %, double structure tabular grain) | silver | 1.00 |
| ExS-7 | | $4.0 \times 10^{-4}$ |
| ExY-2 | | 0.10 |
| ExY-3 | | 0.10 |
| ExY-4 | | 0.010 |
| Cpd-2 | | 0.10 |
| Cpd-3 | | $1.0 \times 10^{-3}$ |
| HBS-1 | | 0.070 |
| Gelatin | | 0.70 |
| 13th layer (1st protective layer) | | |
| UV-1 | | 0.19 |
| UV-2 | | 0.075 |
| UV-3 | | 0.065 |
| HBS-1 | | $5.0 \times 10^{-2}$ |
| HBS-4 | | $5.0 \times 10^{-2}$ |
| Gelatin | | 1.8 |
| 14th (2nd protective layer) | | |
| Silver iodobromide emulsion (AgI 1.0 mol %, uniform structure octahedral grain) | silver | 0.10 |
| H-1 | | 0.40 |
| B-1 (diameter 1.7 $\mu$m) | | $5.0 \times 10^{-2}$ |
| B-2 (diameter 1.7 $\mu$m) | | 0.15 |
| B-3 | | 0.05 |

-continued

| (Sample 101) | |
|---|---|
| S-1 | 0.20 |
| Gelatin | 0.70 |

In addition to the above components, to improve storage stability, processability, resistance to pressure, antiseptic and mildewproofing properties, antistatic properties, and coating properties, the individual layers contained W-1 to W-3, B-4 to B-6, F-1 to F-17, iron salt, lead salt, gold salt, platinum salt, iridium salt, and rhodium salt. Preparation of dispersion of organic solid dispersion dye ExF-2 was dispersed by the following method. 21.7 ml of water, 3 ml of p-octylphenoxyethoxyethanesulfonic acid soda, and 0.5 g of a 5% aqueous solution of p-octylphenoxypolyoxyethyleneether (polymerization degree 10) were placed in a 700-ml pot mill, and 5.0 g of dye ExF-2 and 500 ml of zirconium oxide beads (diameter 1 mm) were added to the mill. The contents were dispersed for 2 hours by using a BO type oscillating ball mill manufactured by Chuo Koki K.K. The dispersion was removed from the mill and added to 8 g of a 12.5% aqueous gelatin solution. The beads were removed from the resultant material by filtration, obtaining a gelatin dispersion of the dye. The average grain size of the fine dye grains was 0.44 μm.

Following the same procedure as above, solid dispersions ExF-3, ExF-4, and ExF-6 were obtained. The average grain sizes of these fine dye grains were 0.24, 0.45, and 0.52 μm, respectively. ExF-5 was dispersed by a microprecipitation dispersion method described in Example 1 of European Patent 549,489A. The average grain size was found to be 0.06 μm.

The compounds used in the formation of the above layers are as follows.

ExC-1

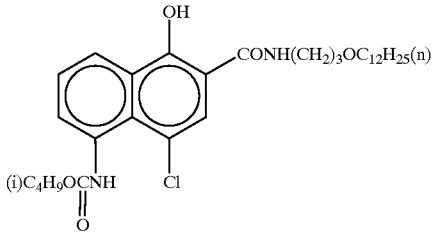

ExC-2

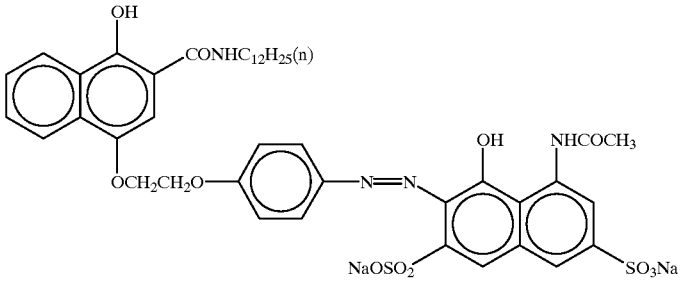

ExC-3

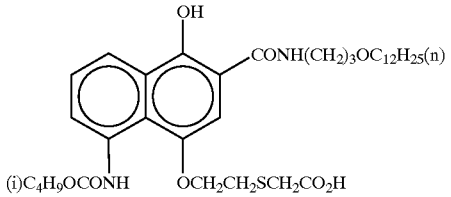

ExC-4

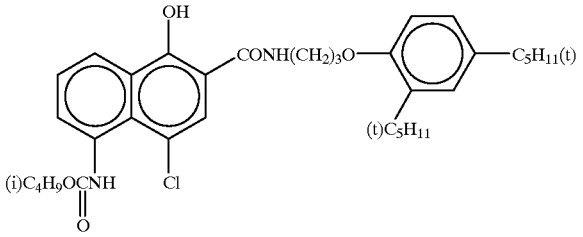

-continued
ExC-5
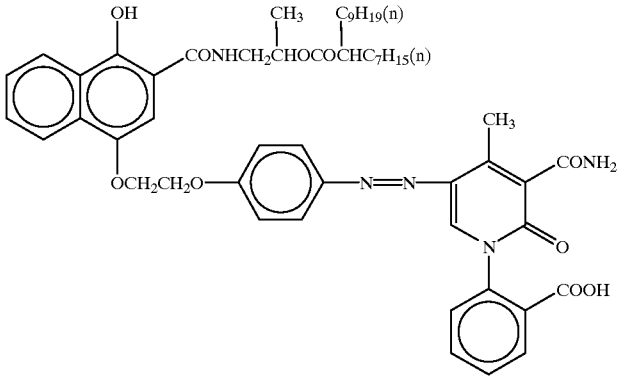
ExC-6
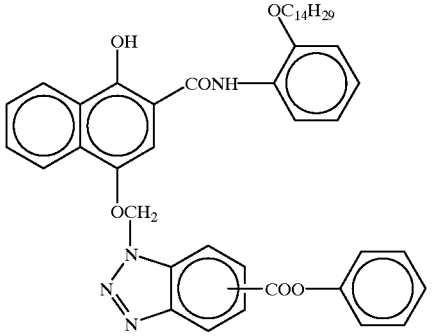
ExC-7
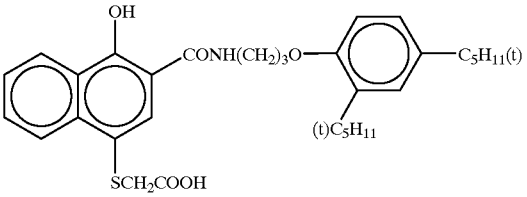
ExC-8
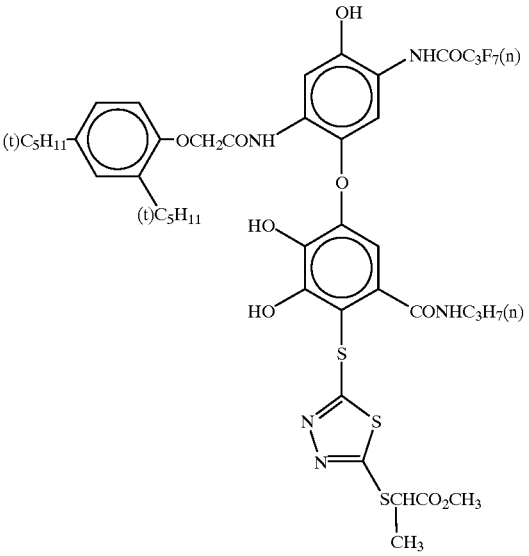

-continued
ExM-1
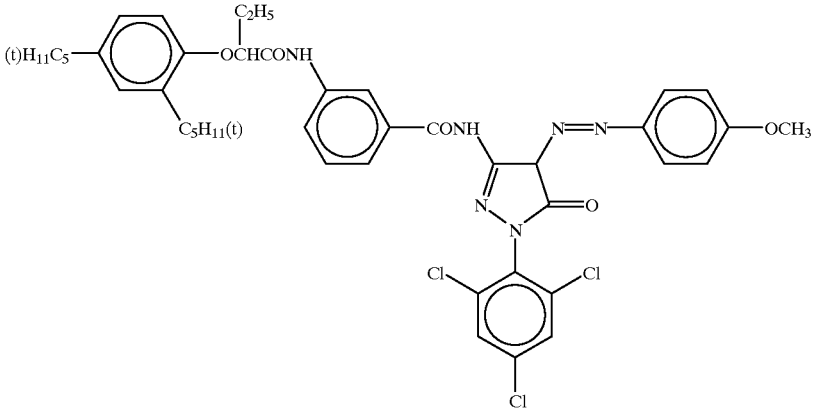
ExM-2
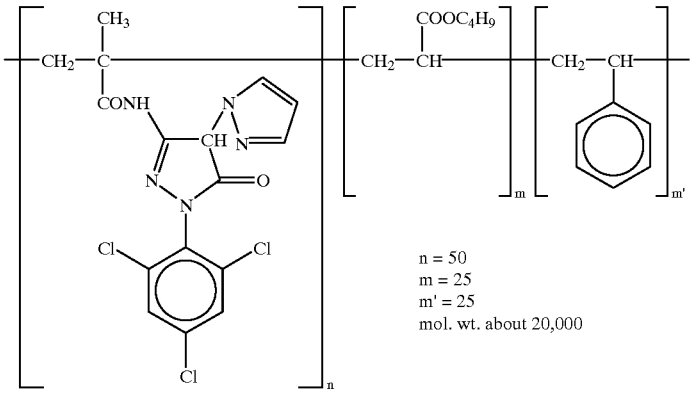
n = 50
m = 25
m' = 25
mol. wt. about 20,000
ExM-3
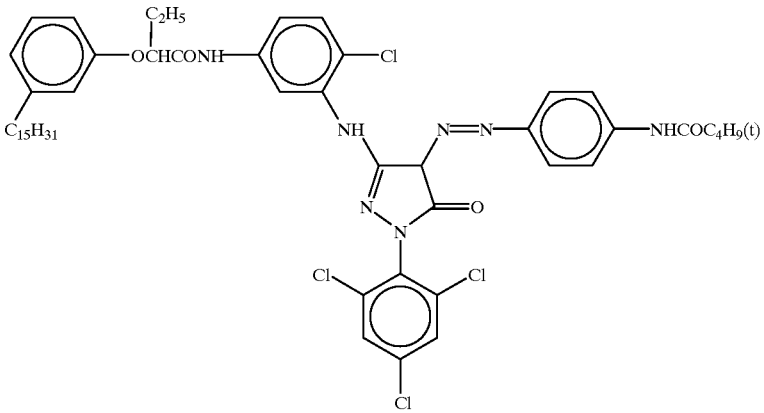
ExM-4
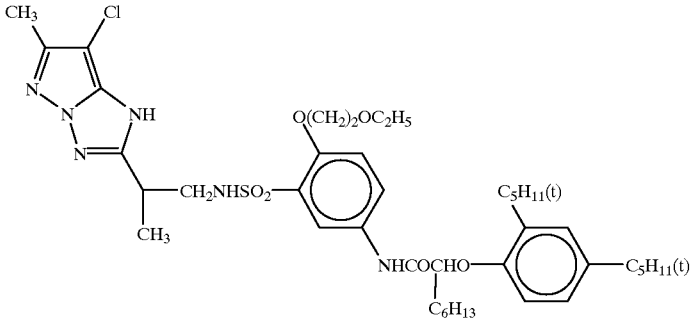

-continued
ExM-5
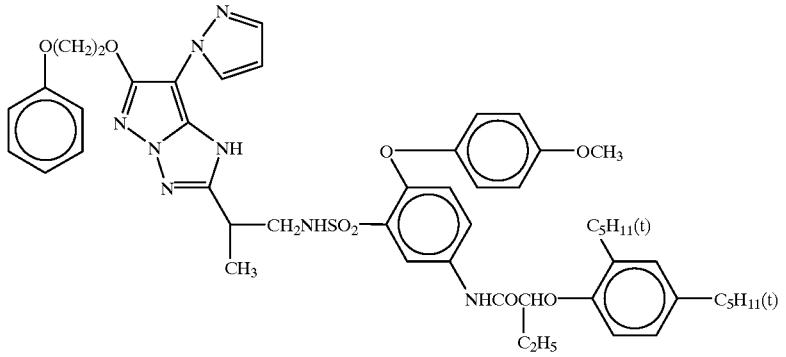
ExY-1
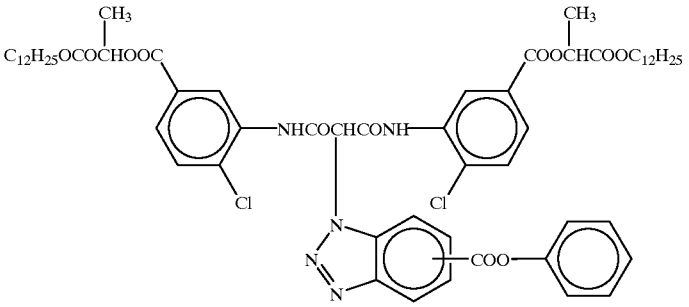
ExY-2
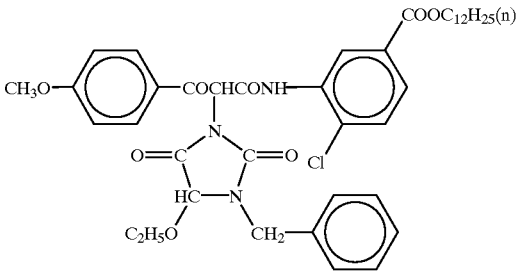
ExY-3
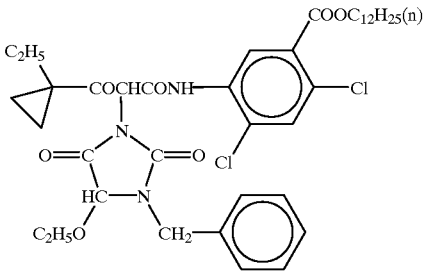
ExY-4
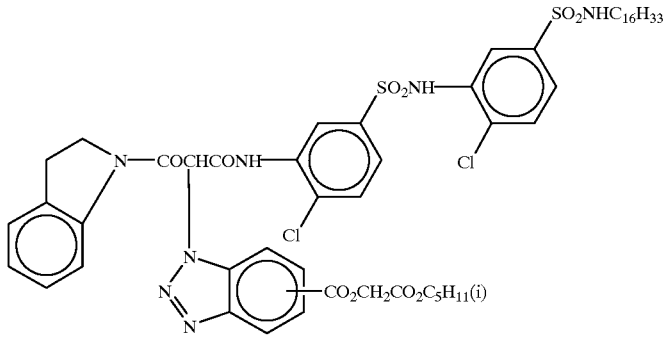

-continued
ExY-5
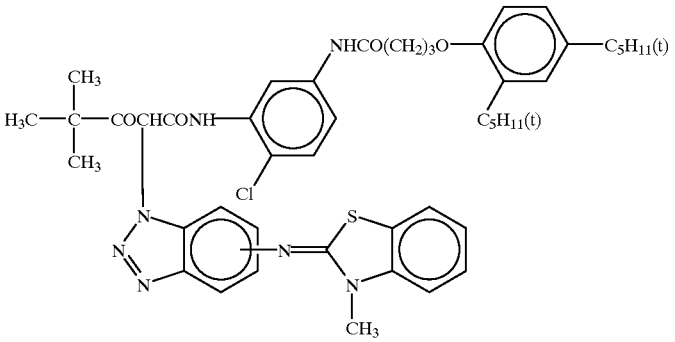
ExF-1
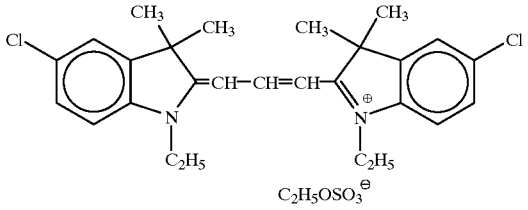
ExF-2
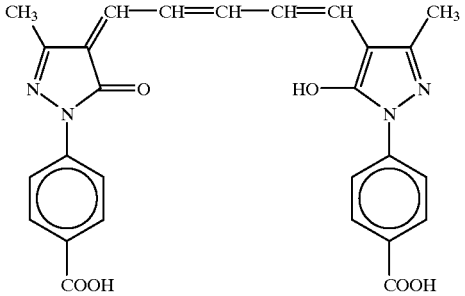
ExF-3
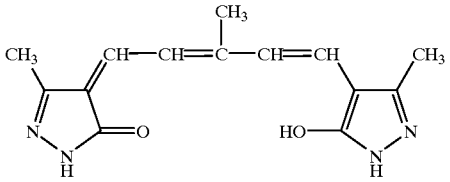
ExF-4
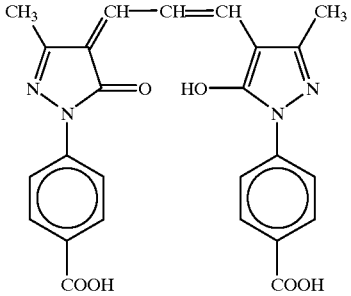
ExF-5
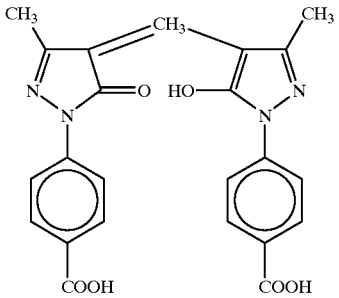
ExF-6
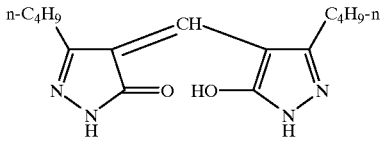
ExF-7
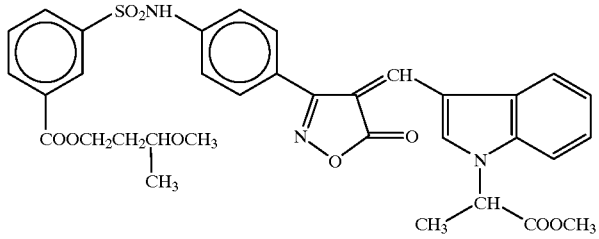

-continued
Cpd-1
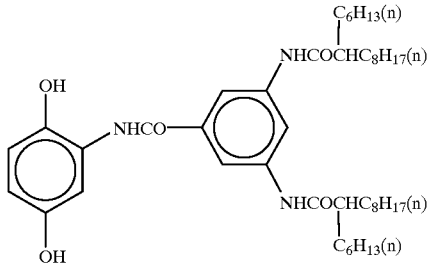
Cpd-2
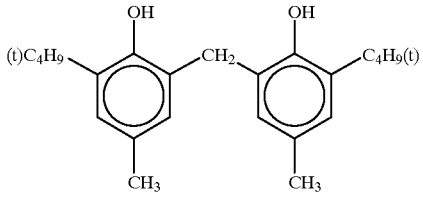
Cpd-3
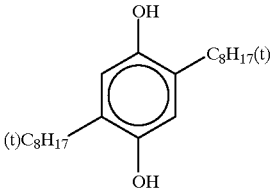
UV-1
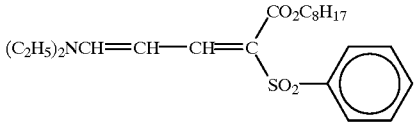
UV-2
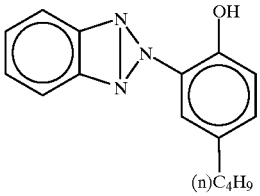
UV-3
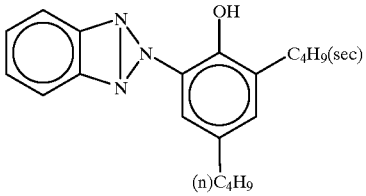
HBS-1
tricresylphosphate
HBS-2
di-n-butylphthalate
HBS-3
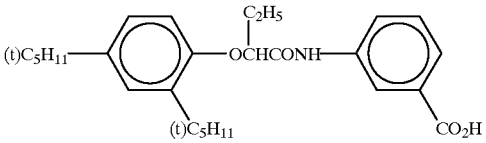
HBS-4
tri(2-ethylhexyl)phosphate
ExS-1
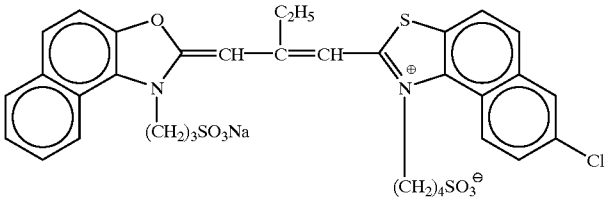
ExS-2
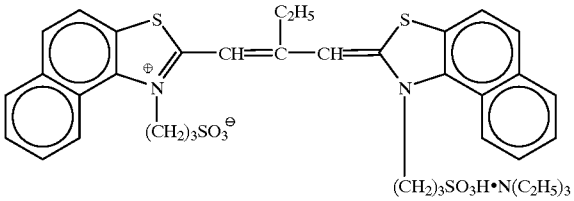
ExS-3
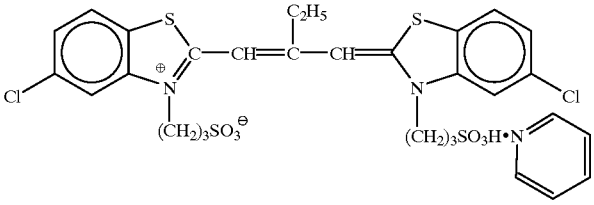

-continued
ExS-4
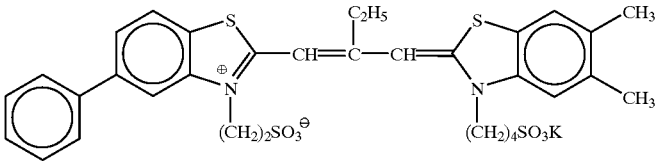
ExS-5
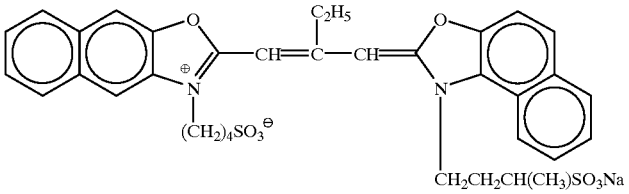
ExS-6
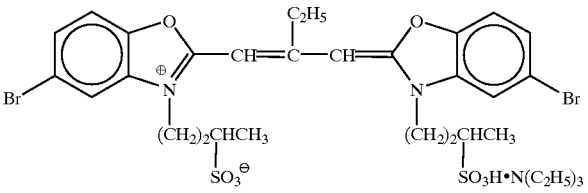
ExS-7
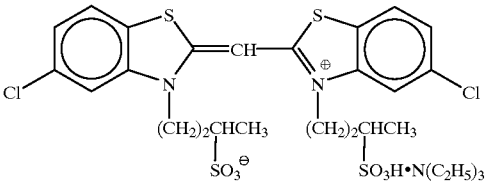
S-1
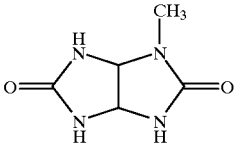
H-1
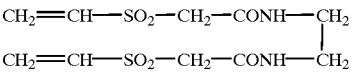
B-1
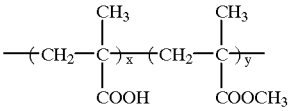
x/y = 10/90 (weight ratio)
average molecular weight
about 35,000
B-2
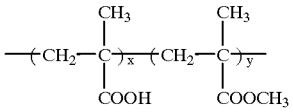
x/y = 40/60 (weight ratio)
average molecular weight
:about 20,000
B-3
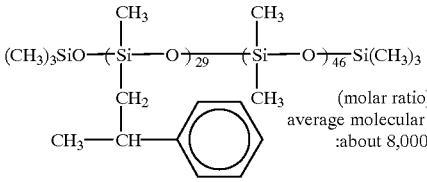
(molar ratio)
average molecular weight
:about 8,000
B-4
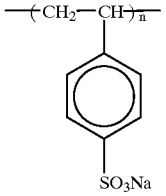
average molecular weight
:about 750,000
B-5
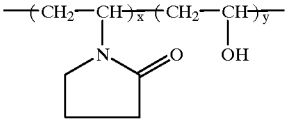
x/y = 70/30 (weight ratio)
average molecular weight
:about 17,000
B-6
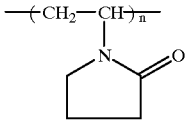
average molecular weight
:about 10,000
W-1
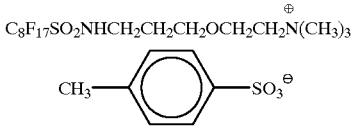

-continued
W-2
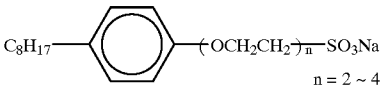
W-3
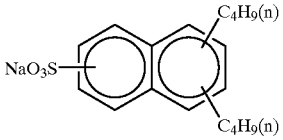
F-1
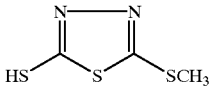
F-2
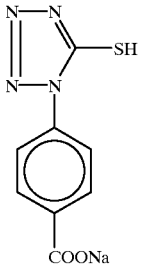
F-3
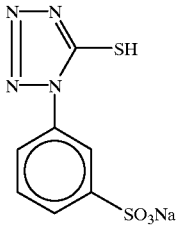
F-4
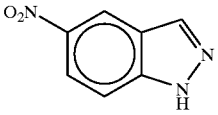
F-5
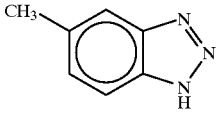
F-6
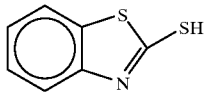
F-7
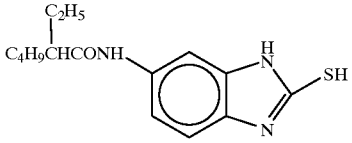
F-8
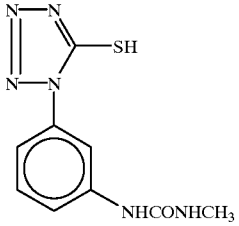
F-9
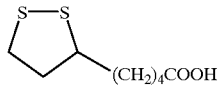
F-10
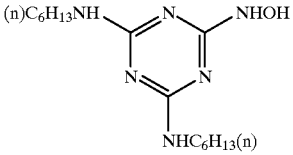
F-11
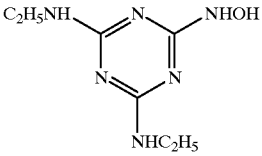
F-12
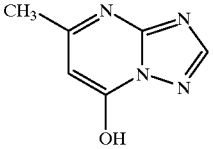
F-13
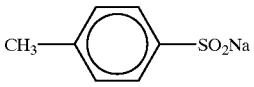
F-14
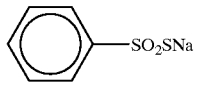

-continued

F-15

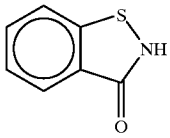

F-16

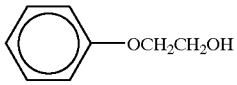

F-17

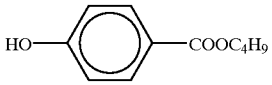

The sample 101 thus formed was wedge-exposed with white light having a color temperature of 4800K and subjected to processing A below.

| (Steps of processing A) | | |
|---|---|---|
| Step | Time | Temperature |
| Color development A | 3 min. 5 sec. | 38.0° C. |
| Bleaching | 1 min. 30 sec. | 38.0° C. |
| Fixing | 1 min. 30 sec. | 38.0° C. |
| Washing | 30 sec. | 38.0° C. |
| Stabilization | 40 sec. | 38.0° C. |
| Drying | 1 min. 30 sec. | 60° C. |

| | addition amount (g) |
|---|---|
| (Solution composition of color development A) | |
| Diethylenetriaminepentaacetic acid | 2.0 |
| 1-hydroxyethylidene-1, 1-diphosphonic acid | 3.3 |
| Sodium sulfite | 4.0 |
| Potassium carbonate | 37.5 |
| Potassium bromide | 1.4 |
| Potassium iodide | 1.3 mg |
| Disodium N, N-bis (sulfonateethyl) hydroxylamine | 5.3 |
| 2-methyl-4-(N-ethyl-N-(β-hydroxyethyl) amino) aniline sulfate | 4.5 |
| Water to make | 1.0 l |
| pH (controlled by potassium hydroxide and sulfuric acid) | 10.05 |
| (Bleaching solution) | |
| Ferric ammonium 1, 3-diaminopropane tetraacetate hydrate | 120 |
| Ammonium bromide | 80 |
| Ammonium nitrate | 14 |
| Succinic acid | 40 |
| Maleic acid | 35 |
| Water to make | 1.0 l |
| pH (controlled by ammonia water) | 4.4 |
| (Fixer) | |
| Ammonium methanesulfonate | 10 |
| Ammonium methanethiosulfonate | 4 |
| Aqueous thiosulfate ammonium solution (700 g/l) | 280 ml |
| Imidazole | 7 |
| Ethylenediaminetetraacetic acid | 15 |
| Water to make | 1.0 l |
| pH (controlled by ammonia water and acetic acid) | 7.4 |
| (Washing water) | |

Tap water was supplied to a mixed-bed column filled with an H type strongly acidic cation exchange resin (Amberlite IR-120B: available from Rohm & Haas Co.) and an OH type strongly basic anion exchange resin (Amberlite IR-400) to set the concentrations of calcium and magnesium to be 3 mg/l or less. Subsequently, 20 mg/l of sodium isocyanuric acid dichloride and 0.15 g/l of sodium sulfate were added. The pH of the solution ranged from 6.5 to 7.5.

| (Stabilizer) | addition amount (g) |
|---|---|
| Sodium p-toluenesulfinate | 0.03 |
| Polyoxyethylene-p-monononylphenylether (average polymerization degree 10) | 0.2 |
| Disodium ethylenediaminetetraacetate | 0.05 |
| 1, 2, 4-triazole | 1.3 |
| 1, 4-bis (1, 2, 4-triazole-1-ylmethyl) piperazine | 0.75 |
| 1, 2-benzoisothiazoline-3-on | 0.10 |
| Water to make | 1.0 l |
| pH | 8.5 |

After the processing, the cyan absorption density was measured to obtain a characteristic curve. A logarithm of a reciprocal of an exposure amount by which a density of minimum density+0.3 was given was defined as the sensitivity. The sensitivity was represented by a relative value assuming that the value of the sample 101 when the processing A was performed was 100.

Samples 102 to 107 were formed following the same procedure as above except that the emulsion (1) in the fourth layer of the sample 101 was changed to emulsions (2) to (7) shown in Table 1. The coating silver amounts of the emulsions (1) to (7) in the samples 101 to 107 were adjusted as follows so that equal sensitivities were obtained when the processing A was performed.

Ratios (1):(2):(3):(4):(5):(6):(7) of coating amounts of emulsions (1) to (7)=180:150:125:100:100:125:150

TABLE 1

| | Average aspect ratio | Average grain size (μm) | Characteristics of grains constituting emulsion |
|---|---|---|---|
| Emulsion (1) | 1.0 | 0.70 | Regular crystal octahedral uniform structure grain |
| Emulsion (2) | 1.0 | 0.65 | Regular crystal octahedral triple structure grain |
| Emulsion (3) | 3.5 | 0.60 | Center low iodide multiple structure fringe dislocation lines grain |
| Emulsion (4) | 7.5 | 0.55 | Center low iodide multiple structure fringe dislocation lines grain |
| Emulsion (5) | 7.5 | 0.55 | Center high iodide multiple structure fringe dislocation lines grain |
| Emulsion (6) | 7.5 | 0.60 | Uniform structure fringe dislocation lines grain |
| Emulsion (7) | 7.5 | 0.65 | Center low iodide multiple structure non-dislocation lines grain |

The emulsions (1) to (7) were prepared as follows.

To prepare the emulsions of the present invention and the comparative emulsions, seven different seed crystal emulsions I to VII were prepared. The seed crystal I consisted of silver iodobromide octahedral grains uniformly containing 6 mol % of silver iodide. The grain size (equivalent-sphere diameter) and the grain size variation coefficient were 0.325 μm and 6.5%, respectively. The seed crystal II consisted of pure silver bromide octahedral grains, and the grain size and the grain size variation coefficient were 0.30 μm and 7.7%, respectively. The seed crystal III consisted of pure silver bromide tabular grains having an average aspect ratio of 2.5. The grain size and the grain size variation coefficient were 0.28 μm and 12.5%, respectively. The seed crystal IV consisted of pure silver bromide tabular grains having an average aspect ratio of 5.5. The grain size and the grain size variation coefficient were 0.255 μm and 18%, respectively. The seed crystal V consisted of silver iodobromide tabular grains uniformly containing 7.5 mol % of silver iodide and having an average aspect ratio of 5.5. The grain size and the grain size variation coefficient were 0.255 μm and 23%, respectively. The seed crystal VI consisted of silver iodobromide tabular grains uniformly containing 4.28 mol % of silver iodide and having an average aspect ratio of 5.5. The grain size and the grain size variation coefficient were 0.28 μm and 21%, respectively. The seed crystal VII consisted of pure silver bromide tabular grains having an average aspect ratio of 5.5. The grain size and the grain size variation coefficient were 0.30 μm and 10.5%.

The emulsion (1) as a comparative emulsion was prepared as follows. The seed crystal emulsion I equivalent to 10% of the total silver amount was placed in a reactor vessel. Aqueous solutions of 2M silver nitrate and 2M sodium bromide equivalent to 90% of the total silver amount and a 0.03-μm silver iodide fine grain emulsion equivalent to 6.0 mol % of the added silver amount were added to the reactor vessel at a silver potential of −20 mV by using a flow rate accelerating addition method in which the final flow rate was 10 times the initial flow rate. Consequently, a silver iodobromide emulsion consisting of octahedral grains with a final grain size of 0.70 μm and uniformly containing 6 mol % of silver iodide was prepared as the emulsion (1).

The emulsion (2) as a comparative example was prepared as follows. The seed crystal emulsion II equivalent to 10% of the total silver amount was placed in a reactor vessel. Aqueous solutions of 2M silver nitrate and 2M sodium bromide and a 0.03-μm silver iodide fine grain emulsion equivalent to 13.3% of the added silver amount were added to the reactor vessel at a silver potential of −10 mV by using a flow rate accelerating addition method in which the final flow rate was 3 times the initial flow rate. After 45% of the total silver amount was thus consumed, the remaining 45% of the silver amount was added at −30 mV by a fixed flow rate method without adding silver iodide fine grains. Consequently, a triple structure grain emulsion consisting of octahedral grains with a final grain size of 0.65 μm and having an average silver iodide content of 6 mol % was prepared as the emulsion (2). The octahedral grain had rounded corners and contained a high silver iodide shell in it.

The emulsion (3) of the present invention was prepared as follows. The seed crystal emulsion III equivalent to 10% of the total silver amount was placed in a reactor vessel. Aqueous solutions of 2M silver nitrate and 2M sodium bromide equivalent to 30% of the total silver amount were added to the reactor vessel at −15 mV by a fixed flow rate addition method. Subsequently, these two aqueous solutions plus a 0.03 μm silver iodide fine grain emulsion equivalent to 10% of the added silver amount were added at 0 mV by using a flow rate accelerating addition method in which the final flow rate was 3 times the initial flow rate. After 30% of the total silver amount was added in this way, the silver potential was adjusted to −100 mV, and the silver iodide fine grain emulsion equivalent to 3 mol % of the total silver amount was added. Finally, the remaining aqueous solutions of silver nitrate and sodium bromide equivalent to 27% of the total silver amount were added at a fixed flow rate until the final potential was −10 mV. Consequently, a multiple structure fringe dislocation lines type emulsion was prepared as the emulsion (3). The grains of the emulsion had a final grain size of 0.60 μm and an average aspect ratio of 3.5 and contained a low iodide portion in the center.

The emulsion (4) of the present invention was prepared as follows. The seed crystal emulsion IV equivalent to 10% of the total silver amount was placed in a reactor vessel. Aqueous solutions of 2M silver nitrate and 2M silver bromide equivalent to 20% of the total silver amount were added to the reactor vessel at −25 mv by a fixed flow rate addition method. Subsequently, these two aqueous solutions plus a silver iodide fine grain emulsion equivalent to 7.5% of the added silver amount were added at −10 mV by a flow rate accelerating addition method in which the final flow rate was twice the initial flow rate. After 40% of the total silver amount was added in this way, the silver potential was adjusted to −100 mV, and the silver iodide fine grain emulsion equivalent to 3 mol % of the total silver amount was added. Finally, the remaining aqueous solutions of silver nitrate and sodium bromide equivalent to 27% of the total silver amount were added at a fixed flow rate until the final potential was −10 mV. Consequently, a multiple structure fringe dislocation lines type emulsion was prepared as the emulsion (4). The grains of the emulsion had a final grain size of 0.55 μm and an average aspect ratio of 7.5 and contained a low iodide portion in the center.

The emulsion (5) of the present invention was prepared as follows. The seed crystal emulsion V equivalent to 10% of the total silver amount was placed in a reactor vessel. Aqueous solutions of 2M silver nitrate and 2M silver bromide and a silver iodide fine grain emulsion equivalent to 7.5% of the added silver amount were added at −10 mV by a flow rate accelerating addition method in which the final flow rate was 4 times the initial flow rate, thereby adding 30% of the total silver amount. Subsequently, the solutions except for the silver iodide fine grains were added at −30 mV by using a fixed flow rate addition method. After 30% of the total silver amount was added in this way, the silver potential was adjusted to −100 mV, and the silver iodide fine grain emulsion equivalent to 3% of the total silver amount was added. Finally, the remaining aqueous solutions of silver nitrate and sodium bromide equivalent to 27% of the total silver amount were added at a fixed flow rate until the final potential was −10 mV. Consequently, a multiple structure fringe dislocation lines type emulsion was prepared as the emulsion (5). The grains of the emulsion had a final grain size of 0.55 μm and an average aspect ratio of 7.5 and contained a high iodide portion in the center.

The emulsion (6) of the present invention was prepared as follows. The seed crystal emulsion VI equivalent to 10% of the total silver amount was placed in a reactor vessel. Aqueous solutions of 2M silver nitrate and 2M silver bromide and a silver iodide fine grain emulsion equivalent to 4.28 mols of the added silver amount were added at −18 mV by a flow rate accelerating addition method in which the final flow rate was 7 times the initial flow rate. After 60% of the total silver amount was added in this way, the silver potential was adjusted to −100 mV, and the silver iodide fine grain emulsion equivalent to 3% of the total silver amount was added. Finally, the remaining aqueous solutions of silver nitrate and sodium bromide equivalent to 27% of the total silver amount were added at a fixed flow rate until the final potential was −10 mV. Consequently, a fringe dislocation lines type emulsion was prepared as the emulsion (6). The grains of the emulsion had a final grain size of 0.60 μm and an average aspect ratio of 7.5 and had no structure inside the major planes.

The emulsion (7) of the present invention was prepared as follows. The seed crystal emulsion VII equivalent to 10% of the total silver amount was placed in a reactor vessel. Aqueous solutions of 2M silver nitrate and 2M silver bromide equivalent to 30% of the total silver amount were added at −20 mV by a fixed flow rate addition method. Subsequently, these two aqueous solutions plus a silver iodide fine grain emulsion equivalent to 15% of the added silver amount were added at −10 mV by a flow rate accelerating addition method in which the final flow rate was 4 times the initial flow rate. After 40% of the total silver amount was added in this way, the remaining aqueous solutions of silver nitrate and sodium bromide equivalent to 20% of the total silver amount were added at −20 mV with a fixed flow rate. Consequently, a triple structure emulsion was prepared as the emulsion (7). The grains of the emulsion had a final grain size of 0.65 μm and an average aspect ratio of 7.5 and contained a low iodide portion in the center. No fringe dislocation lines was observed in this grain by an electron microscope.

The emulsions (1) to (7) thus prepared were desalted by washing and redispersed in a new aqueous gelatin solution. Thereafter, sensitizing dyes ExS-1, ExS-2, and ExS-3 at a molar ratio of 37:3:60 were added to each emulsion in an amount by which 90% of the total surface area of the emulsion grains was covered. Also, a sodium thiosulfate sulfur sensitizer, a selenourea selenium sensitizer, a chloroauric acid gold sensitizer, and sodium thiocyanate, were added to the resultant emulsions, and the emulsions were chemically and spectrally sensitized so that the respective optimum sensitivities were obtained.

After the samples 101 to 107 were wedge-exposed as described above, processing A', processing B, and processing C presented below were performed and the sensitivities were measured.

| Step | Time | Temperature |
|---|---|---|
| (Steps of processing A') | | |
| Color development A' | 60 sec | 45.0° C. |
| The bleaching and the subsequent steps were the same as in the processing A. | | |
| (Steps of processing B) | | |
| Color development B | 60 sec | 45.0° C. |
| The bleaching and the subsequent steps were the same as in the processing A. | | |
| (Steps of processing C) | | |
| Color development C | 60 sec | 45.0° C. |
| The bleaching and the subsequent steps were the same as in the processing A. The solution composition of the color development A' was exactly the same as that of the color development A. | | |

-continued

| | addition amount (g) |
|---|---|
| (Solution composition of color development B) | |
| Diethylenetriaminepentaacetic acid | 2.0 |
| 1-hydroxyethylidene-1, 1-diphosphonic acid | 3.3 |
| Sodium sulfite | 4.0 |
| Potassium carbonate | 37.5 |
| Potassium bromide | 2.0 |
| Potassium iodide | 1.3 mg |
| Disodium N, N-bis (sulfonateethyl) hydroxylamine | 13.0 |
| 2-methyl-4-(N-ethyl-N-(β-hydroxyethyl) amino) aniline sulfate | 11.0 |
| Water to make | 1.0 l |
| pH (controlled by potassium hydroxide and sulfuric acid) | 10.05 |
| (Solution composition of color development C) | |
| Diethylenetriaminepentaacetic acid | 2.0 |
| 1-hydroxyethylidene-1, 1-diphosphonic acid | 3.3 |
| Sodium sulfite | 4.0 |
| Potassium carbonate | 37.5 |
| Potassium bromide | 2.0 |
| Potassium iodide | 1.3 mg |
| Disodium N, N-bis (sulfonateethyl) hydroxylamine | 13.0 |
| 2-methyl-4-(N-ethyl-N-(β-hydroxyethyl) amino) aniline sulfate | 11.0 |
| Silver halide solvent (B-3) of the present invention | 1.0 mmol |
| Water to make | 1.0 l |
| pH (controlled by potassium hydroxide and sulfuric acid) | 10.05 |

The samples 101 and 102 were uniformly exposed with white light at 0.05 csm, subjected to the color developments A', B, and C, and immediately dipped into a 3% aqueous solution of acetic acid to stop the developments. The resultant samples were washed with running water, and silver halide grains in the fourth layer (medium-speed red-sensitive emulsion layer) of each sample were observed with a scanning electron microscope. In this manner the existence ratio (cavity ratio) of grains having a cavity extending through the major planes in the grains started to be developed was obtained.

The obtained results are summarized in Table 2 below.

TABLE 2

| Sample No. | Emulsion in 4th layer | Processing A' Cavity ratio | Processing A' Sensitivity | Processing B Cavity ratio | Processing B Sensitivity | Processing C Cavity ratio | Processing C Sensitivity |
|---|---|---|---|---|---|---|---|
| 101 | Emulsion (1) | 0% | 27 | 0% | 55 | 0% | 57 |
| 102 | Emulsion (2) | 0 | 30 | 0 | 65 | 3 | 68 |
| 103 | Emulsion (3) | 0 | 27 | 3 | 60 | 64 | 96 |
| 104 | Emulsion (4) | 4 | 27 | 10 | 65 | 85 | 102 |
| 105 | Emulsion (5) | 0 | 25 | 5 | 60 | 45 | 86 |
| 106 | Emulsion (6) | 0 | 20 | 0 | 55 | 22 | 82 |
| 107 | Emulsion (7) | 2 | 25 | 5 | 60 | 52 | 90 |

It is apparent from the results shown in Table 2 that when the processing C using the color developing solution C of the present invention was performed for the emulsions (3) to (7), the cavity ratio of the silver halide grains exceeded 20% and a high sensitivity was obtained for a color development time of 60 sec.

Also, comparison of the emulsion (3) with the emulsion (4) shows that grains having an average aspect ratio of 5 or more are more preferable. Comparison of the emulsions (4), (5), and (6) shows that a multiple structure is preferred to a uniform structure as the halogen composition of a grain, and particularly a multiple structure grain having a low iodide portion in its center is preferable. As can be seen by comparing the emulsion (4) with the emulsion (7), it is preferable that fringe dislocations lines be contained in grains.

Example 2

A color developing solution was prepared following the same procedures as for the color developing solution C in Example 1 except that the addition amount of the silver halide solvent (B-3) of the present invention was changed. The sample 104 was processed by using this color developing solution, and the sensitivities and the cavity ratios were obtained. The obtained results are summarized in Table 3 below.

TABLE 3

| Sample No. | Addition amount (mmol/l) of silver halide solvent of present invention | Cavity ratio (%) | Sensitivity | Remarks |
|---|---|---|---|---|
| 104 | 0.1 | 26 | 85 | Present invention |
| 140 | 0.2 | 43 | 92 | Present invention ○ |
| 140 | 0.5 | 65 | 95 | Present invention ◎ |
| 140 | 1.0 | 85 | 102 | Present invention ◎ |
| 140 | 5.0 | 62 | 95 | Present invention ◎ |
| 140 | 10.0 | 42 | 90 | Present invention ○ |
| 140 | 50.0 | 21 | 82 | Present invention |

○ indicates a preferable sample and
◎ indicates a particularly preferable sample of the present invention.

Example 3

Following the same procedures as in Example 1 except that the silver halide solvent (B-3) of the present invention was changed to equal molar amounts of other solvents as shown in Table 4, the samples 101 and 104 were processed and the sensitivities and the cavity ratios were obtained. The obtained results are summarized in Table 4 below.

TABLE 4

| Sample No. | Silver halide solvent | Cavity ratio (%) | Sensitivity | Remarks |
|---|---|---|---|---|
| 101 | $Na_2S_2O_3$ | 0 | 45 | Comparative example |
| " | A-1 | 0 | 48 | " |
| " | B-8 | 0 | 48 | " |
| 104 | $Na_2S_2O_3$ | 41 | 85 | Present invention |
| " | $CH_3SO_2S.Na$ | 48 | 86 | " |
| " | KSCN | 29 | 81 | " |
| " | A-1 | 80 | 90 | " |
| " | A-3 | 82 | 92 | " |
| " | A-4 | 77 | 88 | " |
| " | A-8 | 72 | 88 | " |
| " | A-9 | 40 | 85 | " |
| " | A-14 | 25 | 82 | " |
| " | B-8 | 81 | 100 | " |
| " | B-9 | 85 | 100 | " |
| " | B-12 | 87 | 100 | " |
| " | B-45 | 42 | 88 | " |
| " | B-50 | 61 | 92 | " |
| " | C-6 | 28 | 82 | " |
| " | C-27 | 25 | 80 | " |
| " | D-2 | 41 | 82 | " |
| " | D-3 | 65 | 90 | " |
| " | D-9 | 24 | 80 | " |
| " | D-28 | 25 | 80 | " |

It is evident from the results shown in Table 4 that the effect of the present invention was found in the various silver halide solvents of the present invention.

Example 4

Samples 108 to 112 were formed following the same procedures as for the sample 104 in Example 1 except that the cyan coupler ExC-6 (the same as the compound (4) of the present invention) in the fourth layer was changed to equal molar amounts of compounds of the present invention listed in Table 5 and the coating silver amount of the fourth layer was properly changed so that the sensitivity was 100 when the processing A was performed. The processing C in Example 1 was performed for the resultant samples, and the cavity ratios and the sensitivities were obtained. The obtained results are summarized in Table 5 below.

TABLE 5

| Sample No. | Compound of present invention | Cavity ratio (%) | Sensitivity | Remarks |
|---|---|---|---|---|
| 108 | non | 21 | 80 | Present invention |
| 109 | (1) | 48 | 85 | Present invention ○ |
| 110 | (6) | 45 | 85 | Present invention ○ |
| 111 | (11) | 65 | 88 | Present invention ◎ |
| 112 | (15) | 80 | 97 | Present invention ◎ |
| 113 | (19) | 62 | 88 | Present invention ◎ |
| 114 | (22) | 78 | 92 | Present invention ◎ |
| 115 | (33) | 81 | 100 | Present invention ◎ |
| 116 | (36) | 88 | 102 | Present invention ◎ |
| 117 | (37) | 80 | 100 | Present invention ◎ |

○ indicates a preferable sample and
◎ indicates a particularly preferable sample of the present invention.

It is apparent from the results shown in Table 5 that the cavity ratio and the sensitivity were preferably increased when any compound of the present invention which reacts with an oxidized form of a color developing agent and releases a development inhibitor was contained.

Example 5

The processing C was performed for the samples 101 to 107 in Example 1, and the graininess, sharpness, and color reproduction were evaluated as follows. The obtained results are summarized in Table 6.

(1) Graininess

After the processing, a graininess (RMS value) at which a cyan density of minimum density+0.5 was obtained was measured by using an aperture having a diameter of 48 $\mu$m. Each measured graininess was represented by a relative value assuming that the RMS value when the processing C was performed for the sample 101 was 100. Smaller RMS values indicate better graininess.

(2) Sharpness

Each sample was given rectangular exposure at 25 cycles/mm and subjected to the processing C, and an MTF value of the cyan density was obtained. Each XTF value was represented by a relative value assuming that the MTF value when the processing C was performed for the sample 101 was 100. The measurement of the MTF value was performed in accordance with a method described in The Theory of The Photographic Process, the 4th ed. (T. H. James, Macmillan), pp. 592 to 618. Larger MTF values indicate higher sharpnesses.

(3) Color reproduction

After each sample was uniformly exposed with red light at 0.2 cms, the sample was wedge-exposed with green light and subjected to the processing C. Color reproduction was evaluated by calculating a value obtained by subtracting a cyan density at an exposure amount by which a minimum magenta density was obtained from a cyan density at an exposure amount by which a magenta density of minimum density+1.5 was obtained. As this value decreases, unclear colors decrease. Also, as the value increases in the negative direction, the vividness of colors further increases. Both indicate a high color reproduction.

TABLE 6

| Sample No. | Cavity ration | Processing C Graininess (RMS value) | Sharpness (MTF value) | Color reproduction | Remarks |
|---|---|---|---|---|---|
| 101 | 0% | 100 | 100 | 0.01 | Comparative example |
| 102 | 3 | 98 | 105 | 0.02 | Comparative example |
| 103 | 64 | 80 | 125 | −0.08 | Present invention |
| 104 | 85 | 75 | 138 | −0.12 | Present invention |
| 105 | 45 | 85 | 115 | −0.05 | Present invention |
| 106 | 22 | 88 | 110 | −0.02 | Present invention |
| 107 | 52 | 82 | 112 | −0.02 | Present invention |

It is preferable that the values of graininess and color reproduction be as small as possible and the value of sharpness be as large as possible It is evident from the results shown in Table 6 that the graininess, sharpness, and color reproduction were greatly improved in each sample of the present invention in which the cavity ratio exceeded 20%.

What is claimed is:

1. A method for forming images comprising: i) imagewise exposing a silver halide photographic light-sensitive material having at least one silver halide emulsion layer on a support, wherein the silver halide emulsion layer contains a silver halide emulsion comprising tabular silver halide grains not containing a hole extending through two major planes opposing each other, having a silver halide composition of silver chloroiodobromide or silver iodobromide wherein the silver iodide content is from 1 to 15 mol % and the silver chloride content is 10 mol % or less, and having an average aspect ratio of 1.5 or more, wherein 20% or more of said tabular silver halide grains contain a hole extending through the major planes when said silver halide emulsion is developed with a color developing solution containing 2.0 g of Diethylenetriaminepentaacetic acid, 3.3 g of 1-hydroxyethylidene-1,1-diphosphonic acid, 4.0 g of Sodium sulfite, 37.5 g of Potassium carbonate, 2.0 g of Potassium bromide, 1.3 mg of Potassium iodide, 13.0 g of Disodium N,N-bis(sulfonate ethyl) hydroxylamine, 11.0 g of 2-methyl-4-(N-ethyl-N-(β-hydroxyethyl)amino) aniline sulfate 1.0 mmol silver halide solvent of the formula

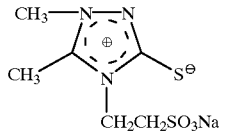

which can also be written as follows

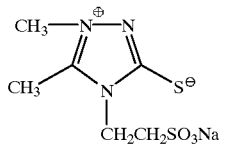

water to make 1.0 l, the pH of said color developing solution being controlled by potassium hydroxide or sulfuric acid to pH of about 10.05 for 60 sec;

and ii) performing color development for 25 to 90 sec with a color developing solution containing at least one silver halide solvent selected from the group consisting of thiosulfate, methanethiosulfonate, thiocyanate and the compound represented by the Formulae (A) to (E) below:

Formula (A)

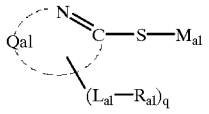

wherein $Q_{a1}$ represents a nonmetal atom group necessary to form a 5- or 6-membered heterocyclic ring which can be condensed with a carbon aromatic ring or a hetero aromatic ring, $L_{a1}$ represents a single bond, a divalent aliphatic group, a divalent aromatic hydrocarbon group, a divalent heterocyclic group, or a linking group as a combination thereof, $R_{a1}$ represents carboxylic acid or a salt thereof, sulfonic acid or a salt thereof, phosphonic acid or a salt thereof, an amino group or ammonium salt, q represents any integer from 1 to 3, and $M_{a1}$ represents a hydrogen atom or a cation;

Formula (B)

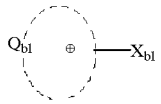

wherein $Q_{b1}$ represents a 5- or 6-membered mesoionic ring constituted by a carbon atom, a nitrogen atom, an oxygen atom, a sulfur atom, or a selenium atom, $X_{b1}$- represents —$O^-$, —$S^-$, or —$N^-R_{b1}$, and $R_{b1}$ represents an aliphatic group, an aromatic hydrocarbon group, or a heterocyclic group;

Formula (C)

$$L_{c1}—(A_{c1}—L_{c2})_r—A_{c2}—L_{c3}$$

wherein $L_{C1}$ and $L_{C3}$ can be the same or different and each represents an aliphatic group, an aromatic hydrocarbon group, or a heterocyclic group, $L_{C2}$ represents a divalent aliphatic group, a divalent aromatic hydrocarbon group, a divalent heterocyclic linking group, or a linking group as a combination thereof, each of $A_{C1}$ and $A_{C2}$ represents —S—, —O—, —$NR_{C20}$—, —CO—, —$SO_2$—, or a group as a combination thereof, r represents any integer from 1 to 10, at least one of $L_{C1}$and $L_{C3}$ being substituted by —$SO_3M_{C1}$, —$PO_3M_{C2}M_{C3}$, —$NR_{C1}(R_{C2})$, —$N^+R_{C3}(R_{C4})(R_{C5})$ $X_{C1}^-$, —$SO_2NR_{C6}(R_{C7})$, —$NR_{C8}SO_2R_{C9}$, —$CONR_{C10}(R_{C11})$, —$NR_{C12}COR_{C13}$, —$SO_2R_{C14}$, —$PO(—NR_{C15}(R_{C16}))_2$, —$NR_{C17}CONR_{C18}(R_{C19})$, —$COOM_{C4}$, or a heterocyclic group, $M_{C1}$, $M_{C2}$, $M_{C3}$, and $M_{C4}$ can be the same or different and each represents a hydrogen atom or a counter cation, $R_{C1}$ to $R_{C20}$ can be the same or different and each represents a hydrogen atom, a substituted or unsubstituted 1- to 12-carbon aliphatic group, or a substituted or unsubstituted 6- to 12-carbon aromatic group, and $X_{C1}^-$ represents a counter anion, at least one of $A_{C1}$ and $A_{C2}$ representing —S—;

Formula (D)

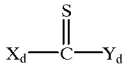

wherein each of $X_d$ and $Y_d$ represents an aliphatic group, an aromatic hydrocarbon group, a heterocyclic group, —$N(R_{d1})R_{d2}$, —$N(R_{d3})N(R_{d4})R_{d5}$, —$OR_{d6}$, or —$SR_{d7}$, $X_d$ and $Y_d$ may be bonded to each other to form a ring but being not enolized, and at least one of $X_d$ and $Y_d$ being substituted by carboxylic acid or a salt thereof, sulfonic acid or a salt thereof, phosphonic acid or a salt thereof, an amino group, an ammonium group, or a hydroxyl group, each of $R_{d1}$, $R_{d2}$, $R_{d3}$, $R_{d4}$, and $R_{d5}$ represents a hydrogen atom, an aliphatic group, an aromatic hydrocarbon group, or a heterocyclic group, and each of $R_{d6}$ and $R_{d7}$ represents a hydrogen atom, a cation, an aliphatic group, an aromatic hydrocarbon group, or a heterocyclic group;

Formula (E)

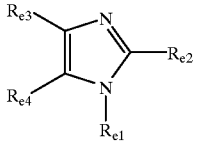

wherein each of $R_{e1}$, $R_{e2}$, $R_{e3}$, and $R_{e4}$ represents a hydrogen atom, an alkyl group, or an alkenyl group.

2. The method according to claim 1, wherein said silver halide solvent is the compound represented by the Formula (A) or (B) below:

Formula (A)

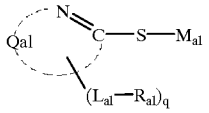

wherein $Q_{a1}$ represents a nonmetal atom group necessary to form a 5- or 6-membered heterocyclic ring which can be condensed with a carbon aromatic ring or a hetro aromatic ring, $L_{a1}$ represents a single bond, a divalent aliphatic group, a divalent aromatic hydrocarbon group, a divalent heterocyclic group, or a linking group as a combination thereof, $R_{a1}$ represents carboxylic acid or a salt thereof, sulfonic acid or a salt thereof, phosphonic acid or a salt thereof, an amino group or ammonium salt, q represents any integer from 1 to 3, and $M_{a1}$ represents a hydrogen atom or a cation;

Formula (B)

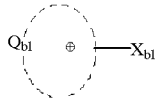

wherein $Q_{b1}$ represents a 5- or 6-membered meso-ionic ring constituted by a carbon atom, a nitrogen atom, an oxygen atom, a sulfur atom, or a selenium atom, $X_{b1}$ represents —$O^-$, —$S^-$, or —$N^-$to $R_{b1}$, and $R_{b1}$ represents an aliphatic group, an aromatic hydrocarbon group, or a heterocyclic group.

3. The method according to claim 2, wherein said silver halide solvent is the compound represented by the Formula (A-1) or (B-1) below:

Formula (A-1)

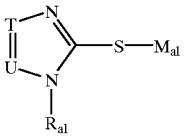

wherein each of $M_{a1}$ and $R_{a1}$ has the same meaning as in Formula (A), each of T and U represents C—$R_{a2}$ or N, $R_{a2}$ represents a hydrogen atom, a hydroxy group, a nitro group, an alkyl group, an alkenyl group, an aralkyl group, an aryl group, a carbonamide group, a sulfonamide group, a ureido group, or a 1- to 4-carbon alkyl group substituted by one or two groups selected from the group consisting of a carboxylic acid, a salt of a carboxylic acid, a sulfonic acid and a salt of a sulfonic acid;

Formula (B-1)

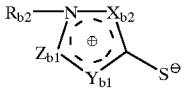

wherein $X_{b2}$ represents N or C—$R_{b3}$, $Y_{b1}$ represents O, S, N, or N—$R_{b4}$, $Z_{b1}$ represents N, N—$R_{b5}$, or C—$R_{b6}$; each of $R_{b2}$, $R_{b3}$, $R_{b4}$, $R_{b5}$ and $R_{b6}$ represents an aliphatic group, an aromatic group, a heterocyclic group, an amino group, an acylamino group, a sulfonamide group, a ureido group, a sulfamoylamino group, an acyl group, or a carbamoyl group; $R_{b3}$ and $R_{b6}$ can be a hydrogen atom; each pair of $R_{b2}$ and $R_{b3}$, $R_{b2}$ and $R_{b5}$, $R_{b2}$ and $R_{b6}$, $R_{b4}$ and $R_{b5}$, and $R_{b4}$ and $R_{b6}$ may be bonded to each other to form a ring.

4. The method according to claim 3, wherein said silver halide solvent is the compound represented by the Formula (B-1) below:

Formula (B-1)

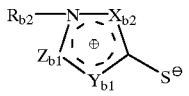

wherein $X_{b2}$ represents N, $Y_{b1}$ represents N—$R_{b4}$, and $Z_{b1}$ represents C—$R_{b6}$, each of $R_{b2}$ and $R_{b4}$ represents a 1- to 3-carbon alkyl group, $R_{b6}$ represents a hydrogen atom or a 1- to 3-carbon alkyl group, at least one alkyl group of $R_{b2}$, $R_{b4}$, and $R_{b6}$ is substituted by a carboxylic acid group or a sulfonic acid group.

5. The method according to claim 2, wherein said silver halide solvent is the compound represented by the Formula (A-1) below:

Formula (A-1)

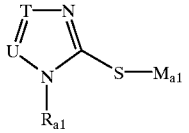

wherein T=U=N and $R_{a1}$ represents a 1- to 4-carbon alkyl group substituted by one or two groups selected from carboxylic acid or its salt and sulfonic acid or its salt.

6. The method according to claim 1, wherein said photographic light-sensitive material further comprises a compound that reacts with an oxidized form of a color developing agent and releases a compound that decreases the solubility of a silver halide.

7. The method according to claim 6, wherein said compound which releases a compound which decreases a solubility of a silver halide is represented by Formula (I) below:

$$A—\{(L1)_a—(B)_m\}_p—(L2)_n—DI \qquad \text{Formula (I)}$$

wherein A represents a group which reacts with an oxidized form of an aromatic primary amine developer and cleaves $\{(L1)_a—(B)_m\}_p—(L2)_n—DI$, L1 represents a group which cleaves a right-hand bond with $(B)_m$ after a bond at the left of L1 indicated by Formula (I) cleaves, B represents a group which reacts with the developing agent oxidized form and cleaves a bond at the left of L2 indicated by Formula (I), L2 represents a group which cleaves a right-hand bond with DI after the bond at the left of L2 indicated by Formula (I) cleaves, DI represents a development inhibitor, each of a, m, and n represents 0 or 1, p represents any integer from 0 to 2, and, if a plurality of $\{(L1)_a—(B)_m\}$ units are present, said units can be the same or different.

* * * * *